US012529370B2

(12) United States Patent
Polly et al.

(10) Patent No.: US 12,529,370 B2
(45) Date of Patent: Jan. 20, 2026

(54) SUMP PUMP SYSTEM, INCLUDING SUMP PUMP MONITOR AND APPLICATION

(71) Applicant: Fortune Brands Water Innovations LLC, North Olmsted, OH (US)

(72) Inventors: George John Polly, Brecksville, OH (US); Brian Patrick Frackelton, Macedonia, OH (US); Gretchen Thekla Woodling, Munroe Falls, OH (US)

(73) Assignee: Fortune Brands Water Innovations LLC, North Olmsted, OH (US)

( * ) Notice: Subject to any disclaimer, the term of this patent is extended or adjusted under 35 U.S.C. 154(b) by 268 days.

(21) Appl. No.: 17/866,121

(22) Filed: Jul. 15, 2022

(65) Prior Publication Data

US 2023/0019795 A1 Jan. 19, 2023

Related U.S. Application Data

(60) Provisional application No. 63/255,229, filed on Oct. 13, 2021, provisional application No. 63/255,235, filed on Oct. 13, 2021, provisional application No. 63/221,983, filed on Jul. 15, 2021.

(51) Int. Cl.

| | |
|---|---|
| ***F04B 49/06*** | (2006.01) |
| ***F04B 17/03*** | (2006.01) |
| ***F04B 23/02*** | (2006.01) |
| ***F04B 51/00*** | (2006.01) |

(52) U.S. Cl.

CPC ..... *F04B 49/065* (2013.01); *F04B 17/03* (2013.01); *F04B 23/021* (2013.01); *F04B 51/00* (2013.01); *F04B 2203/0201* (2013.01)

(58) Field of Classification Search

CPC ..... F04B 49/065; F04B 17/03; F04B 23/021; F04B 2203/0201; F04B 23/04; F04B 49/02; F04B 51/00

See application file for complete search history.

(56) References Cited

U.S. PATENT DOCUMENTS

| | | | |
|---|---|---|---|
| 4,369,438 | A | 1/1983 | Wilhelmi |
| 4,396,353 | A | 8/1983 | MacDonald |
| 4,808,865 | A | 2/1989 | King |

(Continued)

FOREIGN PATENT DOCUMENTS

| | | | |
|---|---|---|---|
| CA | 2838904 | A1 | 12/2017 |

OTHER PUBLICATIONS

International Search Report for International App. No. PCT/US2022/037327 dated Oct. 28, 2022 (2 pages).

(Continued)

*Primary Examiner* — Dominick L Plakkoottam

(74) *Attorney, Agent, or Firm* — Calfee, Halter & Griswold LLP

(57) ABSTRACT

The present invention provides a sump pump system, including a sump pump monitor and application. The sump pump system includes a sump pump. Components of the sump pump system are installed in and/or near a sump. The sump collects liquid, such as water, from an inlet pipe. The sump pump is operable to remove water from the sump. The sump pump is fluidly connected to a discharge pipe. The discharge pipe is operable to carry water from the sump pump to a storm sewer or other discharge point.

20 Claims, 49 Drawing Sheets

(56) References Cited

U.S. PATENT DOCUMENTS

| | | | | |
|---|---|---|---|---|
| 5,071,370 | A | 12/1991 | Kochan, Jr. | |
| 5,672,050 | A | 9/1997 | Webber et al. | |
| 5,919,706 | A | 7/1999 | Tajima | |
| 6,276,901 | B1 | 8/2001 | Farr et al. | |
| 6,356,467 | B1 | 3/2002 | Belehradek, Jr. | |
| 6,364,620 | B1 | 4/2002 | Fletcher et al. | |
| 6,366,053 | B1 | 4/2002 | Belehradek | |
| 6,375,430 | B1 | 4/2002 | Eckert et al. | |
| 6,430,757 | B1 | 8/2002 | Pohler | |
| 6,443,715 | B1 | 9/2002 | Mayleben et al. | |
| 6,464,531 | B2 | 10/2002 | Eckert et al. | |
| 6,640,196 | B1 | 10/2003 | Unsworth et al. | |
| 6,649,839 | B2 | 11/2003 | Eckert et al. | |
| 6,676,382 | B2 | 1/2004 | Leighton et al. | |
| 6,741,442 | B1 | 5/2004 | McNally et al. | |
| 6,758,051 | B2 | 7/2004 | Jayanth et al. | |
| D500,770 | S | 1/2005 | Pohler | |
| 7,145,467 | B2 | 12/2006 | Abel et al. | |
| 7,309,216 | B1 | 12/2007 | Spadola, Jr. et al. | |
| 7,520,736 | B2 | 4/2009 | Pohler | |
| 7,537,439 | B2 | 5/2009 | Pohler | |
| 7,563,082 | B2 | 7/2009 | Pohler | |
| 7,615,954 | B1 | 11/2009 | Potter et al. | |
| 7,768,414 | B2 | 8/2010 | Abel et al. | |
| 7,843,081 | B2 | 11/2010 | Lim | |
| 8,149,122 | B2 | 4/2012 | Burza | |
| 8,226,371 | B2 | 7/2012 | Kochan | |
| 8,297,937 | B2 | 10/2012 | Johnson | |
| 8,380,355 | B2 | 2/2013 | Mayleben et al. | |
| 8,409,124 | B2 | 4/2013 | Steffens et al. | |
| 8,500,412 | B2 | 8/2013 | Williams et al. | |
| 8,523,532 | B1 | 9/2013 | Pohler | |
| 8,535,014 | B2 | 9/2013 | Burch, Jr. et al. | |
| 8,562,287 | B2 | 10/2013 | Schmidt et al. | |
| 8,774,972 | B2 | 7/2014 | Rusnak et al. | |
| 8,888,465 | B1 | 11/2014 | Pohler | |
| 8,907,789 | B2 | 12/2014 | Kochan, Jr. et al. | |
| 9,074,587 | B2 | 7/2015 | Atchia | |
| D740,329 | S | 10/2015 | Gilbert et al. | |
| D740,698 | S | 10/2015 | Cummings | |
| D741,815 | S | 10/2015 | Cummings | |
| 9,157,434 | B2 | 10/2015 | Leonard et al. | |
| 9,383,244 | B2 | 7/2016 | Bishop et al. | |
| 9,404,501 | B2 | 8/2016 | Cummings | |
| 9,441,632 | B2 | 9/2016 | Bishop et al. | |
| 9,500,193 | B2 | 11/2016 | Knight et al. | |
| 9,500,194 | B2 | 11/2016 | Knight et al. | |
| 9,523,366 | B2 | 12/2016 | Cummings et al. | |
| 9,525,309 | B2 * | 12/2016 | Cummings | F04D 13/086 |
| 9,528,512 | B2 | 12/2016 | Cummings | |
| 9,528,520 | B2 | 12/2016 | Cummings | |
| 9,528,522 | B2 | 12/2016 | Cummings | |
| 9,528,523 | B2 | 12/2016 | Cummings | |
| 9,528,873 | B2 | 12/2016 | Cummings | |
| 9,534,593 | B2 | 1/2017 | Cummings et al. | |
| 9,534,606 | B2 | 1/2017 | Cummings | |
| 9,696,360 | B2 | 7/2017 | Rothbart | |
| 9,709,054 | B2 | 7/2017 | Cummings | |
| 9,709,431 | B1 * | 7/2017 | Kinney | E03F 1/002 |
| 9,920,766 | B2 | 3/2018 | Bishop et al. | |
| 9,927,479 | B2 | 3/2018 | Rothbart | |
| 9,958,878 | B2 * | 5/2018 | Kochan, Jr. | F04B 41/06 |
| 9,989,397 | B1 | 6/2018 | Kinney et al. | |
| 10,082,268 | B2 | 9/2018 | Peterson et al. | |
| 10,162,369 | B2 | 12/2018 | McCrossen et al. | |
| 10,208,747 | B2 | 2/2019 | Cummings | |
| 10,233,940 | B2 | 3/2019 | Pohler | |
| 10,585,011 | B2 | 3/2020 | Banta | |
| 10,711,788 | B2 | 7/2020 | Mayleben | |
| 11,041,908 | B2 | 6/2021 | Rothbart | |
| 2003/0049134 | A1 | 3/2003 | Leighton et al. | |
| 2003/0115890 | A1 | 6/2003 | Jayanth et al. | |
| 2005/0232796 | A1 | 10/2005 | Pohler | |
| 2006/0072269 | A1 | 4/2006 | Staples | |
| 2006/0228222 | A1 | 10/2006 | Pohler | |
| 2007/0144564 | A1 | 6/2007 | Gadini et al. | |
| 2008/0031751 | A1 | 2/2008 | Littwin et al. | |
| 2009/0185914 | A1 | 7/2009 | Elnar | |
| 2009/0317259 | A1 | 12/2009 | Burch, Jr. et al. | |
| 2010/0135823 | A1 | 6/2010 | Andy | |
| 2010/0319116 | A1 | 12/2010 | Schmidt et al. | |
| 2011/0085919 | A1 | 4/2011 | Williams et al. | |
| 2011/0273288 | A1 | 11/2011 | Kochan, Jr. et al. | |
| 2011/0311370 | A1 | 12/2011 | Sloss et al. | |
| 2013/0197700 | A1 | 8/2013 | Kochan, Jr. et al. | |
| 2013/0201316 | A1 | 8/2013 | Binder et al. | |
| 2014/0202243 | A1 | 7/2014 | Leonard et al. | |
| 2015/0002658 | A1 | 1/2015 | Jaw et al. | |
| 2015/0143892 | A1 | 5/2015 | Cummings | |
| 2017/0114790 | A1 | 4/2017 | Pohler | |
| 2017/0326282 | A1 | 11/2017 | Wilt et al. | |
| 2018/0010762 | A1 | 1/2018 | Peterson et al. | |
| 2018/0011498 | A1 | 1/2018 | McCrossen et al. | |
| 2018/0163730 | A1 * | 6/2018 | Wilds | F04D 13/086 |
| 2018/0196097 | A1 * | 7/2018 | Rothbart | G01R 31/343 |
| 2018/0262131 | A1 * | 9/2018 | Russick | B63B 13/00 |
| 2018/0291911 | A1 | 10/2018 | Ward et al. | |
| 2019/0353156 | A1 * | 11/2019 | Ward | F04B 49/065 |
| 2020/0003217 | A1 * | 1/2020 | Wilds | F04D 15/0016 |
| 2020/0040915 | A1 | 2/2020 | Pohler et al. | |
| 2020/0132068 | A1 * | 4/2020 | Rupp | F04B 49/10 |
| 2020/0209092 | A1 | 7/2020 | Banta | |
| 2023/0014325 | A1 | 1/2023 | Lance et al. | |

OTHER PUBLICATIONS

Written Opinion of the International Searching Authority of International App. No. PCT/US2022/037327 dated Oct. 28, 2022 (8 pages).

International Search Report for International App. No. PCT/US2022/037334 dated Dec. 15, 2022 (4 pages).

Written Opinion of the International Searching Authority of International App. No. PCT/US2022/037334 dated Dec. 15, 2022 (6 pages).

Author unknown, Allegro Microsystems ACS716 120 KHz Bandwidth, High-Voltage Isolation Current Sensor with Integrated Overcurrent Detection Product Materials, at least a version of the product shown in the Product Materials is believed to have been publicly available prior to Jul. 15, 2021 (23 pages).

Paul Lamkin, Ambient Article re Best smart home hubs 2022: Do more by picking the perfect hub (available at https://web.archive.org/web/20220612215747/www.the-ambient.com/buyers-guides/best-smart-home-hubs-2599—retrieved on Jul. 12, 2023), the Ambient Article is believed to have been publicly available prior to Jul. 15, 2022 (19 pages).

Author unknown, The Basement Watchdog Connect WiFi Module Instruction Manual, at least a version of the product shown in the Instruction Manual is believed to have been publicly available prior to Jul. 15, 2021 (10 pages).

Author unknown, Beacon ProAct 200 System Installation Guide, at least a version of the product shown in the Installation Guide is believed to have been publicly available prior to Jul. 15, 2021 (20 pages).

Author unknown, Hydropump RH1400 Battery Powered Backup Sump Product Materials, at least a version of the product shown in the Product Materials is believed to have been publicly available prior to Jul. 15, 2021 (4 pages).

Author unknown, Ion Genesis II Pump Controller Operation Manual, at least a version of the product shown in the Operation Manual is believed to have been publicly available prior to Jul. 15, 2021 (8 pages).

Author unknown, Level Sense Pro User Manual, at least a version of the product shown in the User Manual is believed to have been publicly available prior to Jul. 15, 2021 (24 pages).

Author unknown, Liberty Pumps ALM-Series Indoor Alarms Installation Manual, at least a version of the product shown in the Installation Manual is believed to have been publicly available prior to Jul. 15, 2021 (6 pages).

(56) References Cited

OTHER PUBLICATIONS

Author unknown, Liberty Pumps 442 Series Battery Backup System Installation Manual, at least a version of the product shown in the Installation Manual is believed to have been publicly available prior to Jul. 15, 2021 (12 pages).
Author unknown, Liberty Pumps SumpJet Water Powered Backup System Installation Manual, at least a version of the product shown in the Installation Manual is believed to have been publicly available prior to Jul. 15, 2021 (8 pages).
Rachel Murphy, This Smart Sump Pump Monitor Can Prevent Water Leaks Article, Moen's new sump pump monitoring system alerts you before potential water damage occurs (available at https://reviewed.usatoday.com/smarthome/features/moen-smart-sump-pump-monitor-ces—retrieved on Jul. 12, 2023), the product shown in the Article was publicly available prior to Jul. 15, 2021 (3 pages).
Author unknown, NexPump Ai Manual, at least a version of the product shown in the Manual is believed to have been publicly available prior to Jul. 15, 2021 (26 pages).
Author unknown, NexPump Installation Guide, at least a version of the product shown in the Installation Guide is believed to have been publicly available prior to Jul. 15, 2021 (2 pages).
Author unknown, Pro Series Pumps 2400 Battery Backup Sump Pump System Product Materials, at least a version of the product shown in the Product Materials is believed to have been publicly available prior to Jul. 15, 2021 (2 pages).
Author unknown, Pro Series Pumps WiFi Module Instruction Manual, at least a version of the product shown in the Instruction Manual is believed to have been publicly available prior to Jul. 15, 2021 (12 pages).
Author unknown, Proteus PRO User Guide, at least a version of the product shown in the User Guide is believed to have been publicly available prior to Jul. 15, 2021 (20 pages).
Author unknown, Proteus How to Install Electric Load Sensor Installation Materials, at least a version of the product shown in the Installation Materials is believed to have been publicly available prior to Jul. 15, 2021 (5 pages).
Author unknown, Proteus How to Install Laser Level Sensor Installation Materials, at least a version of the product shown in the Installation Materials is believed to have been publicly available prior to Jul. 15, 2021 (3 pages).
Author unknown, Proteus How to Install Water Level Sensor Installation Materials, at least a version of the product shown in the Installation Materials is believed to have been publicly available prior to Jul. 15, 2021 (4 pages).
Author unknown, PumpSpy WiFi Connected Battery Backup Sump Pump & Monitoring System Installation and Operating Instructions, at least a version of the product shown in the Installation and Operating Instructions is believed to have been publicly available prior to Jul. 15, 2021 (8 pages).
Author unknown, PumpSpy Sump Pump Smart Outlet Specifications and Installation Materials, at least a version of the product shown in the Specifications and Installation Materials is believed to have been publicly available prior to Jul. 15, 2021 (2 pages).
Author unknown, STMicroelectronics VL53LOX Time-of-Flight ranging sensor Datasheet, at least a version of the product shown in the Datasheet is believed to have been publicly available prior to Jul. 15, 2021 (38 pages).
Author unknown, STMicroelectronics VL53LOX ranging module cover window guidelines AN4907 Application note, at least a version of the product shown in the Application note is believed to have been publicly available prior to Jul. 15, 2021 (21 pages).
Author unknown, Wayne Basement Guardian Wi-Fi Module Quick Start Guide, at least a version of the product shown in the Quick Start Guide is believed to have been publicly available prior to Jul. 15, 2021 (12 pages).
Author unknown, WiOn Smart Wifi Plug Installation Instructions (available at https://www.wionconnect.com/wion-50055-setup/—retrieved on Aug. 29, 2023), at least a version of the product shown in the Installation Instructions is believed to have been publicly available prior to Jul. 15, 2021 (6 pages).
Author unknown, Zoeller Pump Company APak Alarm Installation Instructions, at least a version of the product shown in the Installation Instructions is believed to have been publicly available prior to Jul. 15, 2021 (24 pages).
Author unknown, Zoeller Pump Company APak Indoor Alarm Technical Data Sheet, at least a version of the product shown in the Technical Data Sheet is believed to have been publicly available prior to Jul. 15, 2021 (2 pages).
Author unknown, Zoeller Pump Company AquaNot Fit 508 Installation Instructions, at least a version of the product shown in the Installation Instructions is believed to have been publicly available prior to Jul. 15, 2021 (12 pages).
Author unknown, Zoeller Pump Company AquaNot Fit 508 Technical Data Sheet, at least a version of the product shown in the Technical Data Sheet is believed to have been publicly available prior to Jul. 15, 2021 (2 pages).
Office Action issued by U.S. Patent and Trademark Office for U.S. Appl. No. 17/866,079 dated Mar. 27, 2024 (43 pages).

* cited by examiner

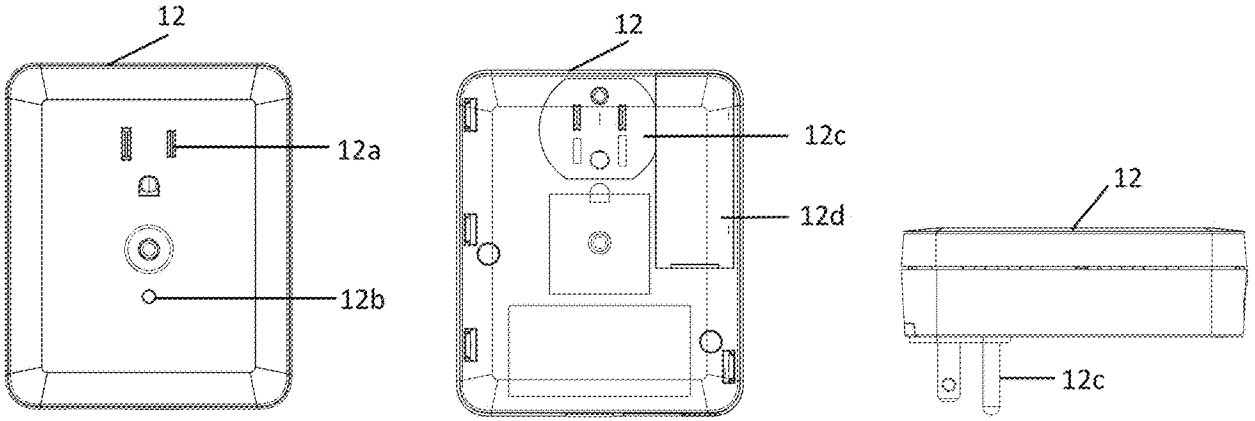
Figure 11c
Figure 11d
Figure 11e
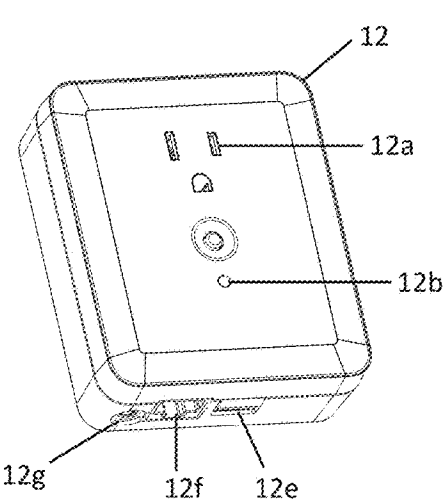
Figure 11b
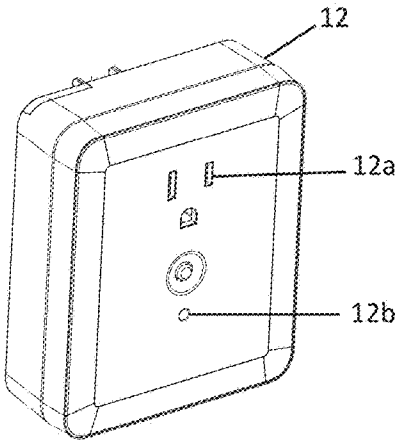
Figure 11a

| Water Level State | Primary Pump Running State | Last Primary Pump Health State | Current Primary Pump Health State | Flood Risk |
|---|---|---|---|---|
| Green | Not Running | Operational | Operational | Normal |
| Green | Not Running | Lagging | Lagging | Caution |
| Green | Not Running | Failed | Failed | Caution |

Figure 12

| Water Level State | Primary Pump Running State | Current Primary Pump Health State | Flood Risk |
|---|---|---|---|
| Orange | Running | Lagging | High |
| Orange | Not Running | Failed | High |

Figure 13

| Water Level State | Primary Pump Running State | Current Primary Pump Health State | Flood Risk |
|---|---|---|---|
| Red | Running | Lagging | High |
| Red | Not Running | Failed | High |

Figure 14

| Water Level State | Primary Pump Running State | Backup Pump Available State | Last Primary Pump Health State | Last Backup Pump Health State | Current Primary Pump Health State | Current Backup Pump Health State | Flood Risk |
|---|---|---|---|---|---|---|---|
| Green | Not Running | Not Available | Operational | Not Applicable | Operational | Not Applicable | Normal |
| Green | Not Running | Available | Operational | Operational | Operational | Operational | Normal |
| Green | Not Running | Available | Operational | Lagging | Operational | Lagging | Caution |
| Green | Not Running | Available | Operational | Failed | Operational | Failed | Caution |

Figure 15a

| Water Level State | Primary Pump Running State | Backup Pump Available State | Last Primary Pump Health State | Last Backup Pump Health State | Current Primary Pump Health State | Current Backup Pump Health State | Flood Risk |
|---|---|---|---|---|---|---|---|
| Green | Not Running | Not Available | Lagging | Not Applicable | Lagging | Not Applicable | Caution |
| Green | Not Running | Available | Lagging | Operational | Lagging | Operational | Caution |
| Green | Not Running | Available | Lagging | Lagging | Lagging | Lagging | Caution |
| Green | Not Running | Available | Lagging | Failed | Lagging | Failed | Caution |

Figure 15b

| Water Level State | Primary Pump Running State | Backup Pump Available State | Last Primary Pump Health State | Last Backup Pump Health State | Current Primary Pump Health State | Current Backup Pump Health State | Flood Risk |
|---|---|---|---|---|---|---|---|
| Green | Not Running | Not Available | Failed | Not Applicable | Failed | Not Applicable | Caution |
| Green | Not Running | Available | Failed | Operational | Failed | Operational | Caution |
| Green | Not Running | Available | Failed | Lagging | Failed | Lagging | Caution |
| Green | Not Running | Available | Failed | Failed | Failed | Failed | Caution |

Figure 15c

| Water Level State | Primary Pump Running State | Backup Pump Available State | Last Backup Pump Health State | Current Primary Pump Health State | Current Backup Pump Health State | Flood Risk |
|---|---|---|---|---|---|---|
| Orange | Running | Not Available | Not Applicable | Lagging | Not Applicable | High |
| Orange | Running | Available | Operational | Lagging | Operational | Moderate |
| Orange | Running | Available | Lagging | Lagging | Lagging | Moderate |
| Orange | Running | Available | Failed | Lagging | Failed | Moderate |

Figure 16a

| Water Level State | Primary Pump Running State | Backup Pump Available State | Last Backup Pump Health State | Current Primary Pump Health State | Current Backup Pump Health State | Flood Risk |
|---|---|---|---|---|---|---|
| Orange | Not Running | Not Available | Not Applicable | Failed | Not Applicable | High |
| Orange | Not Running | Available | Operational | Failed | Operational | Moderate |
| Orange | Not Running | Available | Lagging | Failed | Lagging | High |
| Orange | Not Running | Available | Failed | Failed | Failed | High |

Figure 16b

| Water Level State | Primary Pump Running State | Backup Pump Available State | Water Level Direction | Fill Rate Compare | Current Primary Pump Health State | Current Backup Pump Health State | Flood Risk |
|---|---|---|---|---|---|---|---|
| Red | Running | Not Available | Not Applicable | Not Applicable | Lagging | Not Applicable | High |
| Red | Running | Available | Receding | Orange > Red | Lagging | Operational | High |
| Red | Running | Available | Stable or Rising | Orange > Red | Lagging | Lagging | High |
| Red | Running | Available | Not Applicable | Orange <= Red | Lagging | Failed | High |

Figure 17a

| Water Level State | Primary Pump Running State | Backup Pump Available State | Water Level Direction | Fill Rate Compare | Current Primary Pump Health State | Current Backup Pump Health State | Flood Risk |
|---|---|---|---|---|---|---|---|
| Red | Not Running | Not Available | Not Applicable | Not Applicable | Failed | Not Applicable | High |
| Red | Not Running | Available | Receding | Orange > Red | Failed | Operational | High |
| Red | Not Running | Available | Stable or Rising | Orange > Red | Failed | Lagging | High |
| Red | Not Running | Available | Not Applicable | Orange <= Red | Failed | Failed | High |

Figure 17b

Levels 1-10: Water in interior is Blue.
Levels 1-9: Upper portion of perimeter is Gray.
Levels 1-5: Lower portion of perimeter is Green.
Levels 6-8: Lower portion of perimeter is Orange.
Level 9: Lower portion of perimeter is Red.
Level 10: Perimeter is Red.

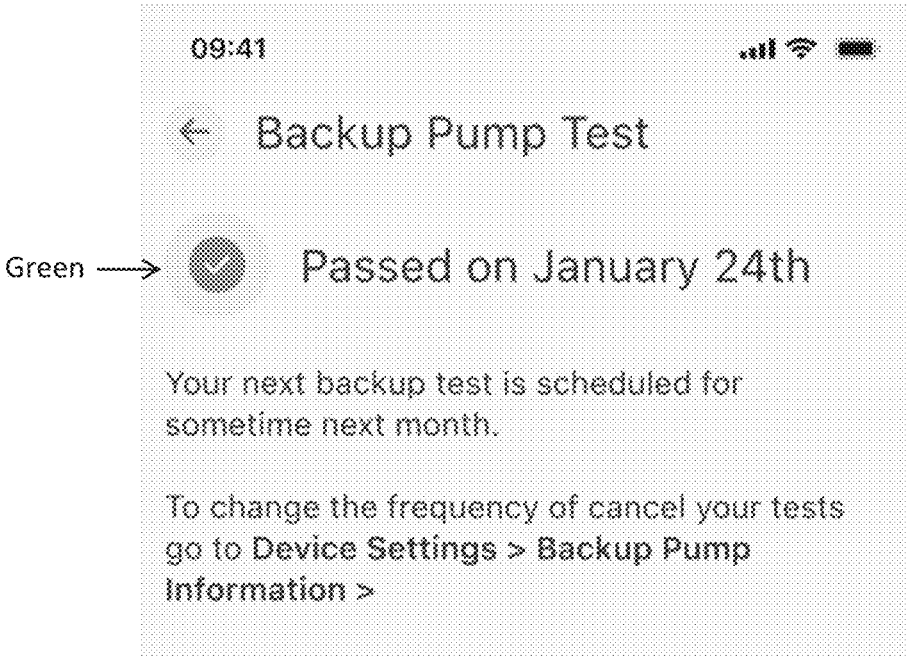
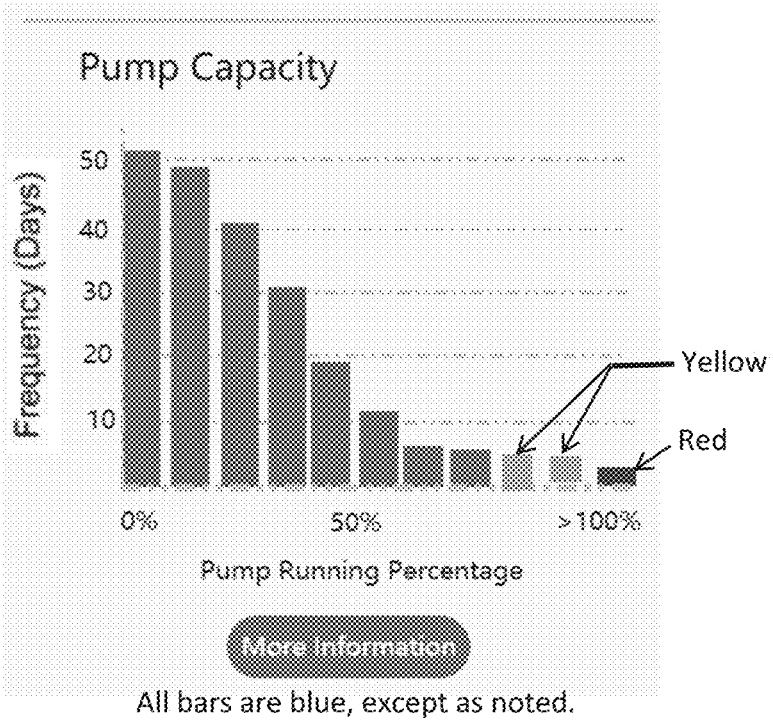
All bars are blue, except as noted.
Figure 37

All bars are blue.

All bars are blue.

All bars are blue, except as noted.

All bars are blue.

All bars are blue, except as noted.

All bars are blue, except as noted.

| Indicator | Icon | Title | Text |
|---|---|---|---|
| sufficient | Green Check | "Pump is Sufficient" | "After analyzing the amount of time your primary pump has run since the monitor was installed or last reset, the primary pump appears to be well sized for your home. " |
| oversized | Green Check | "Pump is Sufficient" | "After analyzing the amount of time your primary pump has run since the monitor was installed or last reset, the primary pump appears to be well sized for your home.<br><br>However, it is running frequently for short periods of time. While there is little concern that the primary pump will not keep up, frequent starts can lead to increased wear and a shorter pump life span." |
| undersized_capacity | Red Warning Icon | "Pump may be Undersized" | "Some storms have brought the system near full capacity. Please contact a professional to verify your pump size and the system operates as efficient as designed." |
| | Green Check | "Pump is Sufficient" | "After analyzing the amount of time your primary pump has run since the monitor was installed or last reset, the primary pump appears to keep up with water demands.<br><br>However, your pump may be running more often than recommended by most manufacturers. Next time you replace your pump, contact a professional to verify your pump size and the system operates as efficient as designed. If your pump is designed to run continuously, please indicate that below."<br><br>When 'undersized', there needs to be a check box added with the text: "Primary pump is designed to run continuously" |
| null | None | "Waiting for more Data" | "The primary pump has not run enough to make this analysis. Please check back in a couple of weeks or after the next big rain storm." |

Figure 49

SUMP PUMP SYSTEM, INCLUDING SUMP PUMP MONITOR AND APPLICATION

CROSS-REFERENCE TO RELATED APPLICATIONS

This application claims the benefit of U.S. Provisional Application No. 63/221,983, filed Jul. 15, 2021, U.S. Provisional Application No. 63/255,229, filed Oct. 13, 2021, and U.S. Provisional Application No. 63/255,235, filed Oct. 13, 2021, the entire disclosures of which are hereby incorporated by reference.

FIELD

The present invention relates generally to a sump pump system and, more particularly, to a sump pump system including a sump pump monitor and application.

BACKGROUND

Sump pumps are well known. Sump pumps are used to remove water from basements and crawl spaces of buildings. The sump pump is at least partially installed in a sump or a sump crock. When water reaches a predetermined level in the sump or the sump crock, the sump pump is activated and removes water from the sump or the sump crock. Users desire reliable sump pumps. Many difficulties can be encountered in providing reliable sump pumps.

Sump pump monitors and applications are also well known. Sump pump monitors and applications are used to check whether the sump pump is functioning, but existing monitors and applications have a number of limitations.

SUMMARY

The present invention provides a sump pump system, including a sump pump monitor and application.

In an exemplary embodiment, the sump pump system comprises a water level sensor, a user input/output module, and a processor. The water level sensor is operable to detect a level of water in a sump. The user input/output module is operable to communicate with a user. The processor is operable to communicate with the water level sensor and the user input/output module. The water level sensor is operable to detect the level of water in the sump and to send a signal to the processor indicating the detected water level. The processor is operable to receive the signal from the water level sensor indicating the detected water level and to assign a water level based on the detected water level. The processor is operable to send a signal to the user input/output module indicating the assigned water level. The input/output module is operable to receive the signal from the processor indicating the assigned water level and to display a notification to the user indicating the assigned water level. The assigned water level is assigned from a plurality of water levels, and more than one of the plurality of water levels corresponds to a state in which a pump is operating normally.

In an exemplary embodiment, the sump pump system comprises a water level sensor, a user input/output module, and a processor. The water level sensor is operable to detect a level of water in a sump. The user input/output module is operable to communicate with a user. The processor is operable to communicate with the water level sensor and the user input/output module. The water level sensor is operable to detect the level of water in the sump and to send a signal to the processor indicating the detected water level. The processor is operable to receive the signal from the water level sensor indicating the detected water level and to assign a water level state based on the detected water level. The processor is operable to send a signal to the user input/output module indicating the assigned water level state. The user input/output module is operable to receive the signal from the processor indicating the assigned water level state and to display a notification to the user indicating the assigned water level state. The assigned water level state is assigned from a plurality of water level states, and the plurality of water level states includes at least three water level states.

BRIEF DESCRIPTION OF THE DRAWINGS

FIGS. 11*a*-11*e* are views of the sump pump monitor of FIG. 10-FIG. 11*a* is a front-top perspective view, FIG. 11*b* is a front-bottom perspective view, FIG. 11*c* is a front view, FIG. 11*d* is a rear view, and FIG. 11*e* is a left side view;

FIG. 12 shows values of various parameters input to, determined by, and/or output by the sump pump system of FIGS. 1, 2, and 4 when a water level state is green;

FIG. 13 shows values of various parameters input to, determined by, and/or output by the sump pump system of FIGS. 1, 2, and 4 when the water level state is yellow/orange;

FIG. 14 shows values of various parameters input to, determined by, and/or output by the sump pump system of FIGS. 1, 2, and 4 when the water level state is red;

FIG. 15*a*-15*c* show values of various parameters input to, determined by, and/or output by the sump pump system of FIGS. 1-6 when the water level state is green;

FIG. 16*a*-16*b* show values of various parameters input to, determined by, and/or output by the sump pump system of FIGS. 1-6 when the water level state is yellow/orange;

FIG. 17*a*-17*b* show values of various parameters input to, determined by, and/or output by the sump pump system of FIGS. 1-6 when the water level state is red;

FIG. 22 is also an illustration of a mobile device screen for displaying information regarding a backup pump/power source monitoring frequency feature according to an exemplary embodiment of the present invention;

FIG. 35 is also an illustration of a mobile device screen for displaying information regarding a primary pump capacity according to an exemplary embodiment of the present invention;

FIG. 37 is an illustration of a mobile device screen for displaying information regarding the backup pump/power source monitoring frequency feature according to an exemplary embodiment of the present invention, and FIG. 37 is also an illustration of a mobile device screen for displaying information regarding the primary pump capacity according to an exemplary embodiment of the present invention;

FIG. 44 is also an illustration of a mobile device screen for displaying information regarding weather according to an exemplary embodiment of the present invention; and FIGS. 45-50 are illustrations of mobile device screens and messages for displaying information regarding the primary pump capacity according to exemplary embodiments of the present invention.

DETAILED DESCRIPTION

The present invention provides a sump pump system, including a sump pump monitor and application.

Figure 1:
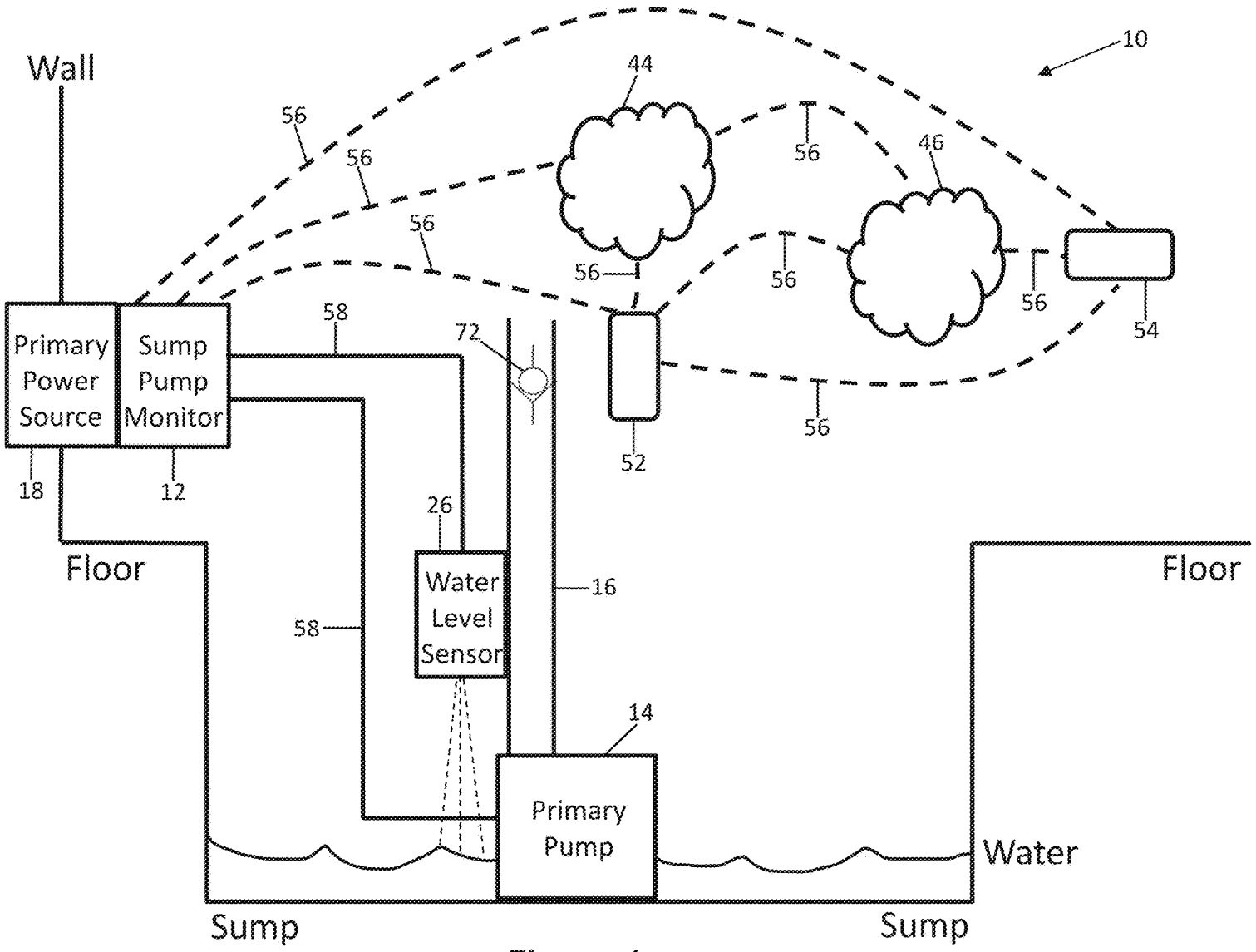
FIG. 1 is a schematic illustration of a sump pump system, including a primary pump and a sump pump monitor, according to an exemplary embodiment of the present invention.
Figure 2:
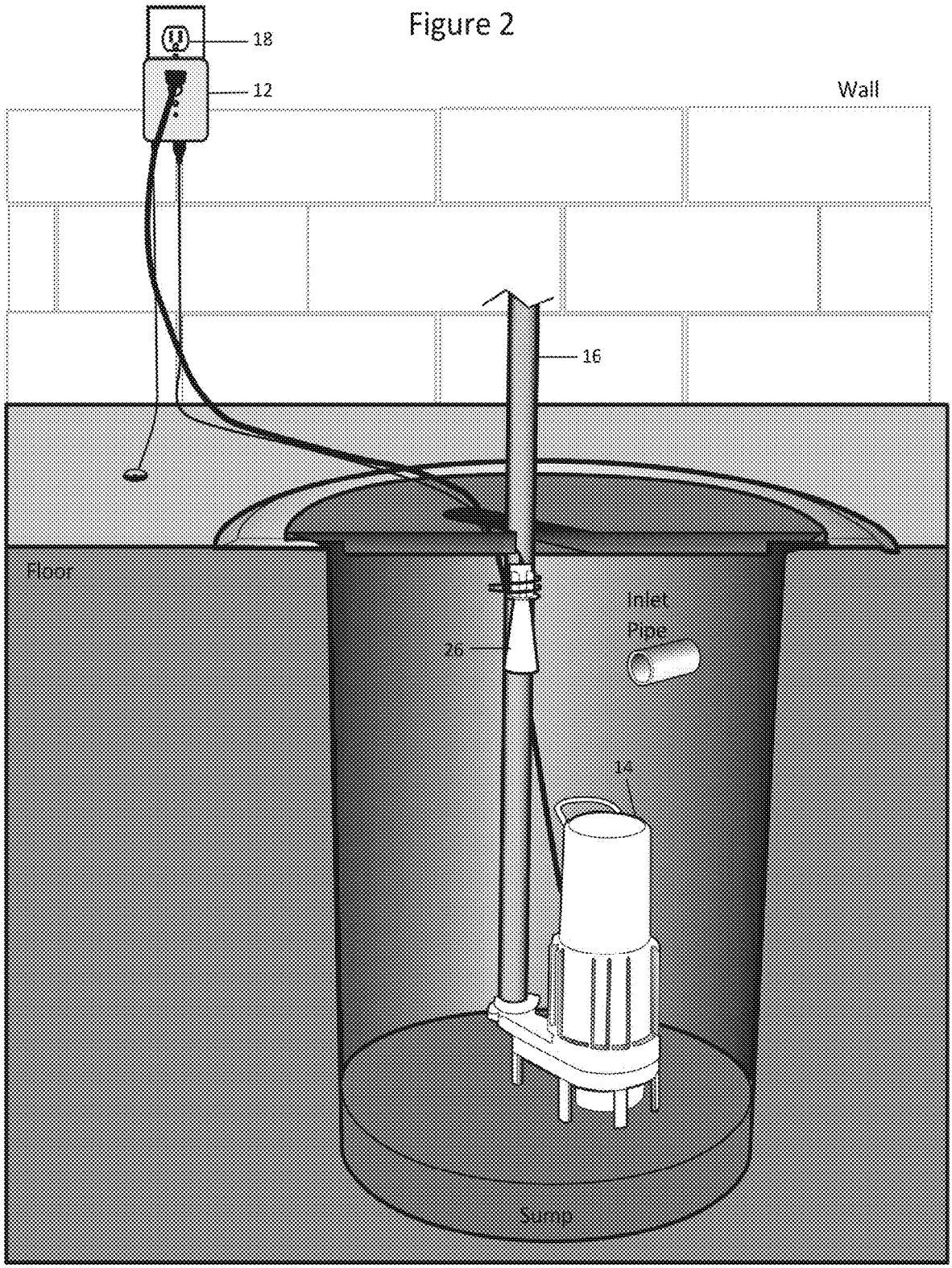
FIG. 2 is an illustration of a sump pump system, including a primary pump and a sump pump monitor, according to an exemplary embodiment of the present invention.
Figure 3:
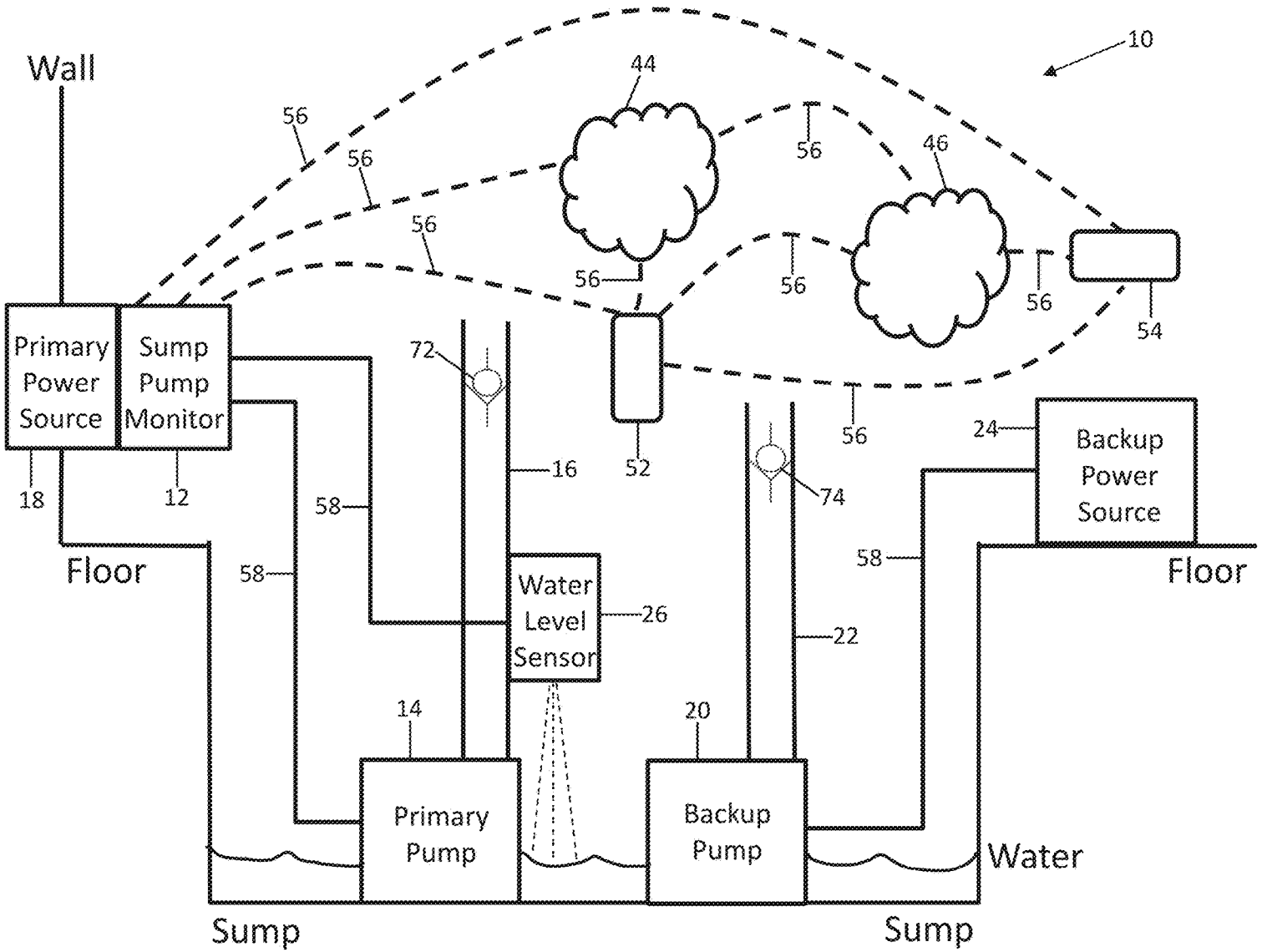
FIG. 3 is a schematic illustration of a sump pump system, including a primary pump, a backup pump, and a sump pump monitor, according to an exemplary embodiment of the present invention.
Figure 4:
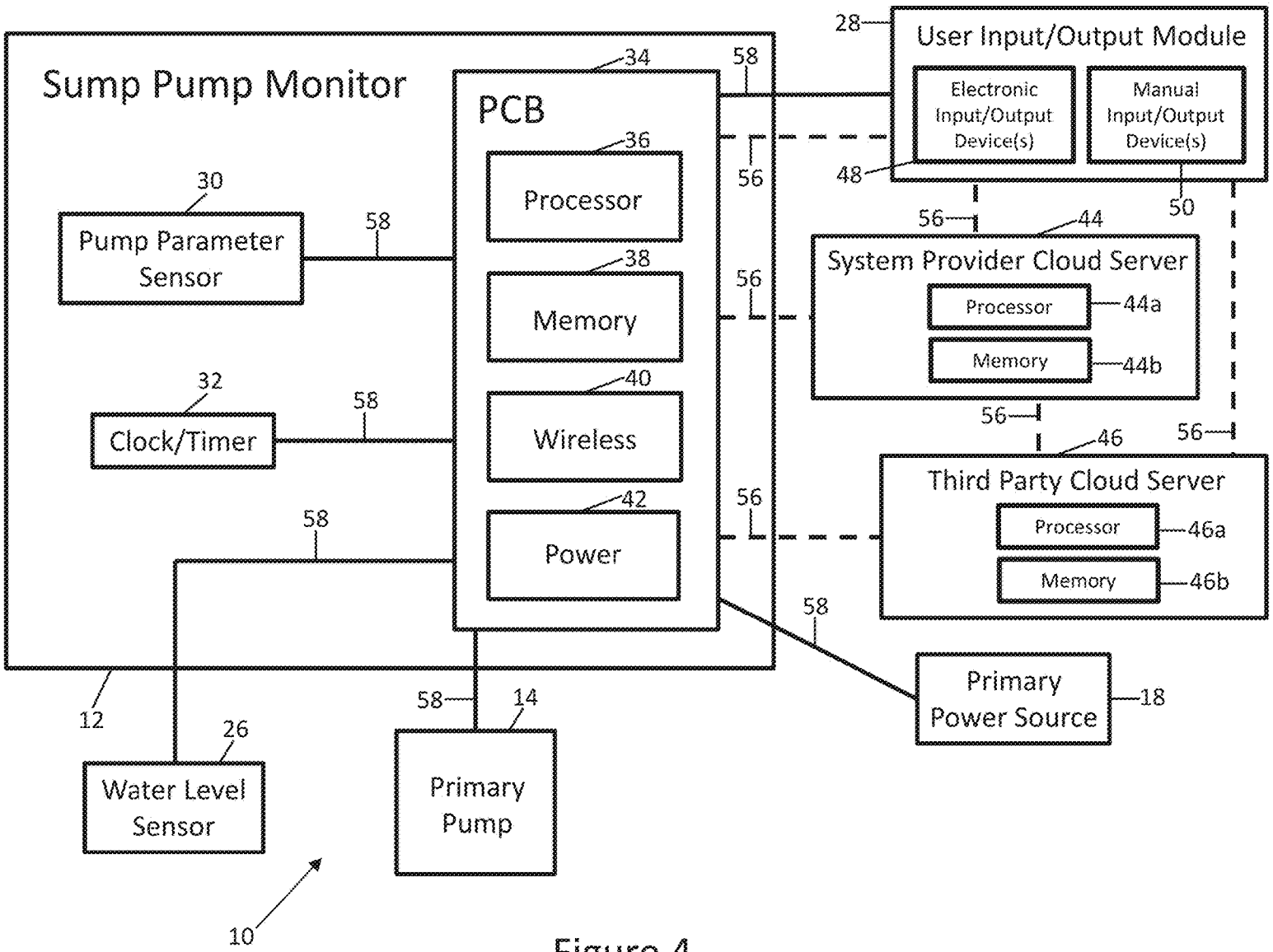
FIG. 4 is another schematic illustration of the sump pump system, including the primary pump and the sump pump monitor, of FIG. 1.
Figure 5:
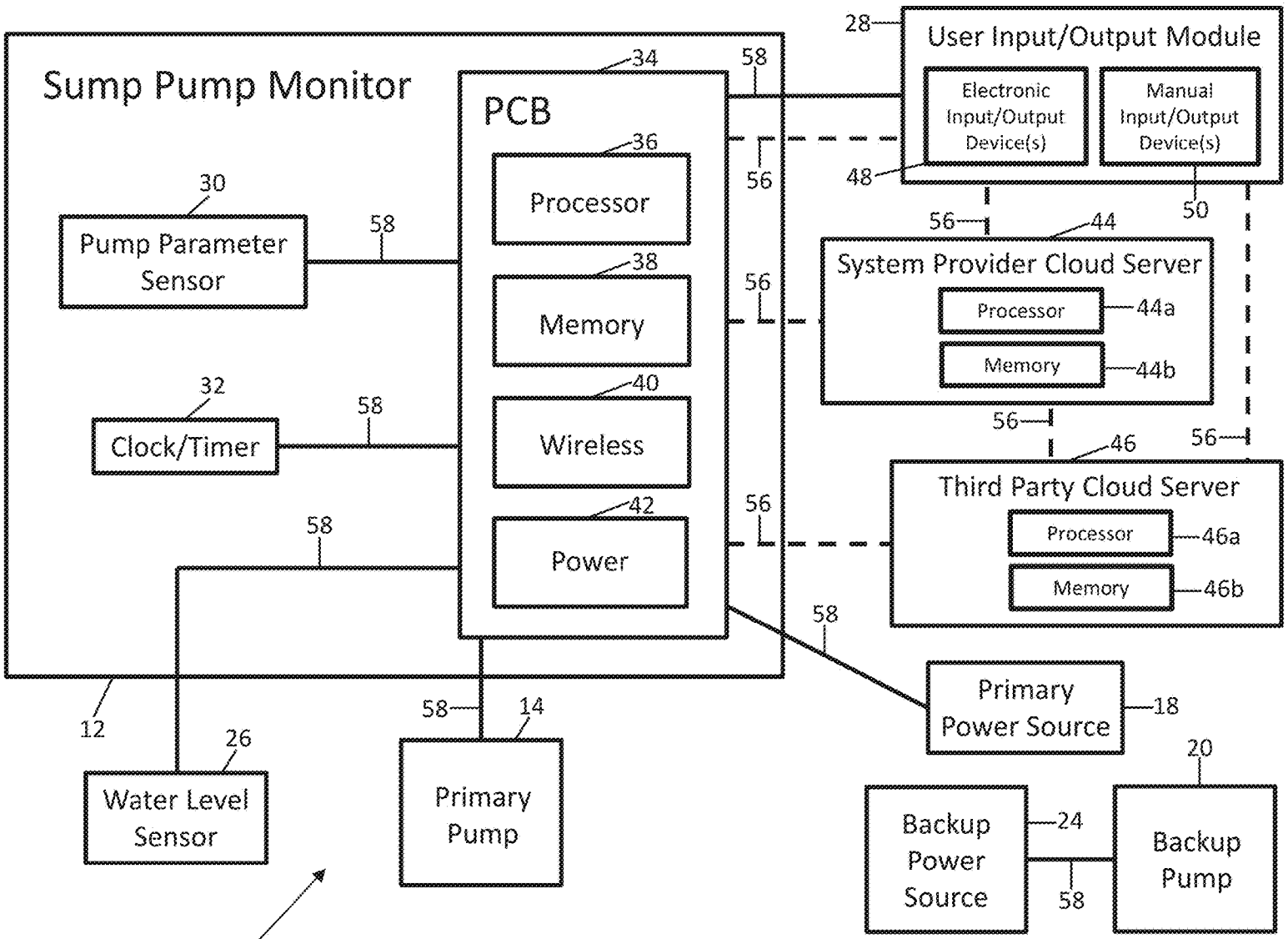
FIG. 5 is another schematic illustration of the sump pump system, including the primary pump, the backup pump, and the sump pump monitor, of FIG. 3.
Figure 6:
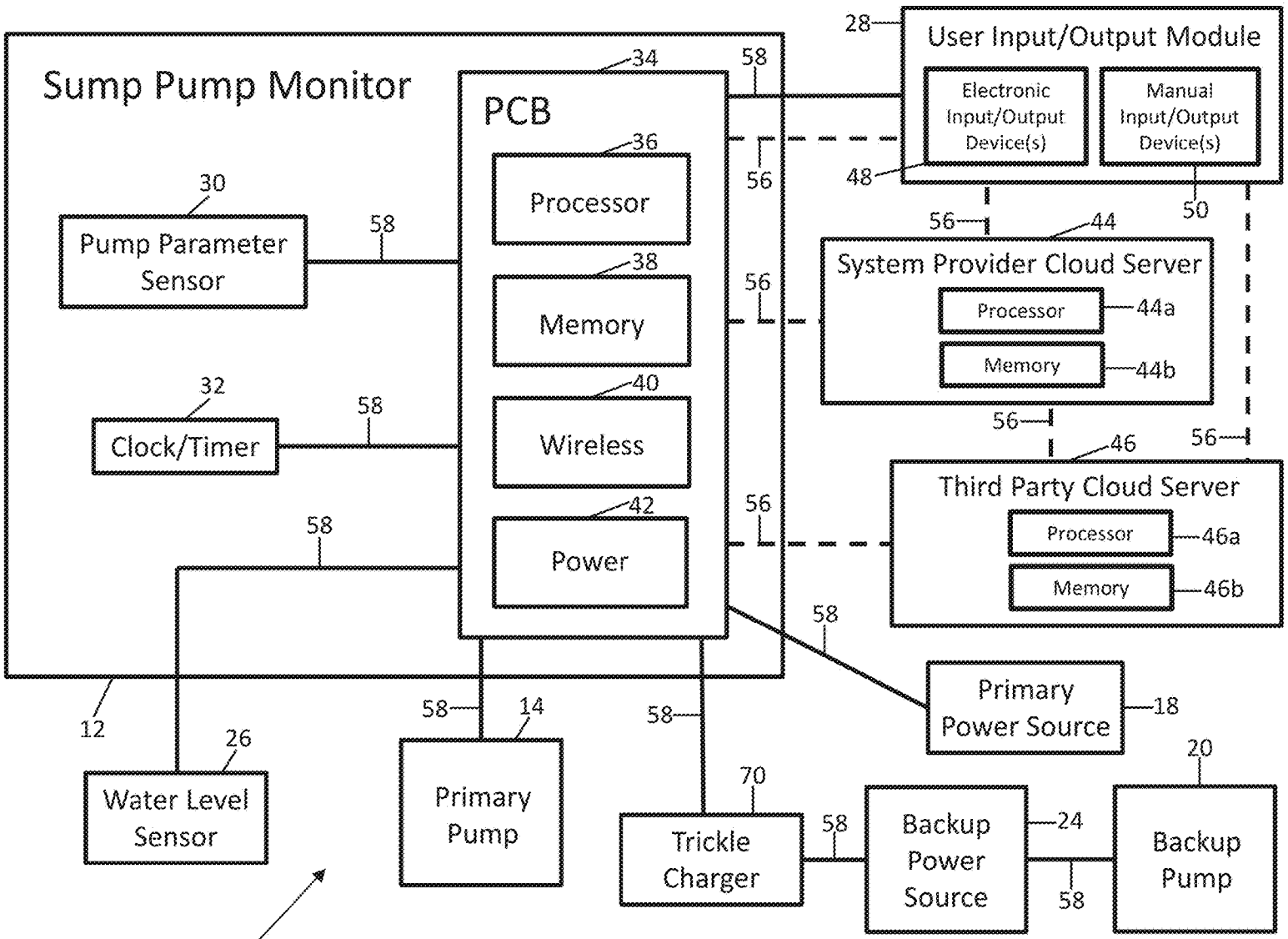
FIG. 6 is another schematic illustration of the sump pump system, including the primary pump, the backup pump, and the sump pump monitor, of FIG. 3, and further including a trickle charger.

Exemplary embodiments of a sump pump system 10, including a sump pump monitor 12, are illustrated in FIGS. 1-6. FIGS. 1-3 show fluidic and electrical/electronic components and connections of the sump pump system 10, and FIGS. 4-6 show electrical/electronic components and connections of the sump pump system 10.

In exemplary embodiments, the sump pump system 10 includes a sump pump. Components of the sump pump system 10 are installed in and/or near a sump or a sump crock. A sump is a reservoir in a basement or a crawl space of a building. A sump crock is a receptacle that is sometimes placed in the sump. For ease of reference, the term sump will be used herein, regardless of whether a sump crock is placed in the sump. The sump collects liquid, such as water, from an inlet pipe. The sump pump is operable to remove water from the sump. The sump pump is fluidly connected to a discharge pipe. The discharge pipe is operable to carry water from the sump pump to a storm sewer or other discharge point.

In the illustrated embodiments, as shown in FIGS. 1-6, the sump pump system 10 includes a primary pump 14. The primary pump 14 is operable to remove water from the sump. The primary pump 14 is fluidly connected to a primary discharge pipe 16. Normally, the primary pump 14 operates when a water level in the sump reaches a primary activation threshold level. Typically, the primary pump 14 includes a primary float and a primary switch (not separately shown). When the primary float determines that the water level has reached the primary activation threshold level, the primary float triggers the primary switch, which in turn activates the primary pump 14. The primary pump 14 operates and removes water from the sump through the primary discharge pipe 16. When the primary float determines that the water level has reached a primary deactivation threshold level, the primary float triggers the primary switch, which in turn deactivates the primary pump 14. The primary pump 14 is electrically connected to a primary power source 18. In an exemplary embodiment, the primary pump 14 is AC powered, so the primary power source 18 is an AC outlet. Primary pumps and primary power sources are well known in the art and will not be described in greater detail.

In the illustrated embodiments, as shown in FIGS. 3, 5, and 6, the sump pump system 10 further includes a backup pump 20. The backup pump 20 is operable to remove water from the sump. The backup pump 20 is fluidly connected to a backup discharge pipe 22. Normally, the backup pump 20 operates when the primary pump 14 is having difficulty maintaining the water level in the sump or has failed. Typically, the backup pump 20 includes a backup float and a backup switch (not separately shown). When the backup float determines that the water level has reached a backup activation threshold level (which is greater than the primary activation threshold level), the backup float triggers the backup switch, which in turn activates the backup pump 20. The backup pump 20 operates and removes water from the sump through the backup discharge pipe 22. When the backup float determines that the water level has reached the backup deactivation threshold level, the backup float triggers the backup switch, which in turn deactivates the backup pump 20. In an exemplary embodiment, the backup pump 20 is electrically connected to a backup power source 24. However, one of ordinary skill in the art will appreciate that the backup pump 20 could be electrically connected to the primary power source 18. In an exemplary embodiment, the backup pump 20 is battery powered, so the backup power source 24 is a battery. Backup pumps and backup power sources are well known in the art and will not be described in greater detail.

When reference is made to one component of the sump pump system 10 connecting to another component of the sump pump system 10, the connection may be direct or indirect. One of ordinary skill in the art will appreciate that additional components may be needed if the connection is indirect.

Figure 7:
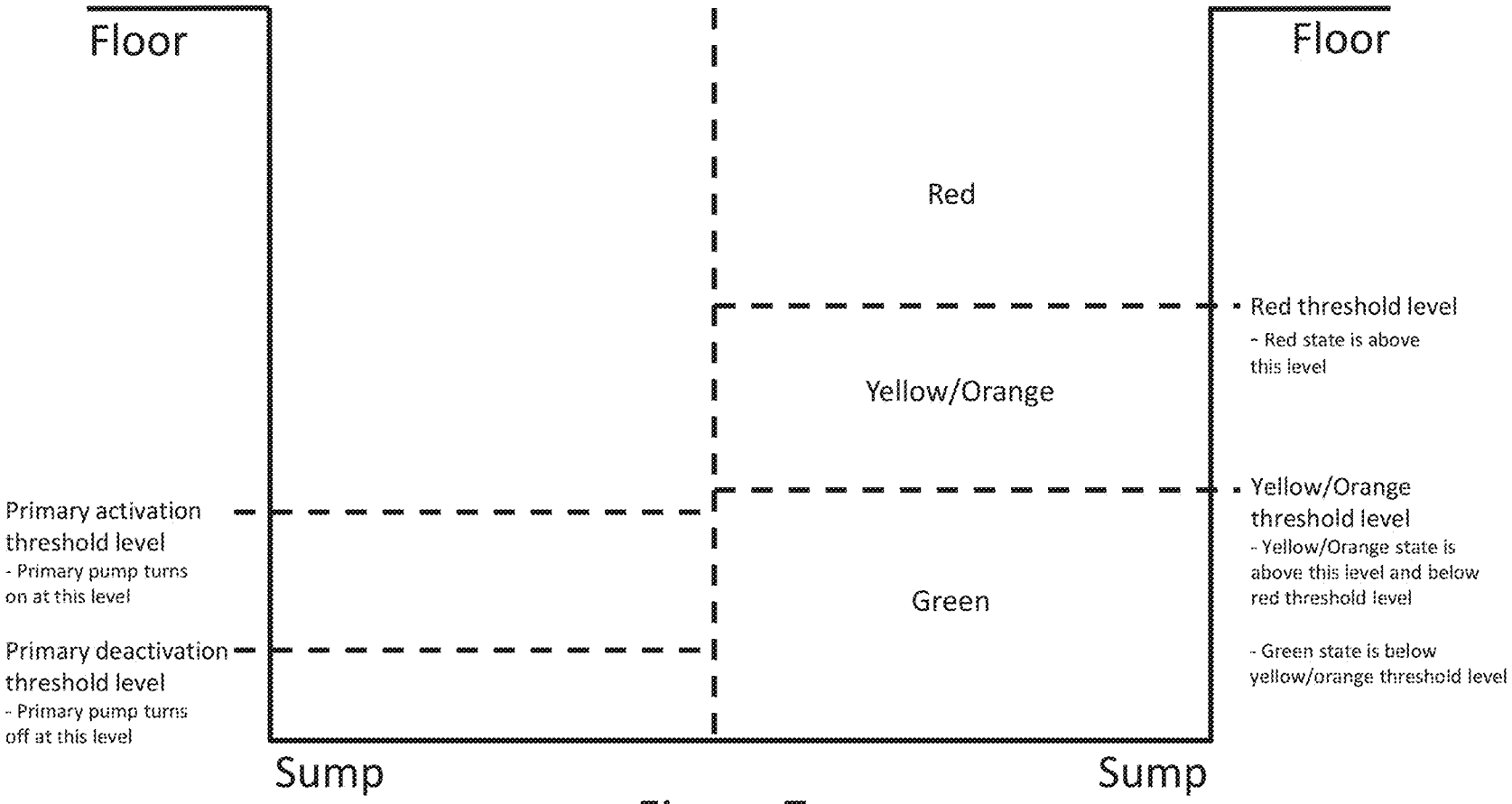
FIG. 7 is a schematic illustration of exemplary threshold water levels in the sump pump systems of FIGS. 1, 2, and 4.
Figure 8:
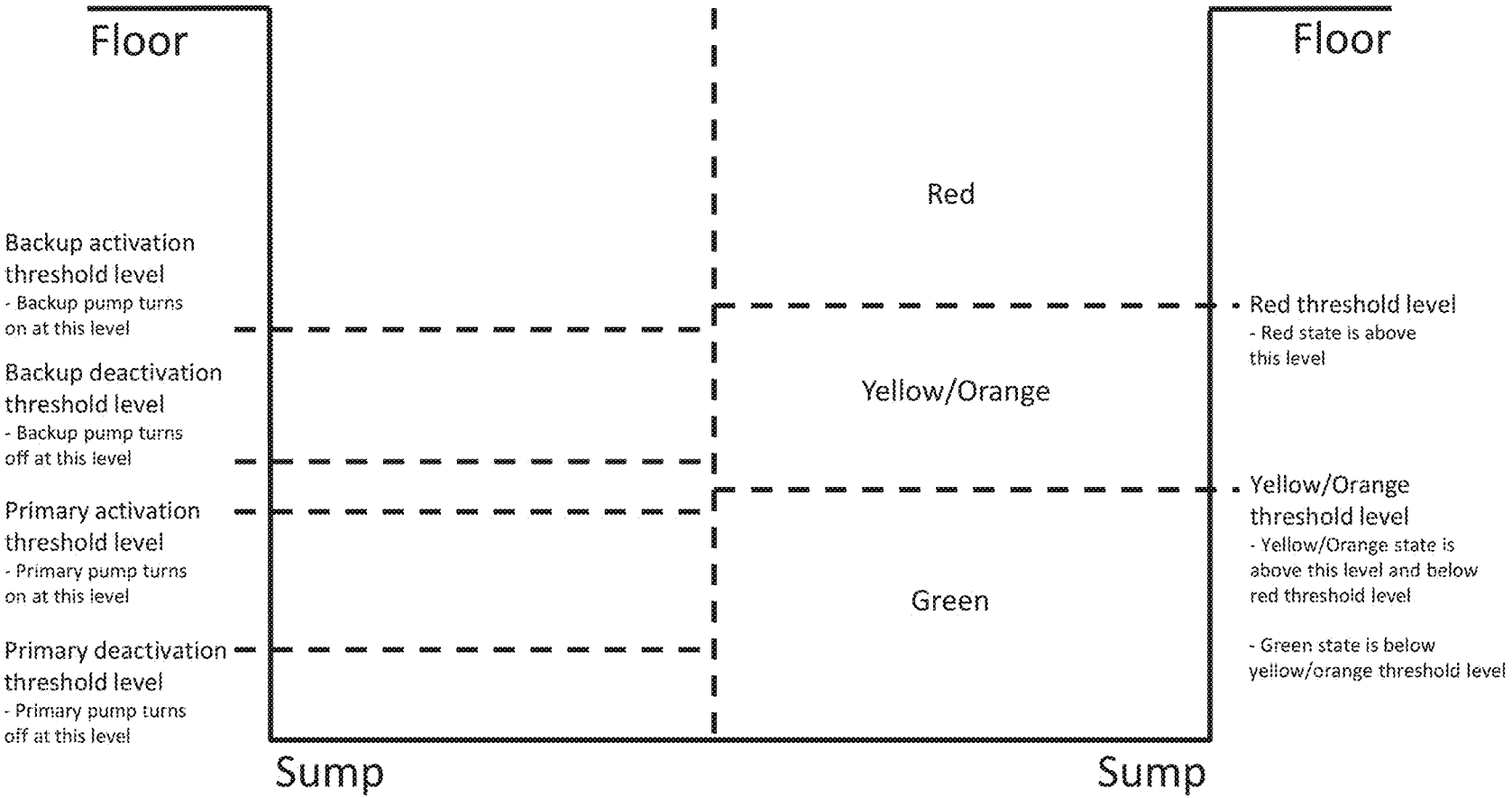
FIG. 8 is a schematic illustration of exemplary threshold water levels in the sump pump system of FIGS. 3, 5, and 6.

In the illustrated embodiments, as shown in FIGS. 7 and 8 and discussed above, when the water level in the sump reaches various threshold levels, operation (i.e., activation and deactivation) of the primary pump 14 and/or the backup pump 20 is triggered. Exemplary threshold levels include: (1) the primary activation threshold level, (2) the primary deactivation threshold level, (3) the backup activation threshold level, and/or (4) the backup deactivation threshold level. The primary activation threshold level is a level of water in the sump at which the primary pump 14 activates. The primary deactivation threshold level is a level of water in the sump at which the primary pump 14 deactivates. The primary activation threshold level is greater than the primary deactivation threshold level. The backup activation threshold level is a level of water in the sump at which the backup pump 20 activates. The backup deactivation level is a level of water in the sump at which the backup pump 20 deactivates. The backup activation threshold level is greater than the backup deactivation threshold level. In an exemplary embodiment, the backup activation threshold level is greater than the primary activation threshold level. In an exemplary embodiment, the backup deactivation threshold level is greater than the primary deactivation threshold level. In an exemplary embodiment, the backup deactivation threshold level is greater than the primary activation threshold level.

In the illustrated embodiments, as shown in FIGS. 7 and 8, when the water level in the sump reaches various threshold levels, the water level is assigned a state. Exemplary threshold levels include: (1) a yellow/orange threshold level, and (2) a red threshold level. Exemplary states include: (1) green, (2) yellow/orange, and (3) red. In exemplary embodiments, the yellow/orange threshold level is the primary activation threshold level plus a margin. In exemplary embodiments, the red threshold level is above the yellow/orange threshold level. In exemplary embodiments including the backup pump 20, the red threshold level is the backup activation threshold level plus a margin. In an exemplary embodiment, the margin is an absolute amount above the primary activation threshold level and/or the backup activation threshold level (e.g., ¼ inch). In an exemplary embodiment, the margin is a percentage of the primary activation threshold level and/or the backup activation threshold level (e.g., 10%). In exemplary embodiments, when the water level is below the yellow/orange threshold level, the water level is assigned the green state. The green state indicates that the water in the sump is at an acceptable level (e.g., generally, there is a low risk of flooding, as explained in greater detail below in connection with FIGS. 12 and 15*a*-15*c*). In exemplary embodiments, when the water level is at or above the yellow/orange threshold level and below the red threshold level, the water level is assigned the yellow/orange state. The yellow/orange state indicates that the water in the sump is above the acceptable level, may be cause for concern, but is not yet at an alarming or unacceptable level (e.g., generally, there is an increased risk of flooding, as explained in greater detail below in connection with FIGS. 13 and 16*a*-16*b*). In exemplary embodiments, when the water level is at or above the red threshold level, the water level is assigned the red state. The red state indicates that the water in the sump is at an alarming or unacceptable level (e.g., there is a high risk of flooding, as explained in greater detail below in connection with FIGS. 14 and 17*a*-17*b*).

In exemplary embodiments, the sump is approximately 16-24 inches in diameter and approximately 20-36 inches deep. In exemplary embodiments, the primary deactivation threshold level is approximately 3-6 inches above a bottom surface of the sump, the primary activation threshold level is approximately 4 inches above the primary deactivation threshold level, the backup deactivation threshold level is approximately 1 inch above the primary activation threshold level, and the backup activation threshold level is approximately 2-6 inches above the backup deactivation threshold level. In exemplary embodiments, the primary discharge pipe 16 and the backup discharge pipe 22 are approximately 8-12 feet long and have an inside diameter of approximately 1¼ to 2 inches.

In an exemplary embodiment, the sump is approximately 18 inches in diameter and approximately 22 inches deep. In the exemplary embodiment, the primary deactivation threshold level is approximately 3 inches deep (i.e., approximately 3 inches above the bottom surface of the sump), the primary activation threshold level is approximately 7 inches deep (i.e., approximately 4 inches above the primary deactivation threshold level), the backup deactivation threshold level is approximately 8 inches deep (i.e., approximately 1 inch above the primary activation threshold level), and the backup activation threshold level is approximately 12 inches deep (i.e., approximately 4 inches above the backup deactivation threshold level). In the exemplary embodiment, the yellow/orange threshold level is approximately 7¼ inches deep (i.e., approximately ¼ inch above the primary activation threshold level), and the red threshold level is approximately 12¼ inches deep (i.e., approximately ¼ inch above the backup activation threshold level). In the exemplary embodiment (where the sump is approximately 18 inches in diameter), every 1 inch of water is approximately 1 gallon of water in the sump. In the exemplary embodiment, the primary discharge pipe 16 and the backup discharge pipe 22 are approximately 10 feet long and have an inside diameter of approximately 1½ inches.

In an exemplary embodiment, the sump is approximately 24 inches in diameter and approximately 30 inches deep. In the exemplary embodiment, the primary deactivation threshold level is approximately 6 inches deep (i.e., approximately 6 inches above the bottom surface of the sump), the primary activation threshold level is approximately 10 inches deep (i.e., approximately 4 inches above the primary deactivation threshold level), the backup deactivation threshold level is approximately 11 inches deep (i.e., approximately 1 inch above the primary activation threshold level), and the backup activation threshold level is approximately 17 inches deep (i.e., approximately 6 inches above the backup deactivation threshold level). In the exemplary embodiment, the yellow/orange threshold level is approximately 10¼ inches deep (i.e., approximately ¼ inch above the primary activation threshold level), and the red threshold level is approximately 17¼ inches deep (i.e., approximately ¼ inch above the backup activation threshold level). In the exemplary embodiment (where the sump is approximately 24 inches in diameter), every 1 inch of water is approximately 2 gallons of water in the sump. In the exemplary embodiment, the primary discharge pipe 16 and the backup discharge pipe 22 are approximately 12 feet long and have an inside diameter of approximately 1¾ inches.

In the illustrated embodiments, as shown in FIGS. 1-6 and 9-11*e*, the sump pump system 10 includes a water level sensor 26, the sump pump monitor 12, and a user input/output module 28.

In exemplary embodiments, the water level sensor 26 is operable to detect the level of water in the sump. The operation of the water level sensor 26 is distinguished from the operation of the primary float in the primary pump 14 and the backup float in the backup pump 20. As discussed above, when the primary/backup float determines that the water level has reached the primary/backup activation threshold level, the primary/backup float triggers the primary/backup switch, which in turn activates the primary pump 14/backup pump 20. The water level detected by the water level sensor 26 will be used by the sump pump system 10.

In exemplary embodiments, the water level sensor 26 is operable to be mounted above the sump, e.g., on one of the primary discharge pipe 16 and the backup discharge pipe 22. In the illustrated embodiments, the water level sensor 26 is operable to be mounted on the primary discharge pipe 16. However, one of ordinary skill in the art will appreciate that the water level sensor 26 can be mounted in any location where it can detect the level of water in the sump (i.e., where it has a line of sight to the water in the sump).

In exemplary embodiments, the water level sensor 26 is a time of flight ("ToF") sensor. In an exemplary embodiment, the water level sensor 26 is the VL53L0X ToF sensor made by STMicroelectronics. The VL53L0X ToF sensor is described in detail in DocID029104 Rev 2 dated April 2018 and DocID029711 Rev 3 dated November 2018, both of which are available on the STMicroelectronics website (www.st.com) at https://www.st.com/resource/en/datasheet/v15310x.pdf and https://www.st.com/resource/en/application_note/dm00326504-v15310x-ranging-module-cover-window-guidelines-stmicroelectronics.pdf, respectively, and both of which are hereby incorporated by reference. Additional documentation regarding the VL53L0X ToF sensor is available on the STMicroelectronics website at https://www.st.com/en/imaging-and-photonics-solutions/v15310x.html#documentation. However, one of ordinary skill in the art will appreciate that the water level sensor 26 could be any type of electronic sensor that can determine the level of water in the sump.

Exemplary embodiments of the sump pump monitor 12 are shown in FIGS. 1-6 and 9-11*e*. In the illustrated embodiments, the sump pump monitor 12 is operable to mount and electrically connect to the primary power source 18. In the illustrated embodiments, the primary pump 14 is operable to electrically connect to the sump pump monitor 12. In the illustrated embodiments, the sump pump monitor 12 includes a front side and a rear side. The front side is opposite the rear side. In the illustrated embodiments, the front side includes an electrical outlet 12*a* and a light emitting diode ("LED") 12*b*. In the illustrated embodiments, a power cord of the primary pump 14 plugs into the electrical outlet 12*a* on the front side. In an exemplary embodiment, the front side includes a display in place of or in addition to the LED 12*b*. In the illustrated embodiments, the rear side includes an electrical plug 12*c* and a battery compartment 12*d*. In the illustrated embodiments, the sump pump monitor 12 includes a top side and a bottom side. The top side is opposite the bottom side. In the illustrated embodiments, the bottom side includes electrical connections. In the illustrated embodiments, the electrical connections include a USB-A port 12*e*, an RJ45 port 12*f*, and a 3.5 mm audio jack 12*g*. In the illustrated embodiments, a power/communication cord of the water level sensor 26 plugs into the USB-A port 12*e* on the bottom side.

In the illustrated embodiments, as shown in FIGS. 4-6, the sump pump monitor 12 includes a number of electronic components. These components control the operation and/or the monitoring of the sump pump system 10, including the primary pump 14 and/or the backup pump 20. In the illustrated embodiments, the sump pump monitor 12 includes a pump parameter sensor 30, a clock/timer 32, and a printed circuit board ("PCB") 34. In the illustrated embodiments, a number of electronic components are mounted on the PCB 34, including, but not limited to, a processor 36, memory 38, a wireless communication chip or module 40, and a power port 42.

In exemplary embodiments, the pump parameter sensor 30 is operable to detect a parameter relating to operation of the primary pump 14. In exemplary embodiments, the pump parameter sensor 30 is operable to detect at least one of current, voltage, vibration, and noise. In exemplary embodiments, the pump parameter sensor 30 is a pump current sensor and is operable to detect whether current is flowing to the primary pump 14. In exemplary embodiments, the parameter detected by the pump parameter sensor 30 is used to determine whether the primary pump 14 is running.

In an exemplary embodiment, the pump current sensor 30 is the ACS716 current sensor made by Allegro Microsystems. The ACS716 current sensor is described in detail in ACS716-DS, Rev. 9, MCO-0000201 dated Feb. 3, 2020, which is available on the Allegro Microsystems website (www.allegromicro.com) at https://www.allegromicro.com/-/media/files/datasheets/acs716-datasheet.ashx, and which is hereby incorporated by reference. Additional documentation regarding the ACS716 current sensor is available on the Allegro Microsystems website at https://www.allegromicro.com/en/products/sense/current-sensor-ics/zero-to-fifty-amp-integrated-conductor-sensor-ics/acs716 and https://www.allegromicro.com/en/products/sense/current-sensor-ics/zero-to-fifty-amp-integrated-conductor-sensor-ics/acs716/allegro-acs716-fully-integrated-current-sensor-ics-for-use-in-3_3-v-applications.

Although the sump pump system 10 has been described as including the water level sensor 26 and the pump parameter sensor 30, one of ordinary skill in the art will appreciate that, in certain embodiments, the sump pump system 10 could include other sensors. Additionally, although the sump pump monitor 12 has been described as including the pump parameter sensor 30, one of ordinary skill in the art will appreciate that, in certain embodiments, the pump parameter sensor 30 could be in other locations in the sump pump system 10 (e.g., the pump parameter sensor 30 could be attached to the primary pump 14).

In exemplary embodiments, the clock/timer 32 is operable to provide a date and a time of an action or to measure time intervals. For example, the clock/timer 32 can determine when the primary pump 14 activated/deactivated and how long the primary pump 14 operated. In exemplary embodiments, the processor 36 includes an internal clock/timer. Any timing of actions or steps described herein could be provided by the clock/timer 32 or the internal clock/timer of the processor 36. Clock/timers are well known in the art and will not be described in greater detail.

In exemplary embodiments, the processor 36 is operable to receive signals from and sends signals to components of the sump pump system 10 to control the operation and/or the monitoring of the sump pump system 10, including the primary pump 14 and/or the backup pump 20. For example, the processor 36 is operable to receive signals from the sensors (e.g., the water level sensor 26 and the pump parameter sensor 30), the user input/output module 28, and other components of the sump pump system 10 and sends signals to the primary pump 14, the user input/output module 28, and other components of the sump pump system 10 to control the operation and/or the monitoring of the sump pump system 10, including the primary pump 14 and/or the backup pump 20. In exemplary embodiments, the memory 38 is operable to save information received from components of the sump pump system 10. In exemplary embodiments, the wireless communication chip or module 40 is operable to control wireless communication between components of the sump pump system 10. In exemplary embodiments, the power port 42 is operable to provide power to components of the sump pump system 10.

In the illustrated embodiments, as shown in FIGS. 1 and 3-6, the sump pump system 10 includes a system provider cloud server 44 and a third party cloud server 46. The system provider cloud server 44 could be hosted by a system provider (such as a sump pump system manufacturer), and the third party cloud server 46 could be hosted by a third party (such as Amazon, Google, HomeKit, and IFTTT). In the illustrated embodiments, each of the system provider cloud server 44 and the third party cloud server 46 includes a processor 44*a*, 46*a* and memory 44*b*, 46*b*. The signals received from and sent to components of the sump pump system 10 to control the operation and/or the monitoring of the sump pump system 10 can be received from and sent to the processor 44*a* in the system provider cloud server 44 and/or the processor 46*a* in the third party cloud server 46 in addition to or alternatively to the processor 36 in the sump pump monitor 12. Similarly, the information received from components of the sump pump system 10 can be saved in the memory 44*b* in the system provider cloud server 44 and/or the memory 46*b* in the third party cloud server 46 in addition to or alternatively to the memory 38 in the sump pump monitor 12. Further, the information received from components of the sump pump system 10 can be saved in the user input/output module 28 (where the user input/output module 28 includes memory, such as Apple iPhone and Google Android).

As used herein, unless stated otherwise, "processor" includes any one or more of the processor 36 in the sump pump monitor 12, the processor 44*a* in the system provider cloud server 44, and the processor 46*a* in the third party cloud server 46. Similarly, as used herein, unless stated otherwise, "memory" includes any one or more of the memory 38 in the sump pump monitor 12, the memory 44*b* in the system provider cloud server 44, the memory 46*b* in the third party cloud server 46, and the memory in the user input/output module 28.

In exemplary embodiments, the user input/output module 28 is operable to receive input (e.g., information and/or instructions) from a user, provide the input to components of the sump pump system 10 (e.g., the processor), receive output (e.g., information and/or notifications) from components of the sump pump system 10 (e.g., the processor), and display the output to the user. In exemplary embodiments, the user input/output module 28 is operable to receive input from the user and send signals to the processor to control the operation and/or the monitoring of the sump pump system 10. Additionally, the user input/output module 28 is operable to receive signals from the processor and display output to the user. The user input/output module 28 can send signals to and receive signals from the processor directly and/or indirectly (e.g., through other components of the sump pump system 10 and/or through other components outside of the sump pump system 10).

The user input/output module 28 can include any device that enables input from the user and/or output to the user. In exemplary embodiments, the user input/output module 28 includes electronic input/output device(s) 48 and manual input/output device(s) 50. Exemplary electronic input/output devices 48 include mobile devices, smart hubs, touch screen devices, and push button devices. Exemplary mobile devices include Apple iPhone and Google Android. Exemplary smart hubs include Amazon Echo, Apple HomePod, and Google Nest. Exemplary manual input/output devices 50 include handles and joysticks.

In exemplary embodiments, the user input/output module 28 includes a mobile device 52 that can be held and/or moved by the user and a smart hub 54 that can be held and/or moved by the user. However, one of ordinary skill in the art will appreciate that the user input/output module 28 could include any number of devices, and each device of the user input/output module 28 could include any number of components. Moreover, one of ordinary skill in the art will appreciate that each device of the user input/output module 28 could be in any location where it can, at some point in time, send signals to and/or receive signals from other components of the sump pump system 10 (e.g., the processor), or each device of the user input/output module 28 could be integrally formed with or physically connected to other components of the sump pump system 10 (e.g., the sump pump monitor 12).

In exemplary embodiments, some components of the sump pump system 10 are connected to each other via a wireless communication connection or network interface 56, while other components of the sump pump system 10 are connected to each other via a wired communication connection or network interface 58. In exemplary embodiments, some components of the sump pump system 10 are operable to send signals to and/or receive signals from each other via the wireless communication connection or network interface 56, while other components of the sump pump system 10 are operable to send signals to and/or receive signals from each other via the wired communication connection or network interface 58.

One of ordinary skill in the art will appreciate that each component of the sump pump system 10 could be connected to each other component of the sump pump system 10 and send signals to and/or receive signals from each other component of the sump pump system 10 via any one type or combination of types of wireless communication connection(s) or network interface(s) 56 and/or wired communication connection(s) or network interface(s) 58. Further, one of ordinary skill in the art will appreciate that the wireless communication connection or network interface 56 and/or the wired communication connection or network interface 58 could be direct or indirect (e.g., via a router or a network hub). Moreover, one of ordinary skill in the art will appreciate that the wireless communication connection or network interface 56 could include any one type or any combination of different types of wireless communication connection(s) or network interface(s), including, but not limited to, Wi-Fi, Bluetooth, cellular, near field communication (NFC), Zigbee, Z-Wave, and Thread.

In the illustrated embodiments, as shown in FIGS. 1 and 3-6, some components of the user input/output module 28 (e.g., the mobile devices and the smart hubs) are connected to other components of the sump pump system 10 (e.g., the processor) via the wireless communication connection or network interface 56, while other components of the user input/output module 28 (e.g., the touch screen devices and the push button devices) are connected to other components of the sump pump system 10 (e.g., the processor) via the wired communication connection or network interface 58. In the illustrated embodiments, as shown in FIGS. 1 and 3-6, some components of the user input/output module 28 (e.g., the mobile devices and the smart hubs) are operable to send signals to and/or receive signals from other components of the sump pump system 10 (e.g., the processor) via the wireless communication connection or network interface 56, while other components of the user input/output module 28 (e.g., the touch screen devices and the push button devices) are operable to send signals to and/or receive signals from other components of the sump pump system 10 (e.g., the processor) via the wired communication connection or network interface 58.

For example, in the illustrated embodiments, as best shown in FIGS. 1 and 3, the mobile device 52 and the smart hub 54 are connected to the sump pump monitor 12 via the wireless communication connection or network interface 56. As stated above, this wireless communication connection or network interface 56 could be direct or indirect. In the illustrated embodiments, as best shown in FIGS. 1 and 3, the mobile device 52 and the smart hub 54 are connected to the sump pump monitor 12 via the system provider cloud server 44 and/or the third party cloud server 46 (i.e., the wireless communication connection or network interface 56 is indirect). In the illustrated embodiments, as best shown in FIGS. 1 and 3, the mobile device 52 and the smart hub 54 are connected to the sump pump monitor 12 via multiple different wireless communication connections or network interfaces 56 to provide redundancy in the event of a failure of one of the wireless communication connections or network interfaces 56. As stated above, each of these wireless communication connections or network interfaces 56 could be direct or indirect.

As stated above, one of ordinary skill in the art will appreciate that each component of the user input/output module 28 could be connected to each other component of the sump pump system 10 (e.g., the processor) and send signals to and/or receive signals from each other component of the sump pump system 10 (e.g., the processor) via any one type or combination of different types of wireless communication connection(s) or network interface(s) 56 and/or wired communication connection(s) or network interface(s) 58. Further, one of ordinary skill in the art will appreciate that the wireless communication connection or network interface 56 and/or the wired communication connection or network interface 58 could be direct or indirect (e.g., via a router or a network hub). Moreover, one of ordinary skill in the art will appreciate that the wireless communication connection or network interface 56 could include any one type or any combination of different types of wireless communication connection(s) or network interface(s), including, but not limited to, Wi-Fi, Bluetooth, cellular, near field communication (NFC), Zigbee, Z-Wave, and Thread.

In the illustrated embodiments, as shown in FIGS. 1 and 3-6, the system provider cloud server 44 and the third party cloud server 46 are connected to other components of the sump pump system 10 (e.g., the processor 36) via the wireless communication connection or network interface 56. In the illustrated embodiments, as shown in FIGS. 1 and 3-6, the system provider cloud server 44 and the third party cloud server 46 are operable to send signals to and/or receive signals from other components of the electronic plumbing system (e.g., the processor 36) via the wireless communication connection or network interface 56.

As stated above, one of ordinary skill in the art will appreciate that the system provider cloud server 44 and the third party cloud server 46 could be connected to other components of the sump pump system 10 (e.g., the processor) and send signals to and/or receive signals from other components of the sump pump system 10 (e.g., the processor) via any one type or combination of different types of wireless communication connection(s) or network interface(s) 56 and/or wired communication connection(s) or network interface(s) 58. Further, one of ordinary skill in the art will appreciate that the wireless communication connection or network interface 56 and/or the wired communication connection or network interface 58 could be direct or indirect (e.g., via a router or a network hub). Moreover, one of ordinary skill in the art will appreciate that the wireless communication connection or network interface 56 could include any one type or any combination of different types of wireless communication connection(s) or network interface(s), including, but not limited to, Wi-Fi, Bluetooth, cellular, near field communication (NFC), Zigbee, Z-Wave, and Thread.

In the illustrated embodiments, as shown in FIGS. 1-6 and 10, the sensors (e.g., the water level sensor 26 and the pump parameter sensor 30) are connected to the sump pump monitor 12 (and, thus, the processor 36) via the wired communication connection or network interface 58. In the illustrated embodiments, as shown in FIGS. 1-6 and 10, the sensors (e.g., the water level sensor 26 and the pump parameter sensor 30) are operable to send signals to and/or receive signals from the sump pump monitor 12 (and, thus, the processor 36) via the wired communication connection or network interface 58.

In the illustrated embodiments, as shown in FIGS. 1-5, the primary power source 18 is operable to provide power to electrical/electronic components of the sump pump system 10, including the primary pump 14, and the backup power source 24 is operable to provide power to the backup pump 20. In the illustrated embodiment, as shown in FIG. 6, the primary power source 18 is operable to provide power to electrical/electronic components of the sump pump system 10, including the primary pump 14 and the backup pump 20, and the backup power source 24 is also operable to provide power to the backup pump 20. In the illustrated embodiments, the primary power source 18 is operable to mount in a wall or other mounting surface near the sump. In the illustrated embodiments, the primary power source 18 is connected to the sump pump monitor 12, and thus the primary pump 14 (and the backup pump 20 when the primary power source 18 provides power to the backup pump 20), via the wired communication connection or network interface 58.

In the illustrated embodiments, the primary power source 18 includes AC power. In the illustrated embodiments, the backup power source 24 is operable to mount on a floor or other mounting surface near the sump. In the illustrated embodiments, the backup power source 24 is connected to the backup pump 20 via the wired communication connection or network interface 58. In the illustrated embodiments, the backup power source 24 includes battery power.

As stated above, one of ordinary skill in the art will appreciate that the sensors (e.g., the water level sensor 26 and the pump parameter sensor 30) and the power sources (e.g., the primary power source 18 and/or the backup power source 24) could be connected to the sump pump monitor 12 and/or other components of the sump pump system 10 (e.g., the processor) and send signals to and/or receive signals from the sump pump monitor 12 and/or other components of the sump pump system 10 (e.g., the processor) via any one type or combination of different types of wireless communication connection(s) or network interface(s) 56 and/or wired communication connection(s) or network interface(s) 58. Further, one of ordinary skill in the art will appreciate that the wireless communication connection or network interface 56 and/or the wired communication connection or network interface 58 could be direct or indirect (e.g., via a router or a network hub). Moreover, one of ordinary skill in the art will appreciate that the wireless communication connection or network interface 56 could include any one type or any combination of different types of wireless communication connection(s) or network interface(s), including, but not limited to, Wi-Fi, Bluetooth, cellular, near field communication (NFC), Zigbee, Z-Wave, and Thread.

In exemplary embodiments, as shown in FIGS. 1-6, during operation of the sump pump system 10 using the water level sensor 26, the water level sensor 26 detects the level of water in the sump. The water level sensor 26 sends a signal to the processor 36 in the sump pump monitor 12 via the wired communication connection or network interface 58. The processor 36 in the sump pump monitor 12 receives the signal from the water level sensor 26. The processor 36 in the sump pump monitor 12 appropriately controls the operation and/or the monitoring of the sump pump system 10.

In exemplary embodiments, as shown in FIGS. 4-6, during operation of the sump pump system 10 using the pump parameter sensor 30, the pump parameter sensor 30 detects the parameter relating to the operation of the primary pump 14. The pump parameter sensor 30 sends a signal to the processor 36 in the sump pump monitor 12 via the wired communication connection or network interface 58. The processor 36 in the sump pump monitor 12 receives the signal from the pump parameter sensor 30. The processor 36 in the sump pump monitor 12 appropriately controls the operation and/or the monitoring of the sump pump system 10.

In exemplary embodiments, as best shown in FIGS. 1 and 3, during operation of the sump pump system 10 using the mobile device 52, the user receives output via the mobile device 52 (e.g., the user receives information and/or notifications on the mobile device 52). The processor 36 in the sump pump monitor 12 sends a signal to the processor 44*a* in the system provider cloud server 44 via the wireless communication connection or network interface 56. The processor 44*a* in the system provider cloud server 44 receives the signal from the processor 36 in the sump pump monitor 12 and sends a signal to the mobile device 52 via the wireless communication connection or network interface 56. The mobile device 52 receives the signal from the processor 44*a* in the system provider cloud server 44 and conveys to the user the information and/or notifications regarding the operation and/or the monitoring of the sump pump system 10 (e.g., displays to the user the information and/or notifications).

In exemplary embodiments, as best shown in FIGS. 1 and 3, during operation of the sump pump system 10 using the smart hub 54, the user receives output via the smart hub 54 (e.g., the user receives information and/or notifications from the smart hub 54). The processor 36 in the sump pump monitor 12 sends a signal to the processor 44*a* in the system provider cloud server 44 via the wireless communication connection or network interface 56. The processor 44*a* in the system provider cloud server 44 receives the signal from the processor 36 in the sump pump monitor 12 and sends a signal to the processor 46*a* in the third party cloud server 46 via the wireless communication connection or network interface 56. The processor 46*a* in the third party cloud server 46 receives the signal from the processor 44*a* in the system provider cloud server 44 and sends a signal to the smart hub 54 via the wireless communication connection or network interface 56. The smart hub 54 receives the signal from the processor 46*a* in the third party cloud server 46 and conveys to the user the information and/or notifications regarding the operation and/or the monitoring of the sump pump system 10 (e.g., speaks to the user the information and/or notifications).

In exemplary embodiments, as best shown in FIGS. 1 and 3, during operation of the sump pump system 10 using the mobile device 52, the user enters input via the mobile device 52 (e.g., the user presses a button on the mobile device 52). The mobile device 52 receives the input from the user and sends a signal to the processor 44*a* in the system provider cloud server 44 via the wireless communication connection or network interface 56. The processor 44*a* in the system provider cloud server 44 receives the signal from the mobile device 52 and sends a signal to the processor 36 in the sump pump monitor 12 via the wireless communication connection or network interface 56. The processor 36 in the sump pump monitor 12 receives the signal from the processor 44*a* in the system provider cloud server 44. The processor 36 in the sump pump monitor 12 appropriately controls the operation and/or the monitoring of the sump pump system 10.

In exemplary embodiments, as best shown in FIGS. 1 and 3, during operation of the sump pump system 10 using the smart hub 54, the user enters input via the smart hub 54 (e.g., the user states a command to the smart hub 54). The smart hub 54 receives the input from the user and sends a signal to the processor 46*a* in the third party cloud server 46 via the wireless communication connection or network interface 56. The processor 46*a* in the third party cloud server 46 receives the signal from the smart hub 54 and sends a signal to the processor 44*a* in the system provider cloud server 44 via the wireless communication connection or network interface 56. The processor 44*a* in the system provider cloud server 44 receives the signal from the processor 46*a* in the third party cloud server 46 and sends a signal to the processor 36 in the sump pump monitor 12 via the wireless communication connection or network interface 56. The processor 36 in the sump pump monitor 12 receives the signal from the processor 44*a* in the system provider cloud server 44. The processor 36 in the sump pump monitor 12 appropriately controls the operation and/or the monitoring of the sump pump system 10.

In exemplary embodiments, the user input/output module 28 includes a wireless communication connection or network interface outage notification feature and/or a power outage notification feature. FIGS. 19-23 are illustrations of mobile device screens for inputting and displaying information regarding the wireless communication connection or network interface outage notification feature and the power outage notification feature according to exemplary embodiments.

In exemplary embodiments, the processor determines whether the wireless communication connection or network interface 56 and/or the power (such as the AC power) are connected. If the processor determines that the wireless communication connection or network interface 56 and/or the power are disconnected, the processor sends a signal to the user input/output module 28 indicating this information. The user input/output module 28 receives the signal from the processor indicating this information and displays a notification to the user indicating this information. In exemplary embodiments, the user selects a manner in which the user is notified (e.g., via email, phone call, text message, and/or push notification) using the user input/output module 28.

In exemplary embodiments, the processor 44*a* in the system provider cloud server 44 and/or the processor 46*a* in the third party cloud server 46 determines whether the wireless communication connection or network interface 56 and/or the power (such as the AC power) are connected by monitoring communication with the processor 36 in the sump pump monitor 12. During normal operation, the processor 36 in the sump pump monitor 12 periodically sends a signal to the processor 44*a* in the system provider cloud server 44 and/or the processor 46*a* in the third party cloud server 46. If a predetermined period of time passes without the processor 44*a* in the system provider cloud server 44 and/or the processor 46*a* in the third party cloud server 46 receiving the signal from the processor 36 in the sump pump monitor 12, the processor 44*a* in the system provider cloud server 44 and/or the processor 46*a* in the third party cloud server 46 determines that the wireless communication connection or network interface 56 and/or the power are disconnected. In exemplary embodiments, the user selects the predetermined period of time (e.g., 15 seconds, 30 seconds, 1 minute, 3 minutes, or 5 minutes) using the user input/output module 28.

In exemplary embodiments, the user input/output module 28 includes a similar notification feature for a wireless communication connection or network interface 56 that is weak (as opposed to disconnected).

Figure 9:
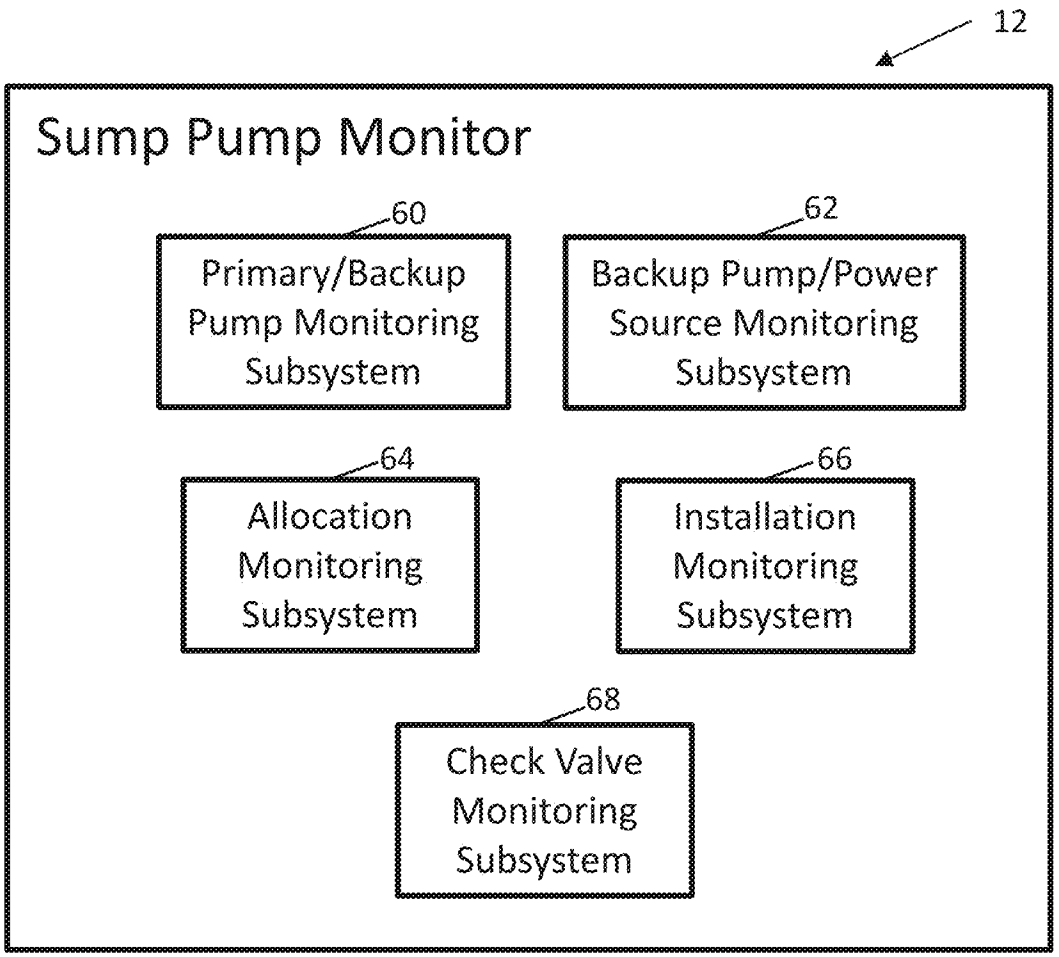
FIG. 9 is a schematic illustration of the sump pump monitor of FIGS. 1-6.
Figure 10:
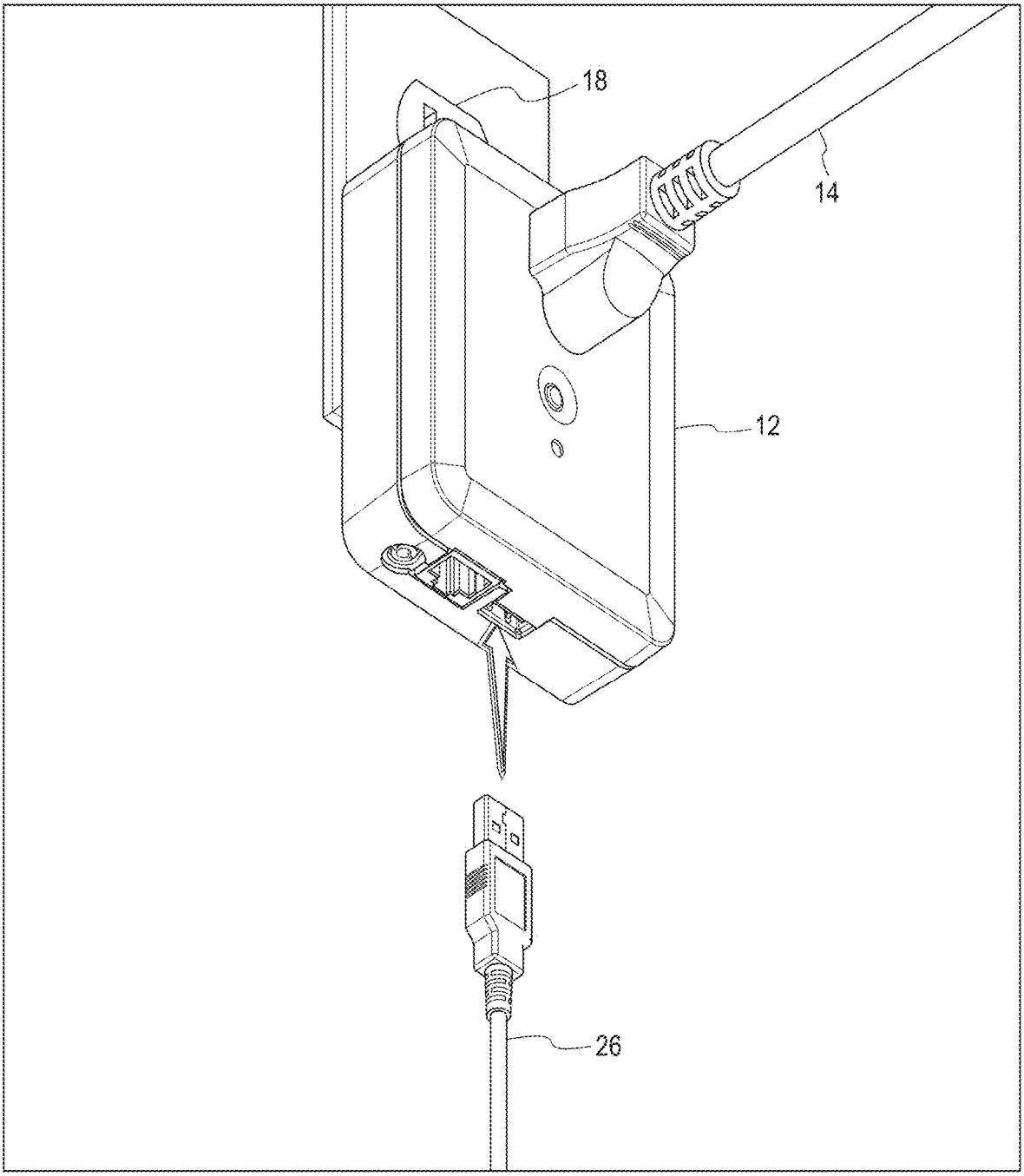
FIG. 10 is an illustration of an exemplary embodiment of the sump pump monitor of FIGS. 1-6 and 9.

In the illustrated embodiment, as shown in FIG. 9, the sump pump monitor 12 includes monitoring subsystems. In the illustrated embodiment, the monitoring subsystems include a primary/backup pump monitoring subsystem 60, a backup pump/power source monitoring subsystem 62, an allocation monitoring subsystem 64, an installation monitoring subsystem 66, and a check valve monitoring subsystem 68. However, one of ordinary skill in the art will appreciate that the sump pump monitor 12 could include any combination of one or more of these monitoring subsystems and/or additional monitoring subsystems. Each of the monitoring subsystems will be described in greater detail below.

In exemplary embodiments, components of the sump pump system 10 are operable to detect and/or determine a variety of parameters relating to operation of the sump pump system 10. Exemplary parameters include, but are not limited to, the following:

1. water level—the water level sensor 26 is operable to detect the level of water in the sump
2. water level state—the water level is assigned the state based on the water level detected by the water level sensor 26—the water level below the yellow/orange threshold level is assigned the green state, the water level at or above the yellow/orange threshold level and below the red threshold level is assigned the yellow/orange state, and the water level at or above the red threshold level is assigned the red state
3. pump parameter—the pump parameter sensor 30 is operable to detect a parameter relating to operation of the primary pump 14; in an exemplary embodiment, the parameter is current flow—the pump current sensor 30 is operable to detect whether current is flowing to the primary pump 14
4. primary pump parameter state—the primary pump 14 is assigned a parameter state based on a parameter detected by the pump parameter sensor 30—a value of the parameter state will depend on the parameter being detected; in an exemplary embodiment, the primary pump parameter state is a primary pump running state—the primary pump 14 is assigned a running state based on the current flow detected by the pump current sensor 30—no current flowing is assigned a state of not running and current flowing is assigned a state of running
5. backup pump available state—the backup pump 20 is assigned an available state based on input from the user whether a backup pump 20 is installed in the sump pump system 10—no backup pump 20 installed is assigned a state of not available and a backup pump 20 installed is assigned a state of available
6. fill rate—the sump pump system 10 is operable to determine a rate at which the sump is filling—the fill rate is determined based on the water level readings from the water level sensor 26 in combination with the timing of the water level readings from the clock/timer 32 and the volume of the sump
7. empty rate—the sump pump system 10 is operable to determine a rate at which the sump is emptying—the empty rate is determined based on the water level readings from the water level sensor 26 in combination with the timing of the water level readings from the clock/timer 32 and the volume of the sump
8. pump rate—the sump pump system 10 is operable to determine a rate at which the sump pump (i.e., the primary pump 14 and/or the backup pump 20) is removing water from the sump—the pump rate is determined based on the empty rate minus the fill rate
9. water level direction—the water level is assigned a direction—a water level that is decreasing is assigned a direction of receding, a water level that is not changing is assigned a direction of stable, and a water level that is increasing is assigned a direction of rising
10. fill rate compare—the fill rate in each of the yellow/orange state and the red state is compared—the fill rate in the yellow/orange state is greater than the fill rate in the red state or the fill rate in the yellow/orange state is less than or equal to the fill rate in the red state
11. current primary pump health state—the primary pump 14 is assigned a health state—a primary pump 14 that is operating normally is assigned a state of operational, a primary pump 14 that cannot decrease the water level in the sump is assigned a state of lagging, and a primary pump 14 that is no longer operational is assigned a state of failed
12. current backup pump health state—the backup pump 20 is assigned a health state—no backup pump 20 installed is assigned a state of not applicable, a backup pump 20 that is operating normally is assigned a state of operational, a backup pump 20 that cannot decrease the water level in the sump is assigned a state of lagging, and a backup pump 20 that is no longer operational is assigned a state of failed
13. last primary pump health state—the health state of the primary pump 14 prior to the current state
14. last backup pump health state—the health state of the backup pump 20 prior to the current state
15. flood risk—the sump pump system 10 assigns a flood risk—no likelihood of flooding is assigned a risk of normal, a low likelihood of flooding is assigned a risk of caution, a medium likelihood of flooding is assigned a risk of moderate, and a high likelihood of flooding is assigned a risk of high Primary/Backup Pump Monitoring Subsystem An exemplary embodiment of the primary/backup pump monitoring subsystem 60 is illustrated in FIG. 9.

In an exemplary embodiment, the primary/backup pump monitoring subsystem 60 includes a mechanism to determine whether the primary pump 14 has failed or is likely to fail and/or whether the backup pump 20 has failed or is likely to fail.

In an exemplary embodiment, the water level sensor 26 periodically detects the water level in the sump and sends a signal to the processor indicating the water level. Additionally, the pump current sensor 30 periodically detects whether current is flowing to the primary pump 14 and sends a signal to the processor indicating whether current is flowing to the primary pump 14. When the primary pump 14 is running, current is flowing to the primary pump 14. When the primary pump 14 is not running, current is not flowing to the primary pump 14.

In an exemplary embodiment, the processor periodically receives the signal from the water level sensor 26 indicating the water level. Additionally, the processor periodically receives the signal from the pump current sensor 30 indicating whether current is flowing to the primary pump 14.

In an exemplary embodiment, when the water level in the sump reaches the primary activation threshold level, the primary pump 14 should activate and remove water from the sump through the primary discharge pipe 16. If the water level in the sump reaches the yellow/orange threshold level, then the primary pump 14 is lagging and may be failing or has failed. If the water level in the sump reaches the backup activation threshold level, then the backup pump 20 should activate and remove water from the sump through the backup discharge pipe 22. If the water level in the sump reaches the red threshold level, then the backup pump 20 is lagging and may be failing or has failed.

In an exemplary embodiment, based on the water level readings received from the water level sensor 26 and the pump current readings received from the pump current sensor 30, the processor determines a variety of parameters, relating to the health of the primary pump 14 and/or the backup pump 20, including one or more of the following parameters: the water level state, the primary pump running state, the water level direction, the fill rate compare, the last primary pump health state, the last backup pump health state, the current primary pump health state, the current backup pump health state, and the flood risk. In an exemplary embodiment, the backup pump available state is input by the user.

FIGS. 12, 13, and 14 show exemplary values of these parameters input to, determined by, and/or output by the processor in a sump pump system 10 including a primary pump 14, but not a backup pump 20, when the water level state is green, yellow/orange, and red, respectively.

As shown in FIG. 12, if the water level state is green, the primary pump running state is not running, and the last primary pump health state is operational, then the current primary pump health state is operational, and the flood risk is normal. If the water level state is green, the primary pump running state is not running, and the last primary pump health state is lagging, then the current primary pump health state is lagging, and the flood risk is caution. If the water level state is green, the primary pump running state is not running, and the last primary pump health state is failed, then the current primary pump health state is failed, and the flood risk is caution.

As shown in FIG. 13, if the water level state is yellow/orange and the primary pump running state is running, then the current primary pump health state is lagging, and the flood risk is high. If the water level state is yellow/orange and the primary pump running state is not running, then the current primary pump health state is failed, and the flood risk is high.

As shown in FIG. 14, if the water level state is red and the primary pump running state is running, then the current primary pump health state is lagging, and the flood risk is high. If the water level state is red and the primary pump running state is not running, then the current primary pump health state is failed, and the flood risk is high.

FIGS. 15*a*-15*c*, 16*a*-16*b*, and 17*a*-17*b* show exemplary values of these parameters input to, determined by, and/or output by the processor in a sump pump system 10 including a primary pump 14 and/or a backup pump 20 when the water level state is green, yellow/orange, and red, respectively.

As shown in FIG. 15*a*, if the water level state is green, the primary pump running state is not running, and the last primary pump health state is operational, then the current primary pump health state is operational. If the backup pump available state is not available, then the last backup pump health state and the current backup pump health state are not applicable, and the flood risk is normal. If the backup pump available state is available and the last backup pump health state is operational, then the current backup pump health state is operational, and the flood risk is normal. If the backup pump available state is available and the last backup pump health state is lagging, then the current backup pump health state is lagging, and the flood risk is caution. If the backup pump available state is available and the last backup pump health state is failed, then the current backup pump health state is failed, and the flood risk is caution.

As shown in FIG. 15*b*, if the water level state is green, the primary pump running state is not running, and the last primary pump health state is lagging, then the current primary pump health state is lagging. If the backup pump available state is not available, then the last backup pump health state and the current backup pump health state are not applicable, and the flood risk is caution. If the backup pump available state is available and the last backup pump health state is operational, then the current backup pump health state is operational, and the flood risk is caution. If the backup pump available state is available and the last backup pump health state is lagging, then the current backup pump health state is lagging, and the flood risk is caution. If the backup pump available state is available and the last backup pump health state is failed, then the current backup pump health state is failed, and the flood risk is caution.

As shown in FIG. 15*c*, if the water level state is green, the primary pump running state is not running, and the last primary pump health state is failed, then the current primary pump health state is failed. If the backup pump available state is not available, then the last backup pump health state and the current backup pump health state are not applicable, and the flood risk is caution. If the backup pump available state is available and the last backup pump health state is operational, then the current backup pump health state is operational, and the flood risk is caution. If the backup pump available state is available and the last backup pump health state is lagging, then the current backup pump health state is lagging, and the flood risk is caution. If the backup pump available state is available and the last backup pump health state is failed, then the current backup pump health state is failed, and the flood risk is caution.

As shown in FIG. 16*a*, if the water level state is yellow/orange and the primary pump running state is running, then the current primary pump health state is lagging. If the backup pump available state is not available, then the last backup pump health state and the current backup pump health state are not applicable, and the flood risk is high. If the backup pump available state is available and the last backup pump health state is operational, then the current backup pump health state is operational, and the flood risk is moderate. If the backup pump available state is available and the last backup pump health state is lagging, then the current backup pump health state is lagging, and the flood risk is moderate. If the backup pump available state is available and the last backup pump health state is failed, then the current backup pump health state is failed, and the flood risk is moderate.

As shown in FIG. 16*b*, if the water level state is yellow/orange and the primary pump running state is not running, then the current primary pump health state is failed. If the backup pump available state is not available, then the last backup pump health state and the current backup pump health state are not applicable, and the flood risk is high. If the backup pump available state is available and the last backup pump health state is operational, then the current backup pump health state is operational, and the flood risk is moderate. If the backup pump available state is available and the last backup pump health state is lagging, then the current backup pump health state is lagging, and the flood risk is high. If the backup pump available state is available and the last backup pump health state is failed, then the current backup pump health state is failed, and the flood risk is high.

As shown in FIG. 17*a*, if the water level state is red and the primary pump running state is running, then the current primary pump health state is lagging. If the backup pump available state is not available, then the water level direction, the fill rate compare, and the current backup pump health state are not applicable, and the flood risk is high. If the backup pump available state is available, the water level direction is receding, and the fill rate compare is yellow/orange greater than red, then the current backup pump health state is operational, and the flood risk is high. If the backup pump available state is available, the water level direction is stable or rising, and the fill rate compare is yellow/orange greater than red, then the current backup pump health state is lagging, and the flood risk is high. If the backup pump available state is available and the fill rate compare is yellow/orange less than or equal to red, then the water level direction is not applicable, the current backup pump health state is failed, and the flood risk is high.

As shown in FIG. 17*b*, if the water level state is red and the primary pump running state is not running, then the current primary pump health state is failed. If the backup pump available state is not available, then the water level direction, the fill rate compare, and the current backup pump health state are not applicable, and the flood risk is high. If the backup pump available state is available, the water level direction is receding, and the fill rate compare is yellow/orange greater than red, then the current backup pump health state is operational, and the flood risk is high. If the backup pump available state is available, the water level direction is stable or rising, and the fill rate compare is yellow/orange greater than red, then the current backup pump health state is lagging, and the flood risk is high. If the backup pump available state is available and the fill rate compare is yellow/orange less than or equal to red, then the water level direction is not applicable, the current backup pump health state is failed, and the flood risk is high.

In an exemplary embodiment, the processor sends a signal to the user input/output module 28 indicating this information (e.g., any of the parameters relating to the health of the primary pump 14 and/or the backup pump 20). The user input/output module 28 receives the signal from the processor and displays a notification to the user indicating this information.

Figure 24:
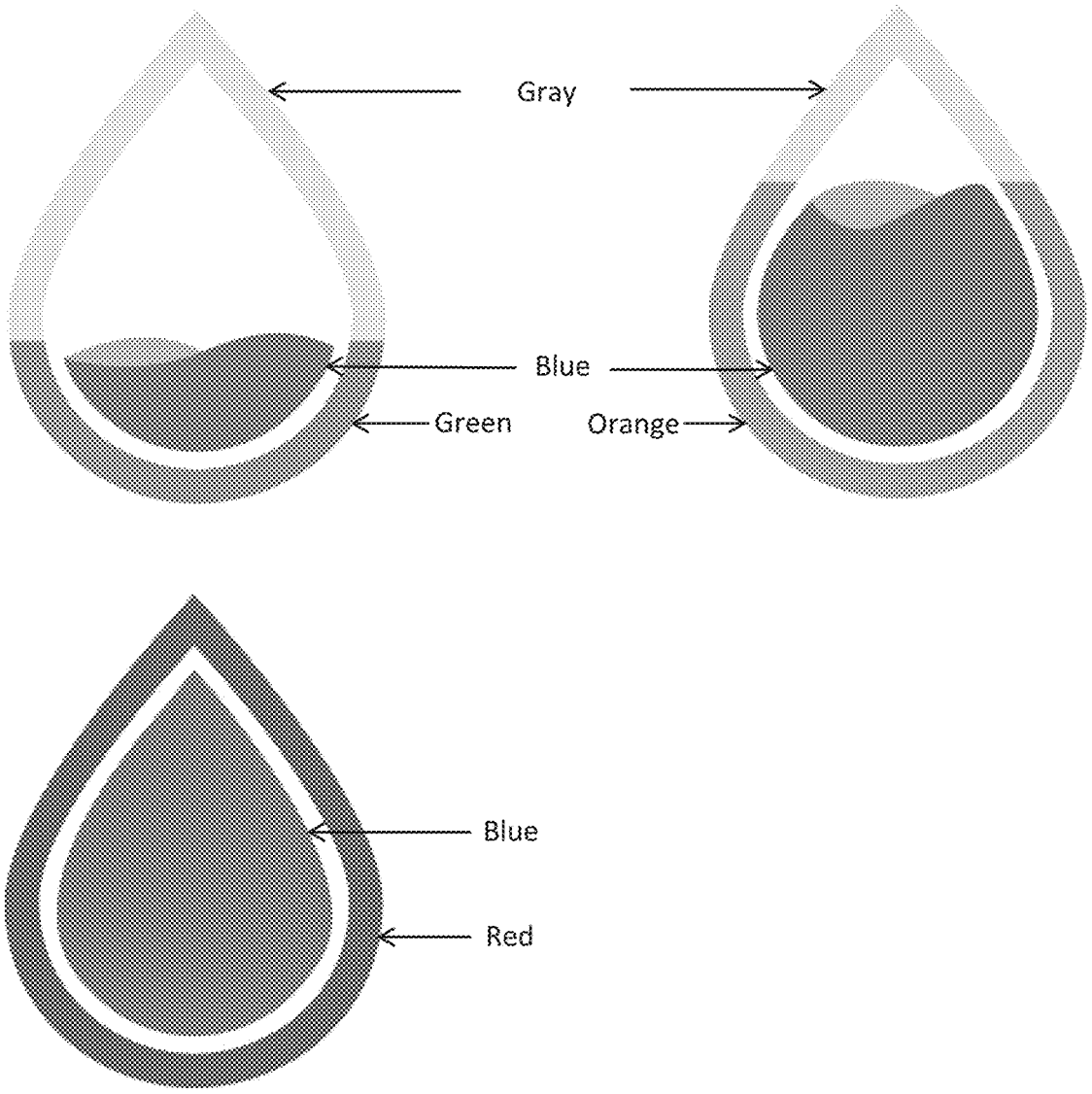
FIGS. 24-26 are illustrations of exemplary water drops for displaying information to a user regarding a water level and a water level state according to exemplary embodiments of the present invention.
Figure 25:
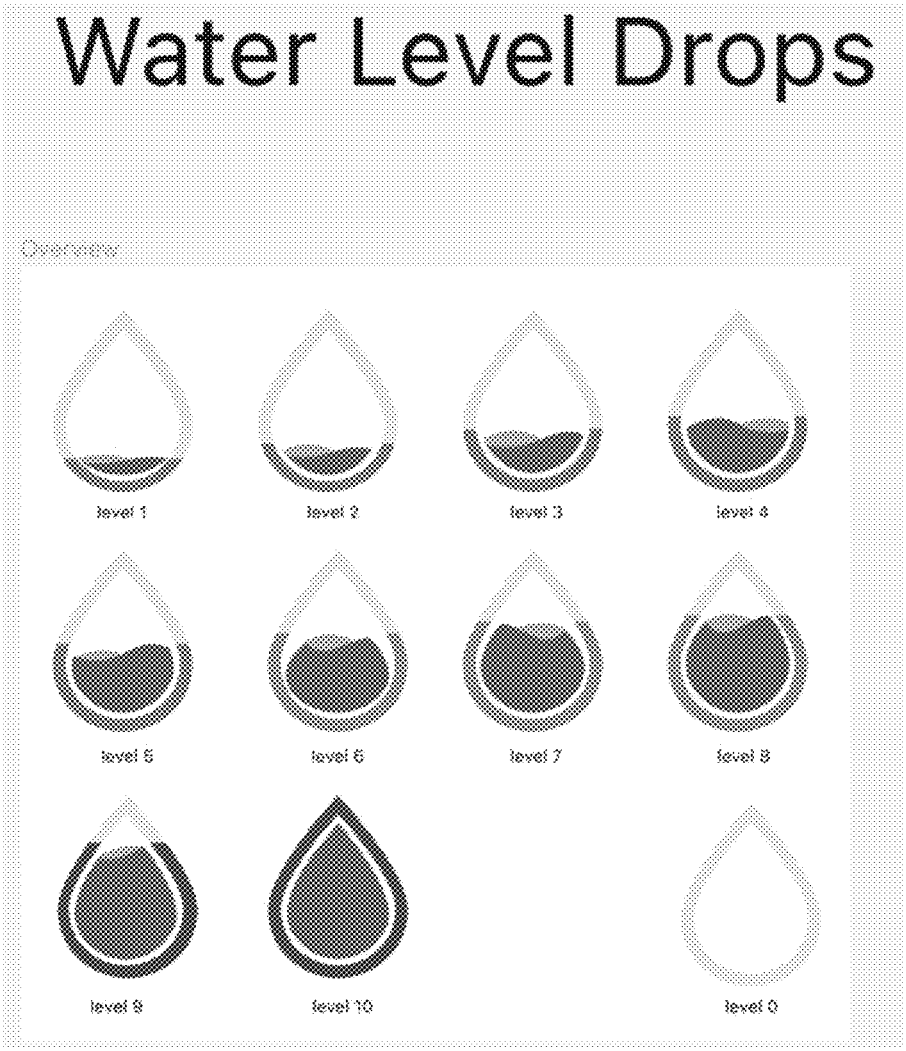
Figure 26:
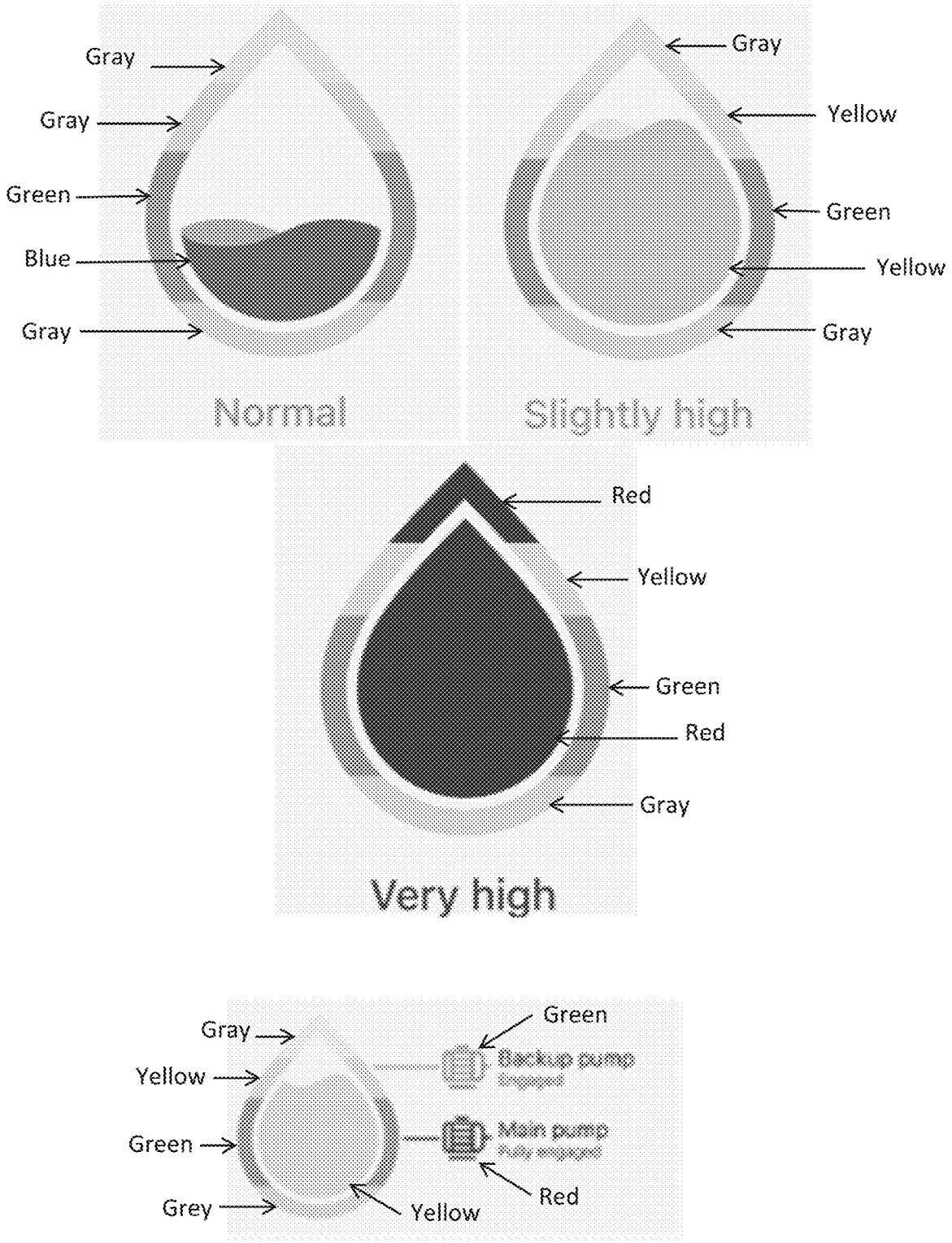
Figure 27:
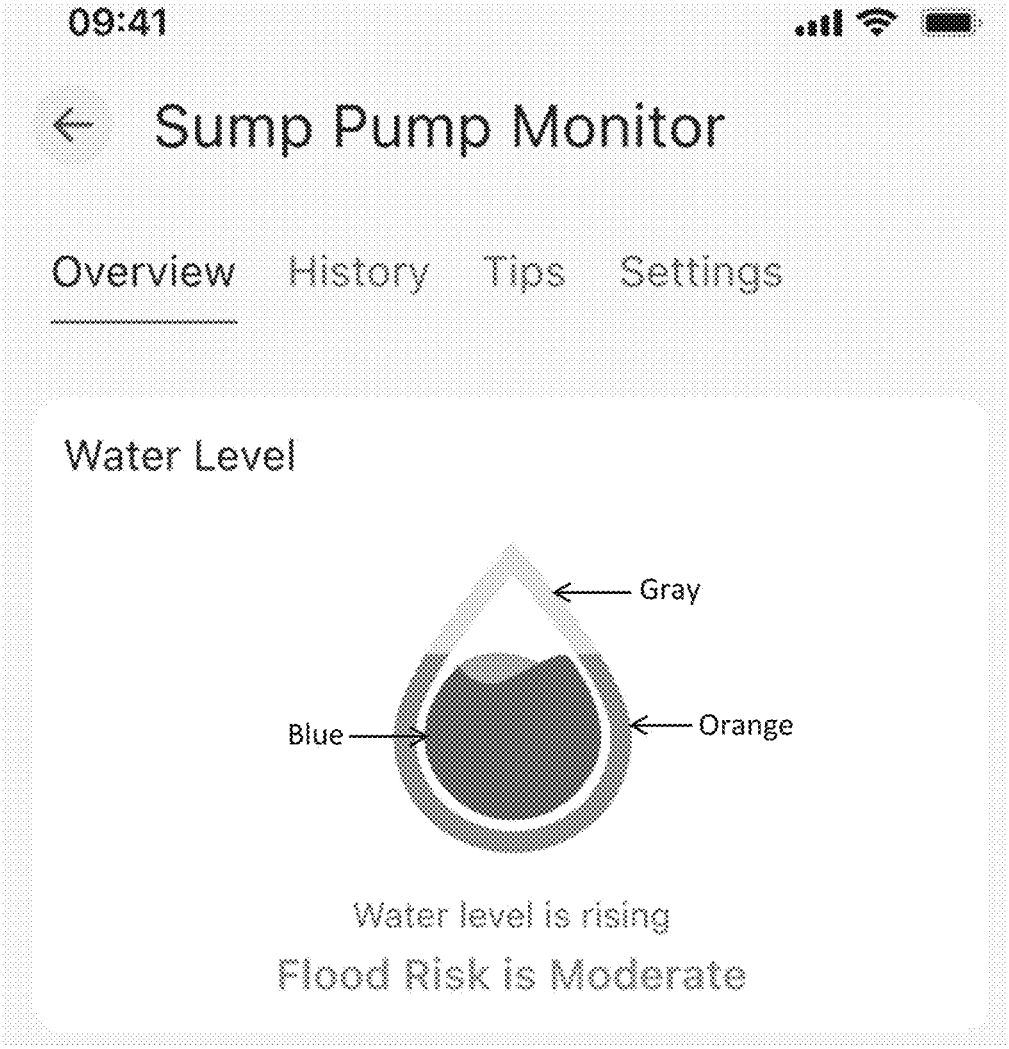
FIGS. 27-36 are illustrations of mobile device screens for displaying information to a user regarding the water level, the water level state, and other parameters relating to operation of the sump pump system according to exemplary embodiments of the present invention.
Figure 28:
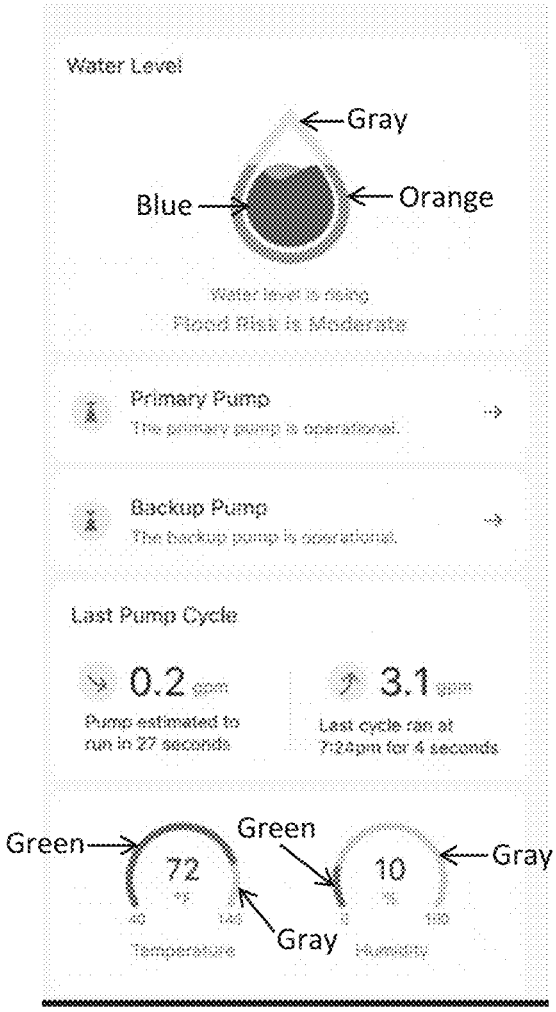
Figure 29:
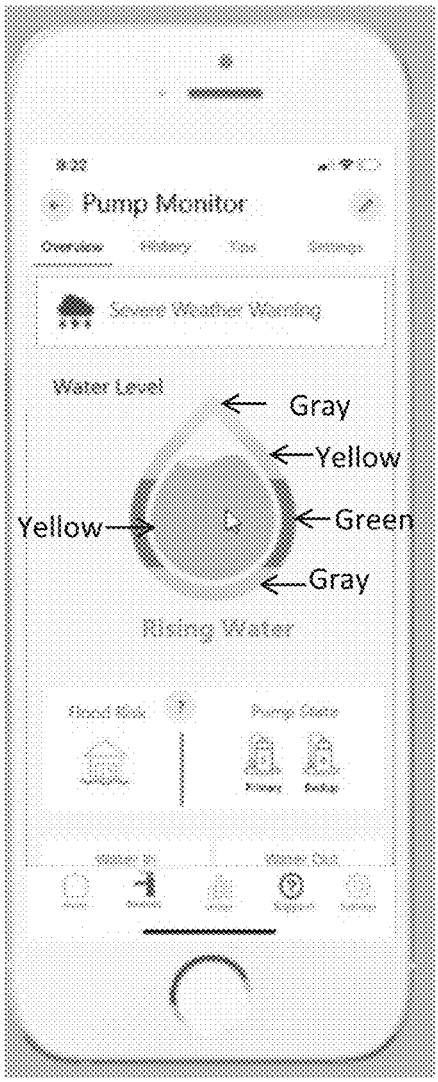
Figure 30:
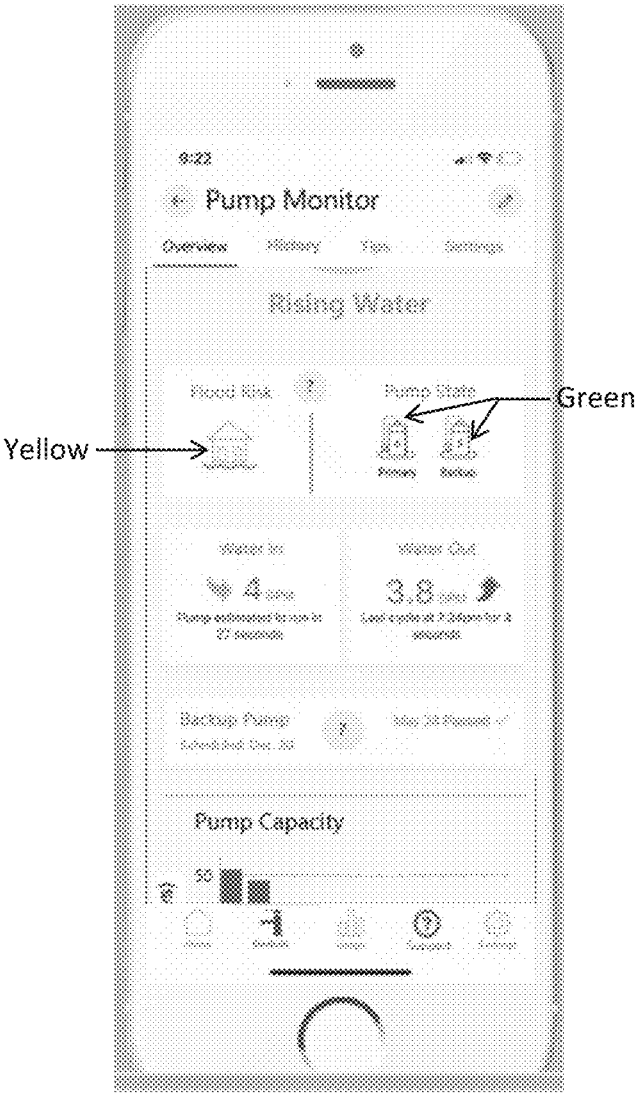
Figure 31:
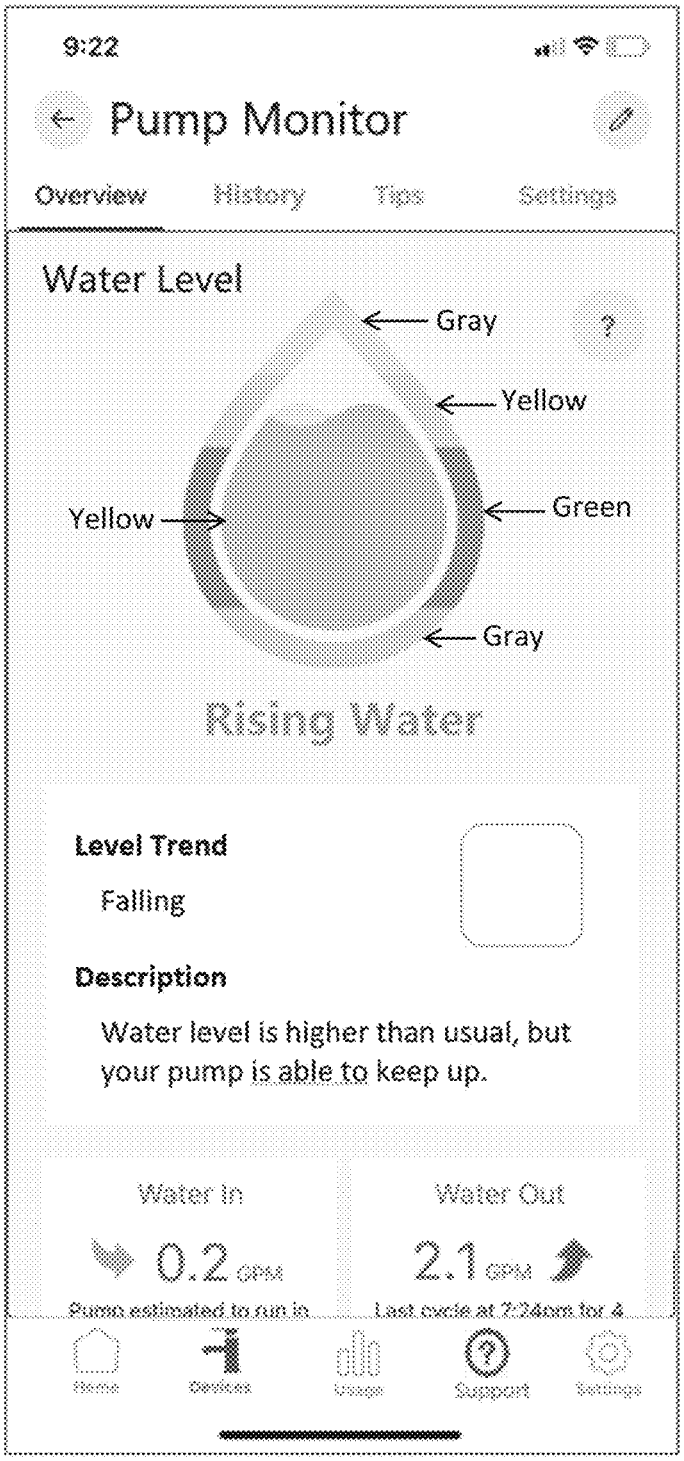
Figure 32:
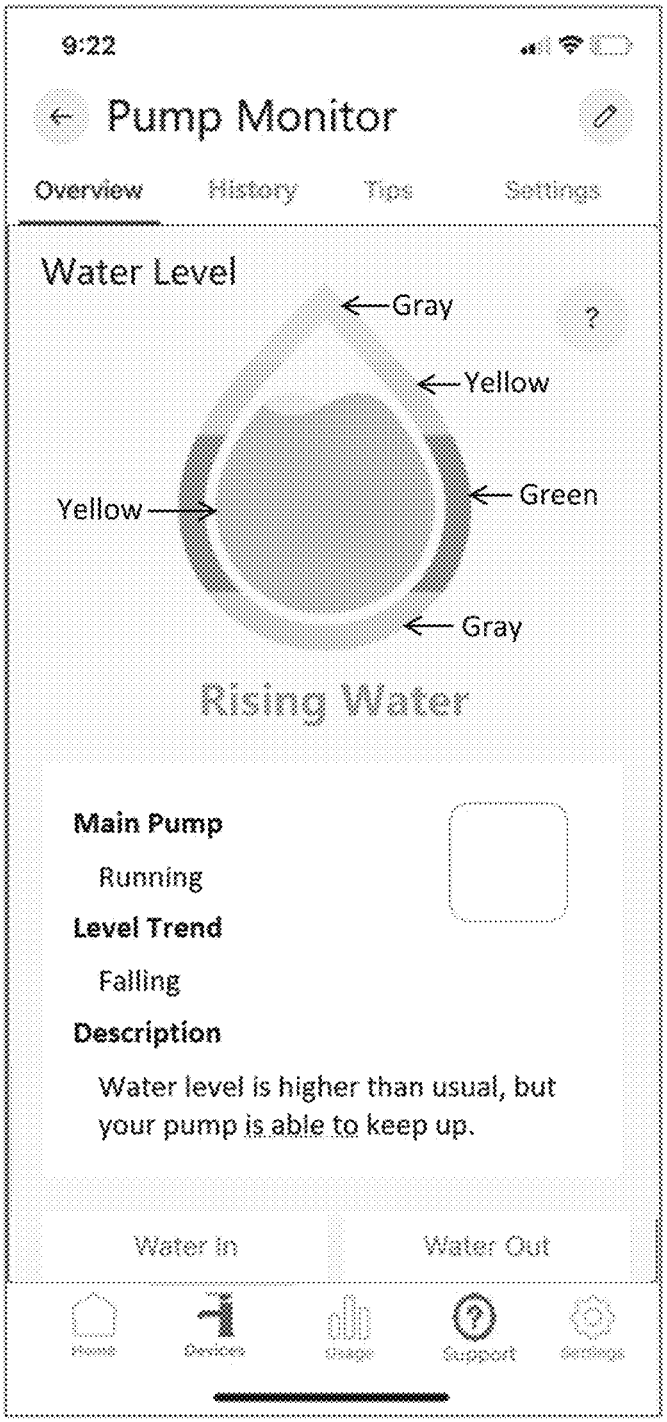
Figure 33:
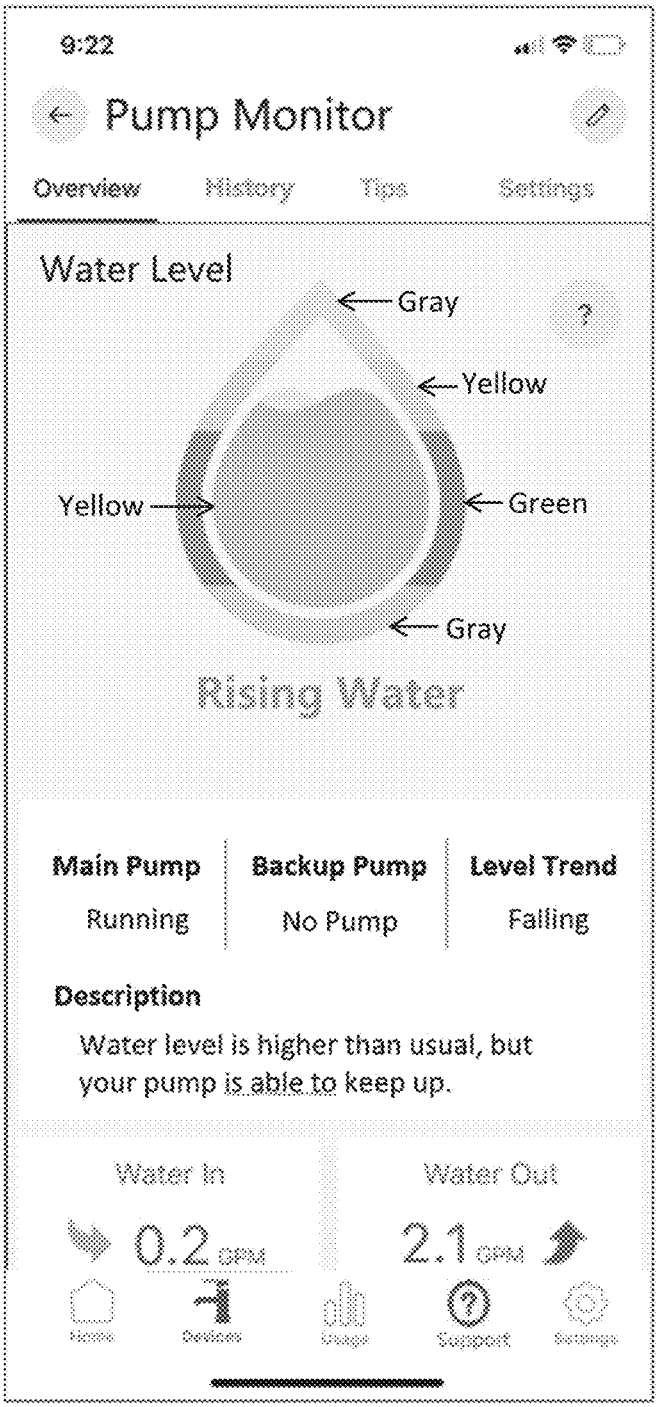
Figure 34:
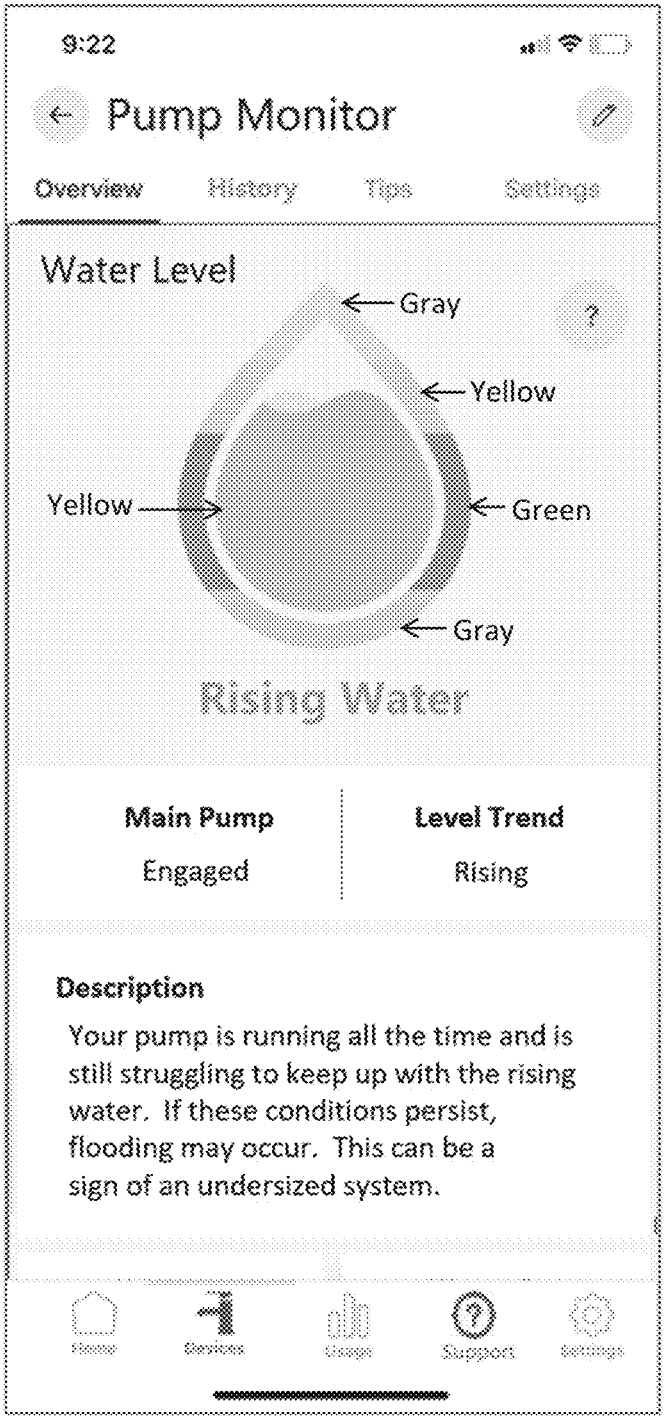
Figure 35:
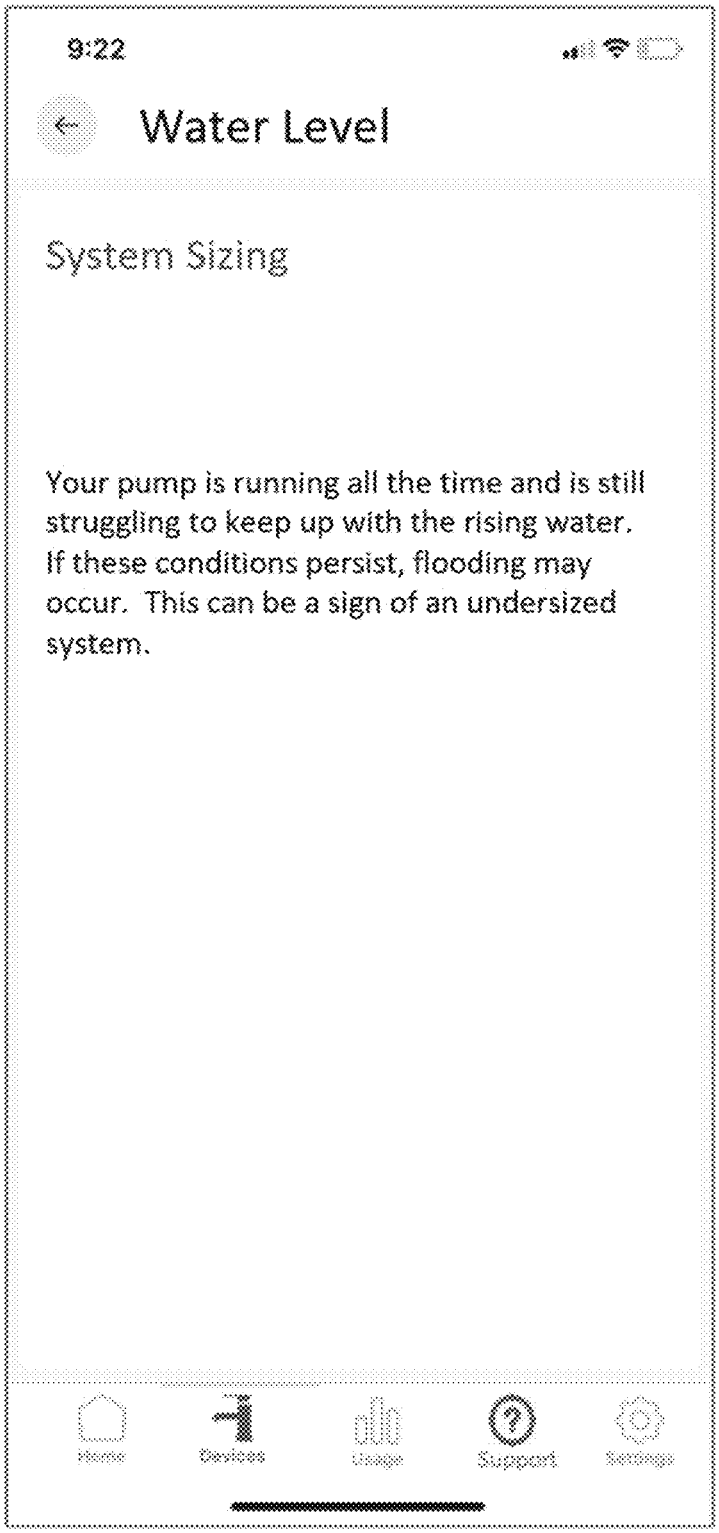
Figure 36:
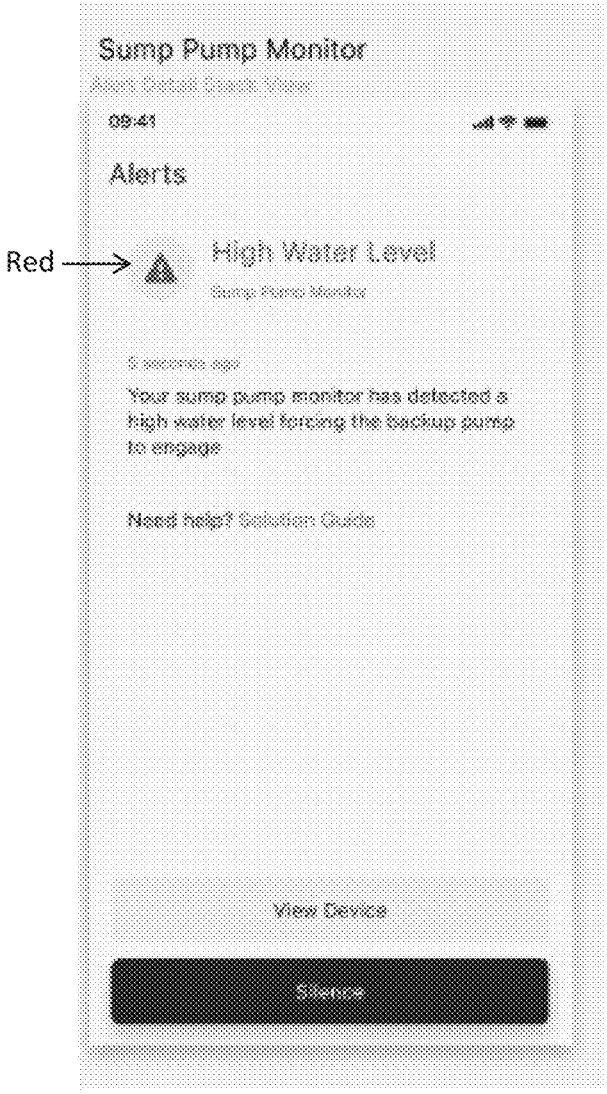
Figure 38:
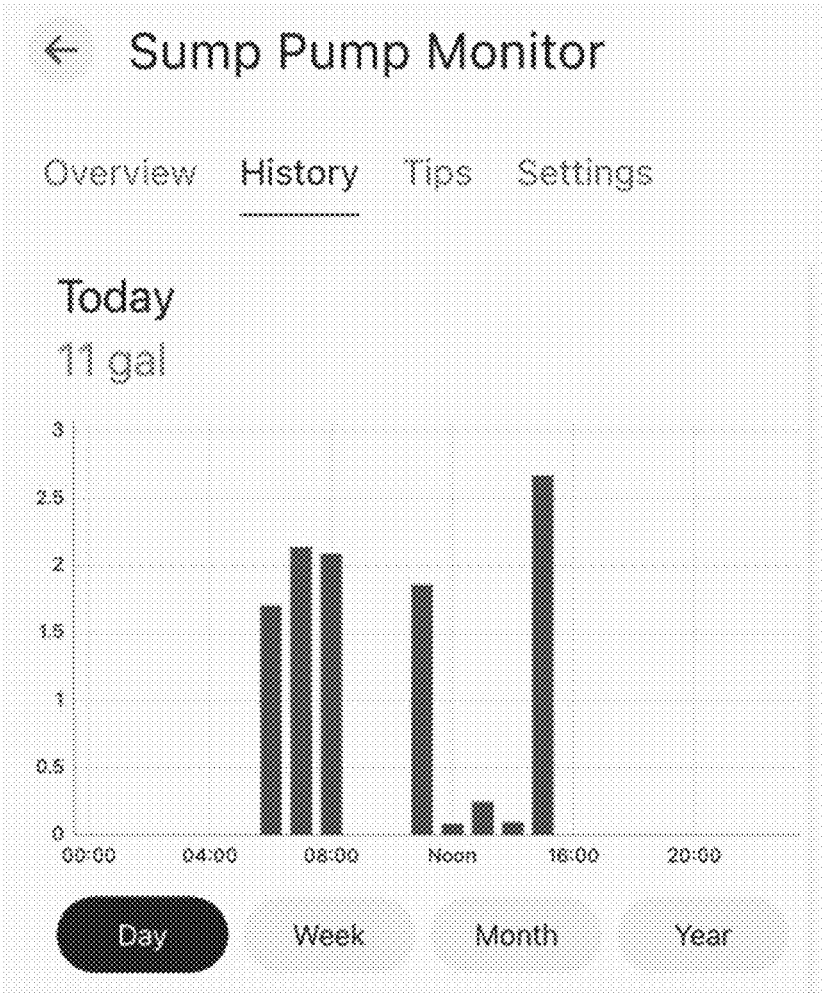
FIGS. 38-44 are illustrations of mobile device screens for displaying information regarding a primary pump and/or a backup pump operation history according to exemplary embodiments of the present invention.
Figure 39:
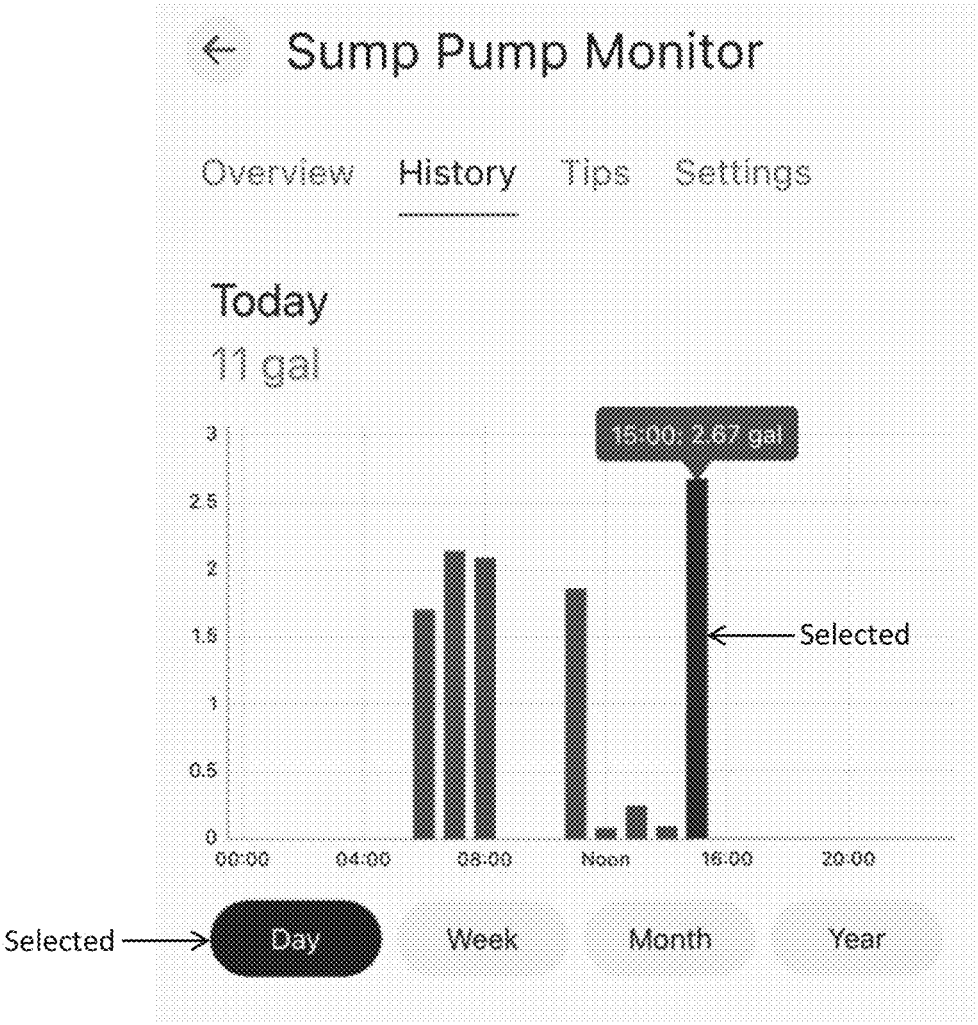
Figure 40:
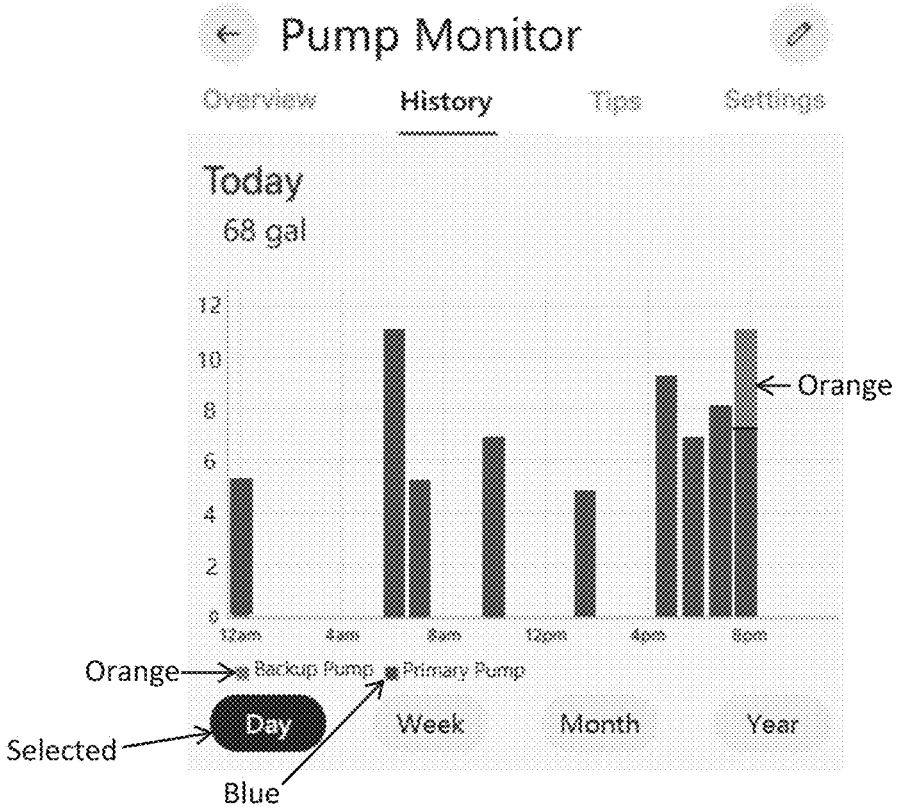
Figure 41:
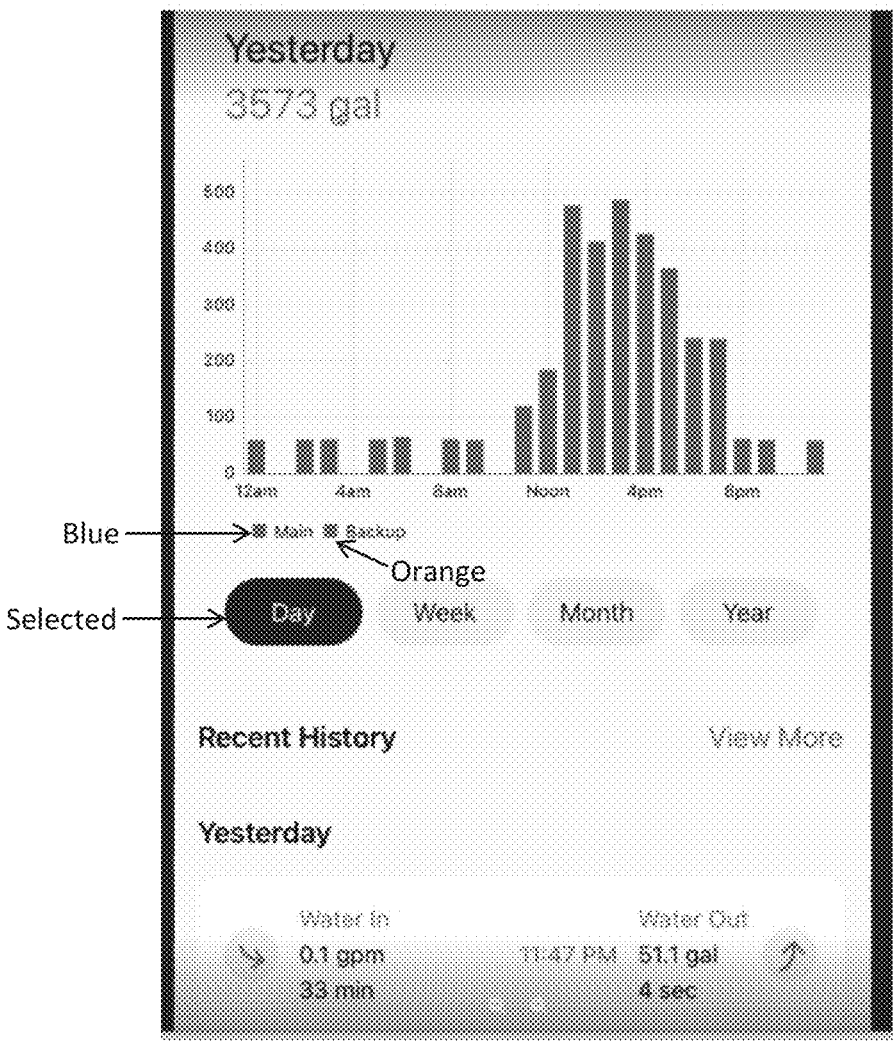
Figure 42:
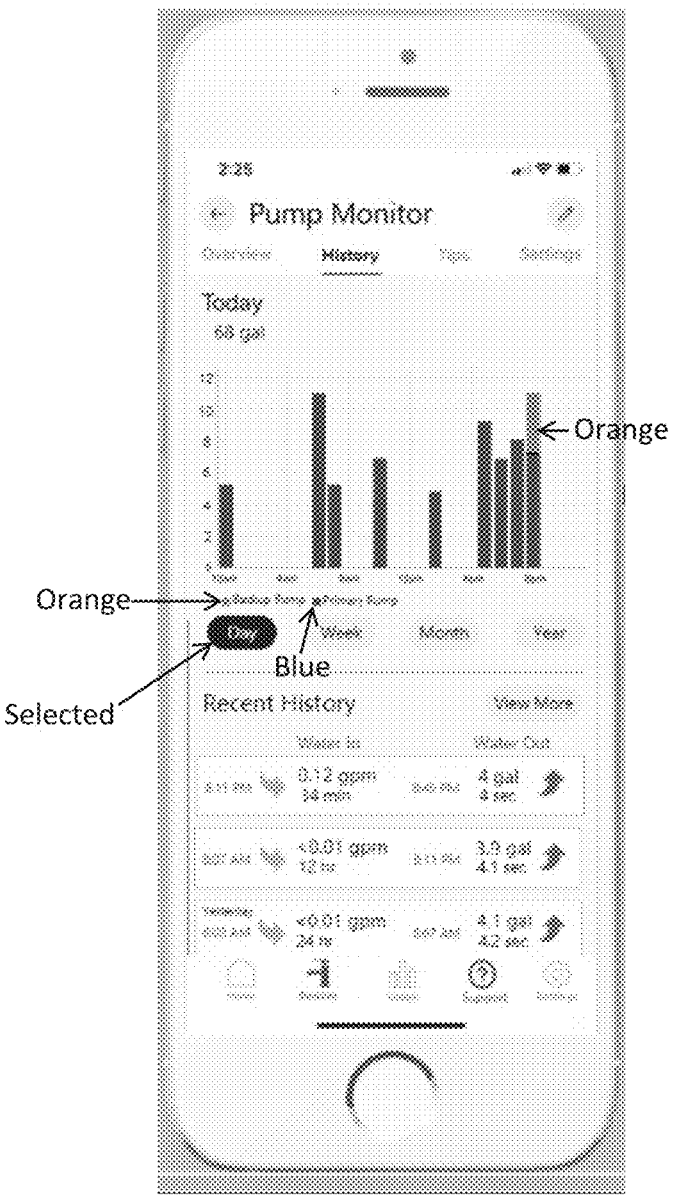
Figure 43:
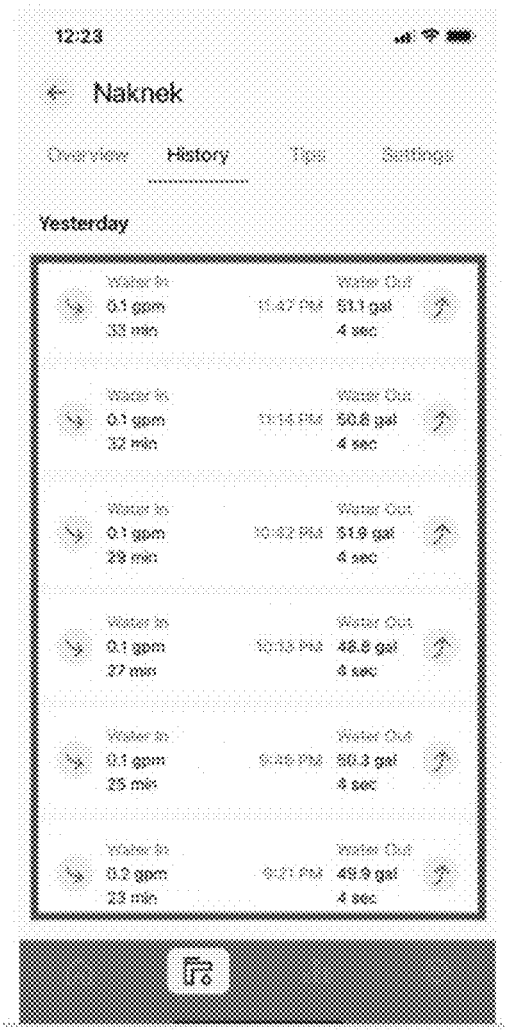

In exemplary embodiments, the processor sends a signal to the user input/output module 28 indicating the water level and/or the water level state. The user input/output module 28 receives the signal from the processor indicating the water level and/or the water level state and displays a notification to the user indicating the water level and/or the water level state. In exemplary embodiments, the water level includes: (1) an absolute water level detected by the water level sensor 26 and/or (2) a relative water level assigned by the processor based on the absolute water level. In exemplary embodiments, the water level state includes: (1) a water level state assigned by the processor based on the absolute water level and/or (2) a water level state assigned by the processor based on the relative water level. In exemplary embodiments, the water level and the water level state are displayed to the user in the form of a water drop. However, one of ordinary skill in the art will appreciate that the water level and/or the water level state could be conveyed to the user in numeric, textual, and/or other forms. FIGS. 24-26 are illustrations of exemplary water drops. FIGS. 27-36 are illustrations of mobile device screens for displaying information regarding the water level and the water level state according to exemplary embodiments.

In the illustrated embodiments of FIGS. 24-26, the water drop includes an interior and a perimeter. In exemplary embodiments, the color and/or the color level of the interior and the perimeter of the water drop conveys to the user information regarding the current water level and/or the current water level state of the sump.

In the illustrated embodiment of FIGS. 24 and 25, when the sump pump system 10 is not receiving information regarding the water level and the water level state of the sump (e.g., because the processor is not connected to the water level sensor 26), the interior of the water drop is transparent (and, thus, will be the color of the background of the user input/output module 28). In the illustrated embodiment, when the sump pump system 10 is receiving information regarding the water level and the water level state of the sump, the interior of the water drop is at least partially blue (representing the water level in the sump). In the illustrated embodiment, the interior of the water drop is blue up to a level corresponding to the water level in the sump (e.g., when the sump is approximately half full, the interior of the water drop is blue up to a level that is approximately half the height of the water drop). Accordingly, in the illustrated embodiment, as the water level in the sump rises and recedes, the color level of the interior of the water drop correspondingly rises and recedes. As a result, the water drop conveys to the user information regarding the current water level of the sump.

In the illustrated embodiment of FIGS. 24 and 25, when the sump pump system 10 is not receiving information regarding the water level and the water level state of the sump (e.g., because the sump pump monitor is not connected to the water level sensor 26), the perimeter of the water drop is gray. In the illustrated embodiment, when the sump pump system 10 is receiving information regarding the water level and the water level state of the sump, the perimeter of the water drop is at least partially green, orange, or red (representing the water level state of the sump). In the illustrated embodiment, the perimeter of the water drop is the color of the water level state of the sump up to a level corresponding to the water level in the sump and gray above that level (e.g., when the water level state is green, the perimeter of the water drop is green up to the level corresponding to the water level in the sump and gray above that level; when the water level state is orange, the perimeter of the water drop is orange up to the level corresponding to the water level in the sump and gray above that level; and when the water level state is red, the perimeter of the water drop is red up to the level corresponding to the water level in the sump and gray above that level). Accordingly, in the illustrated embodiment, as the water level in the sump rises and recedes, the color of the perimeter of the water drop correspondingly changes and the color level of the perimeter of the water drop correspondingly rises and recedes. As a result, the water drop conveys to the user information regarding the current water level and the current water level state of the sump.

In the illustrated embodiment of FIGS. 24 and 25, there are 11 water levels shown in the water drop (e.g., water level 0 through water level 10). In the illustrated embodiment, water level 0 indicates that the sump pump system 10 (e.g., the processor) is not receiving information regarding the water level or the water level state of the sump. In the illustrated embodiment, water levels 1 through 9 correspond to an increasing full sump, and water level 10 corresponds to a full sump. In the illustrated embodiment, water levels 1 through 5 correspond to the water level state green, water levels 6 through 8 correspond to the water level state orange, and water levels 9 and 10 correspond to the water level state red. However, one of ordinary skill in the art will appreciate that there could be more or less water levels shown in the water drop and more or less water levels could correspond to each water level state.

In the illustrated embodiment of FIG. 26, when the sump pump system 10 is not receiving information regarding the water level and the water level state of the sump (e.g., because the sump pump monitor is not connected to the water level sensor 26), the interior of the water drop is transparent (and, thus, will be the color of the background of the user input/output module 28). In the illustrated embodiment, when the sump pump system 10 is receiving information regarding the water level and the water level state of the sump, the interior of the water drop is at least partially colored (representing the water level in the sump). In the illustrated embodiment, the interior of the water drop is the color representing the water level state (e.g., green, yellow, or red) up to a level corresponding to the water level in the sump (e.g., when the sump is approximately one-third full, the interior of the water drop is green up to a level that is approximately one-third the height of the water drop; when the sump is approximately two-thirds full, the interior of the water drop is yellow up to a level that is approximately two-thirds the height of the water drop; and when the sump is approximately full, the interior of the water drop is red up to a level that is approximately the height of the water drop). Accordingly, in the illustrated embodiment, as the water level in the sump rises and recedes, the color of the interior of the water drop correspondingly changes and the color level of the interior of the water drop correspondingly rises and recedes. As a result, the water drop conveys to the user information regarding the current water level and the current water level state of the sump.

In the illustrated embodiment of FIG. 26, when the sump pump system 10 is not receiving information regarding the water level and the water level state of the sump (e.g., because the sump pump monitor is not connected to the water level sensor 26), the perimeter of the water drop is gray. In the illustrated embodiment, when the sump pump system 10 is receiving information regarding the water level and the water level state of the sump, the perimeter of the water drop is at least partially green, yellow, and/or red (representing the water level state of the sump). In the illustrated embodiment, the perimeter of the water drop is the color of each water level state of the sump up to a level corresponding to the water level in the sump and gray below and above that level (e.g., when the water level state is green, the perimeter of the water drop is gray up to a level corresponding to a minimum water level in the sump (e.g., the primary deactivation threshold level), green up to the level corresponding to the water level in the sump, and gray above that level; when the water level state is yellow, the perimeter of the water drop is gray up to the level corresponding to the minimum water level in the sump (e.g., the primary deactivation threshold level), green up to the level of the green water level state, yellow up to the level corresponding to the water level in the sump, and gray above that level; and when the water level state is red, the perimeter of the water drop is gray up to the minimum water level in the sump (e.g., the primary deactivation threshold level), green up to the level corresponding to the green water level state, yellow up to the level corresponding to the yellow water level state, red up to the level corresponding to the water level in the sump, and gray above that level). Accordingly, in an exemplary embodiment, as the water level in the sump rises and recedes, the color of the perimeter of the water drop correspondingly changes and the color level of the perimeter of the water drop correspondingly rises and recedes. As a result, the water drop conveys to the user information regarding the current water level and the current water level state of the sump.

Again, in exemplary embodiments, the processor sends the signal to the user input/output module 28 indicating the water level and/or the water level state. The user input/output module 28 receives the signal from the processor indicating the water level and/or the water level state and displays the notification to the user indicating the water level and/or the water level state.

In exemplary embodiments, the processor sends the signal to the user input/output module 28 indicating the water level and/or the water level state each time the processor receives the water level (e.g., the absolute water level, such as 6 inches) from the water level sensor 26 and/or each time the processor assigns the water level (e.g., the relative water level, such as water level 3). In exemplary embodiments, the processor sends the signal to the user input/output module 28 indicating the water level and/or the water level state only when the water level changes (e.g., when the absolute water level rises or recedes, such as from 6 inches to 6.1 inches, and/or when the relative water level rises one or more levels or recedes one or more levels, such as from water level 2 to water level 3 or from water level 7 to water level 6). In exemplary embodiments, the processor sends the signal to the user input/output module 28 indicating the water level and/or the water level state only when the water level state changes (e.g., when the water level state assigned by the processor based on the absolute water level and/or the water level state assigned by the processor based on the relative water level changes, such as from water level state green to water level state yellow/orange or from water level state red to water level state yellow/orange). In exemplary embodiments, the processor sends the signal to the user input/output module 28 indicating the water level and/or the water level state only when the user input/output module 28 is displaying the notification to the user indicating the water level and/or the water level state and, thus, only when the user input/output module 28 is requesting the water level and/or the water level state. In exemplary embodiments, the frequency at which the processor sends the signals to the user input/output module 28 is based, at least in part, on costs associated with sending the signals (e.g., data transmission costs).

In exemplary embodiments, the processor sends a signal to the user input/output module 28 indicating other parameters relating to operation of the sump pump system 10. The user input/output module 28 receives the signal from the processor and displays notifications to the user indicating the other parameters relating to operation of the sump pump system 10. FIGS. 27-36 are illustrations of mobile device screens for displaying information regarding other parameters relating to operation of the sump pump system 10 according to exemplary embodiments.

In exemplary embodiments, the processor 36 in the sump pump monitor 12 sends the signal to the user input/output module 28 indicating the water level, the water level state, and/or the other parameters relating to operation of the sump pump system 10 via the processor 44*a* in the system provider cloud server 44 and/or the processor 46*a* in the third party cloud server 46. More specifically, the processor 36 in the sump pump monitor 12 sends the signal to the processor 44*a* in the system provider cloud server 44 and/or the processor 46*a* in the third party cloud server 46, and the processor 44*a* in the system provider cloud server 44 and/or the processor 46*a* in the third party cloud server 46 sends the signal to the user input/output module 28.

In exemplary embodiments, the processor 44*a* in the system provider cloud server 44 and/or the processor 46*a* in the third party cloud server 46 does not store the signal indicating the water level, the water level state, and/or the other parameters relating to operation of the sump pump system 10 in the memory 44*b* in the system provider cloud server 44 and/or the memory 46*b* in the third party cloud server 46. In exemplary embodiments, the processor 44*a* in the system provider cloud server 44 and/or the processor 46*a* in the third party cloud server 46 stores the signal indicating the water level, the water level state, and/or the other parameters relating to operation of the sump pump system 10 in the memory 44*b* in the system provider cloud server 44 and/or the memory 46*b* in the third party cloud server 46. In exemplary embodiments, whether the signals are stored in memory is based, at least in part, on costs associated with storing the signals (e.g., data storage costs).

In exemplary embodiments, the sump pump system 10 conveys to the user information regarding the current water level and/or the current water level state of the sump. In exemplary embodiments, the information includes the current water level and/or the current water level state of the sump. In exemplary embodiments, the current water level includes the absolute water level most recently detected by the water level sensor 26 and/or the relative water level most recently assigned by the processor. In exemplary embodiments, the current water level state includes the water level state most recently assigned by the processor based on the current water level. In exemplary embodiments, the current water level is assigned from one of a plurality of water levels (e.g., water level 1 through water level 10). In exemplary embodiments, the current water level state is assigned from one of a plurality of water level states (e.g., water level state green, water level state yellow/orange, and water level state red). In exemplary embodiments, a plurality of water levels corresponds to each water level state (e.g., water levels 1 through 5 correspond to water level state green, water levels 6 through 8 correspond to water level state yellow/orange, and water levels 9 and 10 correspond to water level state red).

Since a plurality of water levels corresponds to each water level state, the user is provided with more detailed information regarding the current water level in the sump. For example, the user can see the water level rise from level 1 to level 2 to level 3 to level 4 to level 5, then recede to level 1. As a result, the user knows that the primary pump 14 is operating normally. Alternatively, instead of seeing the water level recede to level 1 after reaching level 5, the user could see the water level rise from level 5 to level 6 to level 7 to level 8, then recede to level 1. As a result, the user knows that the primary pump 14 is either not operating or not operating normally, but that the backup pump 20 is operating normally. Further alternatively, instead of seeing the water level recede to level 1 after reaching level 8, the user could see the water level rise from level 8 to level 9 to level 10. As a result, the user knows that both the primary pump 14 and the backup pump 20 are either not operating or not operating normally. Thus, the user is notified of conditions that require corrective action to be taken in a timely manner.

In exemplary embodiments, the processor sends a signal to the user input/output module 28 indicating an estimated period of time until the primary pump 14 is next activated. The user input/output module 28 receives the signal from the processor and displays a notification to the user indicating the estimated period of time until the primary pump 14 is next activated. In exemplary embodiments, the estimated period of time until the primary pump 14 is next activated is determined based on when the water level in the sump will reach the primary activation threshold level. In exemplary embodiments, when the water level in the sump will reach the primary activation threshold level is determined based on a current water level in the sump, a current rate at which water is flowing into the sump, and a volume of the sump (which can be determined based on the diameter of the sump).

Backup Pump/Power Source Monitoring Subsystem

An exemplary embodiment of a backup pump/power source monitoring subsystem 62 is illustrated in FIG. 9.

In an exemplary embodiment, the backup pump/power source monitoring subsystem 62 includes a mechanism to determine whether the backup pump 20 has failed or is likely to fail and/or whether the backup power source 24 has failed or is likely to fail.

In an exemplary embodiment, the water level sensor 26 periodically detects the water level in the sump and sends a signal to the processor indicating the water level. During normal operation, the water level in the sump gradually increases.

In an exemplary embodiment, the processor periodically receives the signal from the water level sensor 26 indicating the water level. As the water level in the sump rises, the processor determines the fill rate of the sump by comparing the water level over time.

In an exemplary embodiment, before the water level reaches the primary activation threshold level, the sump pump monitor 12 shuts off power to the primary pump 14 to prevent the primary pump 14 from operating and removing water from the sump. As a result, the water level in the sump continues to rise.

In an exemplary embodiment, when the water level in the sump reaches the backup activation threshold level, the backup pump 20 should activate and remove water from the sump through the backup discharge pipe 22. The processor determines whether the water level starts to lower as a result of the backup pump 20 operating.

In an exemplary embodiment, if the water level in the sump does not start to lower when it reaches the backup activation threshold level, then the backup pump 20 has failed. The processor turns on power to the primary pump 14 to enable the primary pump 14 to operate again. The processor sends a signal to the user input/output module 28 indicating this information (i.e., that the backup pump 20 has failed). The user input/output module 28 receives the signal from the processor and displays a notification to the user indicating this information.

In an exemplary embodiment, if the water level in the sump starts to lower when it reaches the backup activation threshold level, then the processor determines the empty rate of the sump by comparing the water level over time. Additionally, if the water level in the sump starts to lower when it reaches the backup activation threshold level, then the processor determines the pump rate of the backup pump 20 by comparing the water level over time. The pump rate of the backup pump 20 is the pump rate while only the backup pump 20 is running. Once the processor determines the pump rate of the backup pump 20, the processor turns on power to the primary pump 14 to enable the primary pump 14 to operate again.

In an exemplary embodiment, the processor stores the pump rate of the backup pump 20 over a period of time. The processor analyzes any changes in the pump rate of the backup pump 20 over the period of time to determine whether there is a degradation in the performance of the backup pump 20.

In an exemplary embodiment, the processor analyzes the current pump rate of the backup pump 20 and the change in the pump rate of the backup pump 20 over time to estimate the current health of the backup pump 20 and to predict the future health of the backup pump 20 (i.e., whether the backup pump 20 has failed or is likely to fail). The processor sends a signal to the user input/output module 28 indicating this information (i.e., the current health and/or the future health of the backup pump 20). The user input/output module 28 receives the signal from the processor and displays a notification to the user indicating this information.

In the illustrated embodiment, as shown in FIG. 6, the sump pump system 10 includes a trickle charger 70 for the backup power source 24. The trickle charger 70 is electrically connected to the backup power source 24. In the illustrated embodiment, the trickle charger 70 is electrically connected to the sump pump monitor 12. After the backup pump 20 deactivates, the processor measures a trickle charge flowing to the backup power source 24.

In an exemplary embodiment, the processor stores the trickle charge over a period of time. The processor analyzes any change in the trickle charge over the period of time to determine whether there is a degradation in the performance of the backup power source 24.

In an exemplary embodiment, the processor analyzes the current trickle charge and the change in the trickle charge over time to estimate the current health of the backup power source 24 and to predict the future health of the backup power source 24 (i.e., whether the backup power source 24 has failed or is likely to fail). The processor sends a signal to the user input/output module 28 indicating this information (i.e., the current health and/or the future health of the backup power source 24). The user input/output module 28 receives the signal from the processor and displays a notification to the user indicating this information.

In exemplary embodiments, the pump performance information and the trickle charge information are used independently and/or in combination.

Figure 22:
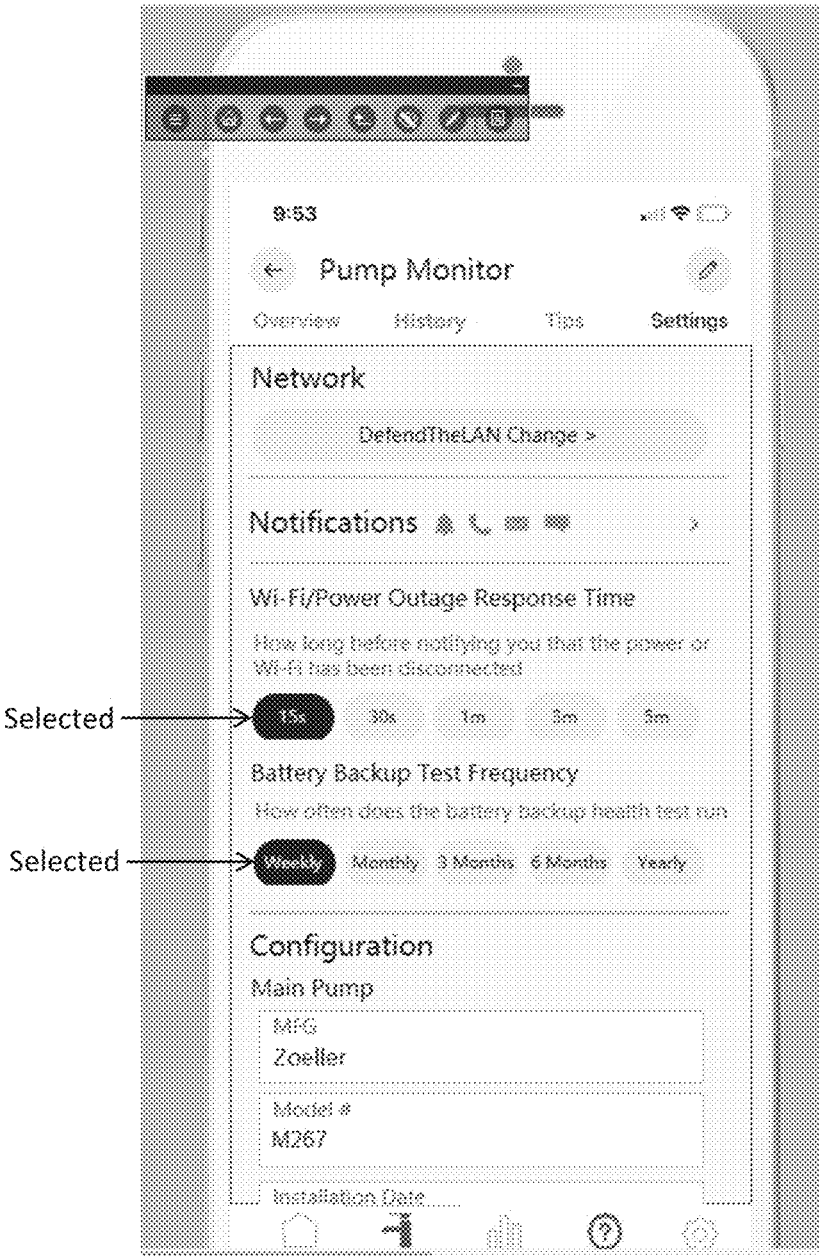
Figure 23:
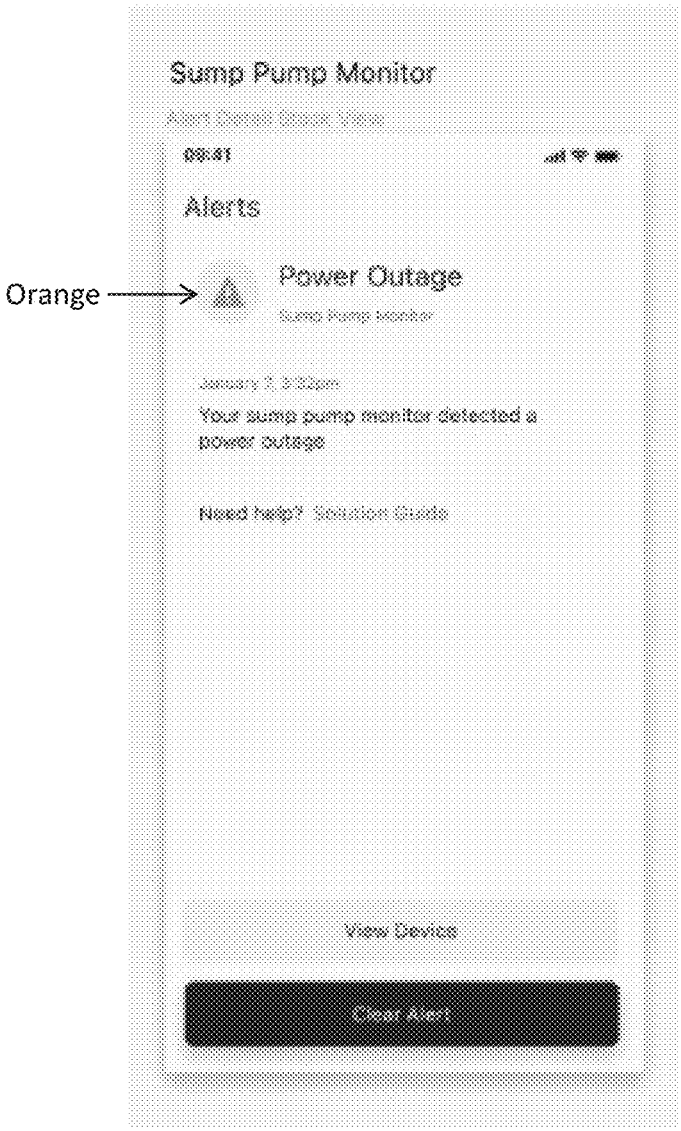

In exemplary embodiments, the sump pump system 10 includes a backup pump/power source monitoring frequency feature. FIGS. 22 and 37 are illustrations of mobile device screens for displaying information regarding the backup pump/power source monitoring frequency feature according to exemplary embodiments. In exemplary embodiments, the user selects a frequency at which the backup pump/power source monitoring occurs (e.g., weekly, monthly, every 3 months, every 6 months, or yearly) using the user input/output module 28.

Allocation Monitoring Subsystem

An exemplary embodiment of an allocation monitoring subsystem 64 is illustrated in FIG. 9.

In an exemplary embodiment, the allocation monitoring subsystem 64 includes a mechanism to determine an amount of water removed from the sump by each of the primary pump 14 and the backup pump 20.

In an exemplary embodiment, the water level sensor 26 periodically detects the water level in the sump and sends a signal to the processor indicating the water level. Additionally, the pump current sensor 30 periodically detects whether current is flowing to the primary pump 14 and sends a signal to the processor indicating whether current is flowing to the primary pump 14. When the primary pump 14 is running, current is flowing to the primary pump 14. When the primary pump 14 is not running, current is not flowing to the primary pump 14.

In an exemplary embodiment, the processor periodically receives the signal from the water level sensor 26 indicating the water level. Additionally, the processor periodically receives the signal from the pump current sensor 30 indicating whether current is flowing to the primary pump 14.

In an exemplary embodiment, as the water level in the sump rises, the processor determines the fill rate of the sump by comparing the water level over time. When the water level in the sump reaches the primary activation threshold level, the primary pump 14 should activate and remove water from the sump through the primary discharge pipe 16. The processor determines whether the water level starts to lower as a result of the primary pump 14 running.

In an exemplary embodiment, if the water level in the sump starts to lower when it reaches the primary activation threshold level, then the processor determines the empty rate of the sump by comparing the water level over time. Additionally, if the water level in the sump starts to lower when it reaches the primary activation threshold level, then the processor determines the pump rate of the primary pump 14 by comparing the water level over time. The pump rate of the primary pump 14 is the pump rate while only the primary pump 14 is running (i.e., while the water level in the sump is below the backup activation threshold level).

In an exemplary embodiment, if the primary pump 14 is running, the water level is decreasing, and the water level in the sump is below the backup activation threshold level, then the water removed from the sump is being removed by the primary pump 14 and the amount of water removed can be allocated to the primary pump 14.

In an exemplary embodiment, if the primary pump 14 is not running and the water level is decreasing, then the water removed from the sump is being removed by the backup pump 20 and the amount of water removed can be allocated to the backup pump 20.

In an exemplary embodiment, if the primary pump 14 is running, and the pump rate increases, then the water removed from the sump is being removed by the primary pump 14 and the backup pump 20 and the amount of water removed needs to be allocated between the primary pump 14 and the backup pump 20. The amount of water allocated to the primary pump 14 is calculated based on the primary pump rate, and the amount of water allocated to the backup pump 20 is calculated based on the increase in the pump rate over the primary pump rate.

In an exemplary embodiment, the processor sends a signal to the user input/output module 28 indicating this information (i.e., the amount of water removed by the primary pump 14 and the amount of water removed by the backup pump 20). The user input/output module 28 receives the signal from the processor and displays a notification to the user indicating this information.

Installation Monitoring Subsystem

An exemplary embodiment of an installation monitoring subsystem 66 is illustrated in FIG. 9.

In an exemplary embodiment, the sump pump system 10 is installed. The installation includes installing the water level sensor 26. In an exemplary embodiment, the water level sensor 26 is operable to be mounted in or above the sump, e.g., on one of the primary discharge pipe 16 and the backup discharge pipe 22. When properly installed, the water level sensor 26 should be directed toward the bottom surface of the sump and generally perpendicular to the bottom surface of the sump with a line of sight to the water in the sump. Additionally, when properly installed, the water level sensor 26 should be mounted within approximately 30 inches of the primary deactivation threshold level. In an exemplary embodiment, the water level sensor 26 is mounted at or slightly below a top of the sump. In an exemplary embodiment, the water level sensor 26 is mounted approximately 18 inches above the primary deactivation threshold level.

In an exemplary embodiment, the installation monitoring subsystem 66 includes a mechanism to determine whether the water level sensor 26 was properly installed.

In an exemplary embodiment, the water level sensor 26 periodically detects the water level in the sump and sends a signal to the processor indicating the water level. During normal operation, the water level in the sump gradually increases. When the water level reaches the primary activation threshold level, the primary pump 14 activates and removes water from the sump through the primary discharge pipe 16. During normal operation, the water level in the sump quickly decreases. When the water level in the sump reaches the primary deactivation threshold level, the primary pump 14 deactivates.

In an exemplary embodiment, the processor periodically receives the signal from the water level sensor 26 indicating the water level. The processor determines whether the water level sensor 26 has been properly installed by comparing the water level over time. If the primary pump 14 is running and the water level is decreasing, then the water level sensor 26 has been properly installed. If the primary pump 14 is running and the water level is not decreasing, then the water level sensor 26 has not been properly installed.

In an exemplary embodiment, the processor sends a signal to the user input/output module 28 indicating this information (i.e., whether the water level sensor 26 has been properly installed). The user input/output module 28 receives the signal from the processor and displays a notification to the user indicating this information.

Check Valve Monitoring Subsystem

An exemplary embodiment of a check valve monitoring subsystem 68 is illustrated in FIG. 9.

In an exemplary embodiment, the sump pump system 10 is installed. The installation includes installing a primary check valve 72 in the primary discharge pipe 16. Additionally, if the sump pump system 10 includes a backup pump 20, the installation includes installing a backup check valve 74 in the backup discharge pipe 22.

In an exemplary embodiment, the check valve monitoring subsystem 68 includes a mechanism to determine whether the primary check valve 72 was installed in the primary discharge pipe 16 and, subsequently, whether the primary check valve 72 is properly functioning. One of ordinary skill in the art will appreciate that a similar mechanism could be used to determine whether the backup check valve 74 was installed in the backup discharge pipe 22 and, subsequently, whether the backup check valve 74 is properly functioning.

In an exemplary embodiment, the water level sensor 26 periodically detects the water level in the sump and sends a signal to the processor indicating the water level. During normal operation, the water level in the sump gradually increases. When the water level in the sump reaches the primary activation threshold level, the primary pump 14 activates and removes water from the sump through the primary discharge pipe 16. During normal operation, the water level in the sump quickly decreases. When the water level in the sump reaches the primary deactivation threshold level, the primary pump 14 deactivates. At this time, there is water standing in the discharge pipe that was not discharged to the storm sewer or other discharge point.

In an exemplary embodiment, if the primary check valve 72 has been installed in the primary discharge pipe 16 and is properly functioning, then the water standing in the primary discharge pipe 16 primarily stays in the primary discharge pipe 16 (although there may be a small amount of backflow from the primary discharge pipe 16 into the sump). As a result, the water level in the sump gradually increases again (i.e., there should be a generally constant fill rate) due to normal water flow into the sump. In an exemplary embodiment, the fill rate is approximately ¼ gallon per second for a period of time just before operation of the primary pump 14. However, if the primary check valve 72 has not been installed in the primary discharge pipe 16 or is not properly functioning, then the water standing in the primary discharge pipe 16 quickly flows back into the sump. As a result, the water level in the sump quickly increases and then levels out (i.e., there is a steep fill rate followed by a leveling off of the fill rate) due to backflow from the primary discharge pipe 16 into the sump followed by normal water flow into the sump. In an exemplary embodiment, the fill rate is approximately 1 gallon per second for 3 seconds just after operation of the primary pump 14 followed by ¼ gallon per second for a period of time.

In an exemplary embodiment, the processor periodically receives the signal from the water level sensor 26 indicating the water level. The processor determines whether the primary check valve 72 has been installed and is properly functioning by comparing the water level over time. If the water level gradually increases (i.e., there is a fairly constant fill rate) after the primary pump 14 deactivates, then the primary check valve 72 has been installed and is properly functioning. If the water level quickly increases and then levels out (i.e., there is a steep fill rate followed by a leveling off of the fill rate) after the primary pump 14 deactivates, then the primary check valve 72 has not been installed or is not properly functioning.

In an exemplary embodiment, the processor sends a signal to the user input/output module 28 indicating this information (i.e., whether the primary check valve 72 has been installed and is properly functioning). The user input/output module 28 receives the signal from the processor and displays a notification to the user indicating this information.

In exemplary embodiments, the processor sends a signal to the user input/output module 28 indicating the primary pump and/or the backup pump operation history. The user input/output module 28 receives the signal from the processor and displays a notification to the user indicating the primary pump and/or the backup pump operation history. In exemplary embodiments, the primary pump and/or the backup pump operation history is displayed to the user in the form of history data. In exemplary embodiments, the primary pump and/or the backup pump operation history is displayed to the user in the form of history graphs. FIGS. 38-44 are illustrations of mobile device screens for displaying information regarding the primary pump and/or the backup pump operation history according to exemplary embodiments.

In exemplary embodiments where the primary pump and/or the backup pump operation history is displayed to the user in the form of history data, the history data includes water in and water out data for one or more cycles of operation of the primary pump 14 and/or the backup pump 20. However, one of ordinary skill in the art will appreciate that the history data could include other information regarding the operation of the primary pump 14 and/or the backup pump 20. As used herein, a cycle is a period of time of operation of the primary pump 14 and/or the backup pump 20 from activation through deactivation.

In exemplary embodiments, the water in data includes the water that flowed into the sump between an end time of the second to last cycle and a start time of the last cycle, a start time of the second to last cycle, and/or a period of time between the end time of the second to last cycle and the start time of the last cycle. In exemplary embodiments, the water that flowed into the sump is displayed as a rate of water pumped out, e.g., gallons per minute ("GPM"). However, one of ordinary skill in the art will appreciate that the water that flowed into the sump could be displayed in other formats, such as a volume, e.g., gallons.

In exemplary embodiments, the water out data includes the water that was pumped out of the sump during the last cycle, a start time of the last cycle, and/or a period of time between the start time and an end time of the last cycle. In exemplary embodiments, the water that was pumped out of the sump is displayed as a volume, e.g., gallons. However, one of ordinary skill in the art will appreciate that the water that was pumped out of the sump could be displayed in other formats, such as a rate of water pumped out, e.g., gallons per minute ("GPM").

In exemplary embodiments, the history data for a most recent cycle is displayed to the user. In exemplary embodiments, the history data for a most recent plurality of cycles is displayed to the user.

In exemplary embodiments where the primary pump and/or the backup pump operation history is displayed to the user in the form of history graphs, each history graph includes an amount of water that was pumped out of the sump during a selected period of time. However, one of ordinary skill in the art will appreciate that the history graphs could include other information regarding the operation of the primary pump 14 and/or the backup pump 20.

In exemplary embodiments, the amount of water that was pumped out of the sump is displayed as a volume, e.g., gallons. However, one of ordinary skill in the art will appreciate that the amount of water that was pumped out of the sump could be displayed in other formats, such as a rate of water pumped out, e.g., gallons per minute ("GPM").

In exemplary embodiments, the user selects the period of time for which the history graph is displaying the amount of water that was pumped out of the sump using the user input/output module 28. In exemplary embodiments, the period of time is one of a day, a week, a month, and a year. In exemplary embodiments, if the selected period of time is a day, each bar of the history graph represents 1 hour and there would be 24 bars in the history graph; if the selected period of time is a week, each bar of the history graph represents 1 day and there would be 7 bars in the history graph; if the selected period of time is a month, each bar of the history graph represents 1 day and there would be 28-31 bars in the history graph (depending on the number of days in the month); and if the selected period of time is a year, each bar of the history graph represents 1 month and there would be 12 bars in the history graph.

In exemplary embodiments, the history graph delineates between the water that was pumped out of the sump by the primary pump 14 and by the backup pump 20 during the selected period of time. In exemplary embodiments, each bar of the history graph shows the water that was pumped out of the sump by the primary pump 14 in a first color and the water that was pumped out of the sump by the backup pump 20 in a second color. However, one of ordinary skill in the art will appreciate that the water that was pumped out of the sump by the primary pump 14 and by the backup pump 20 could be delineated in other formats, such as numerically.

Figure 44:
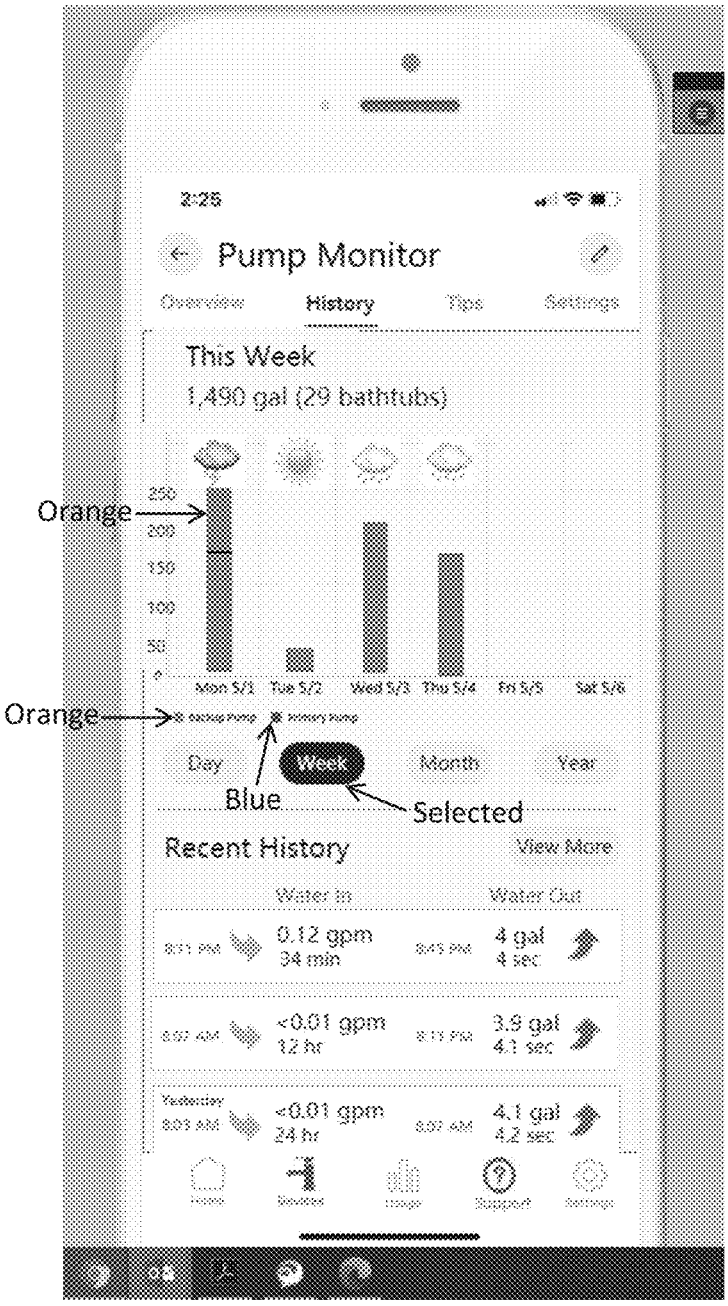
Figure 45:
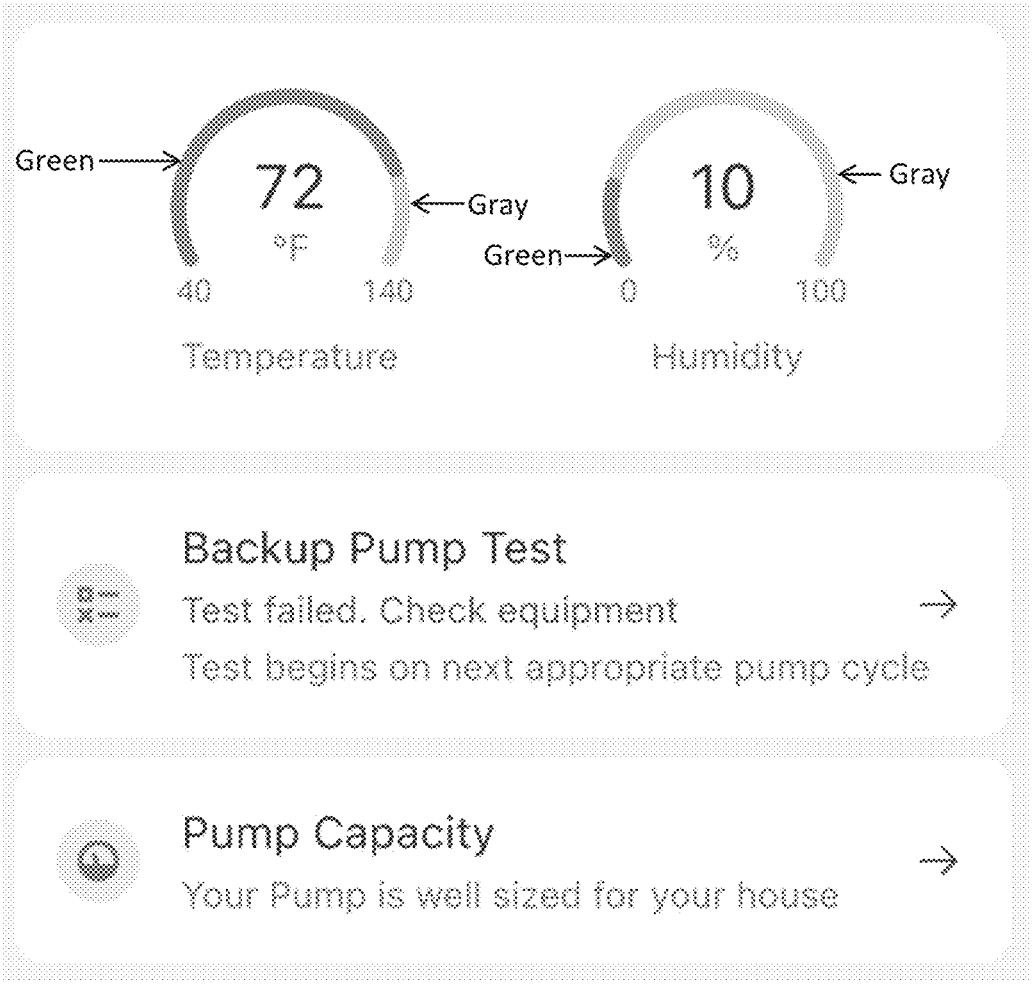
Figure 46:
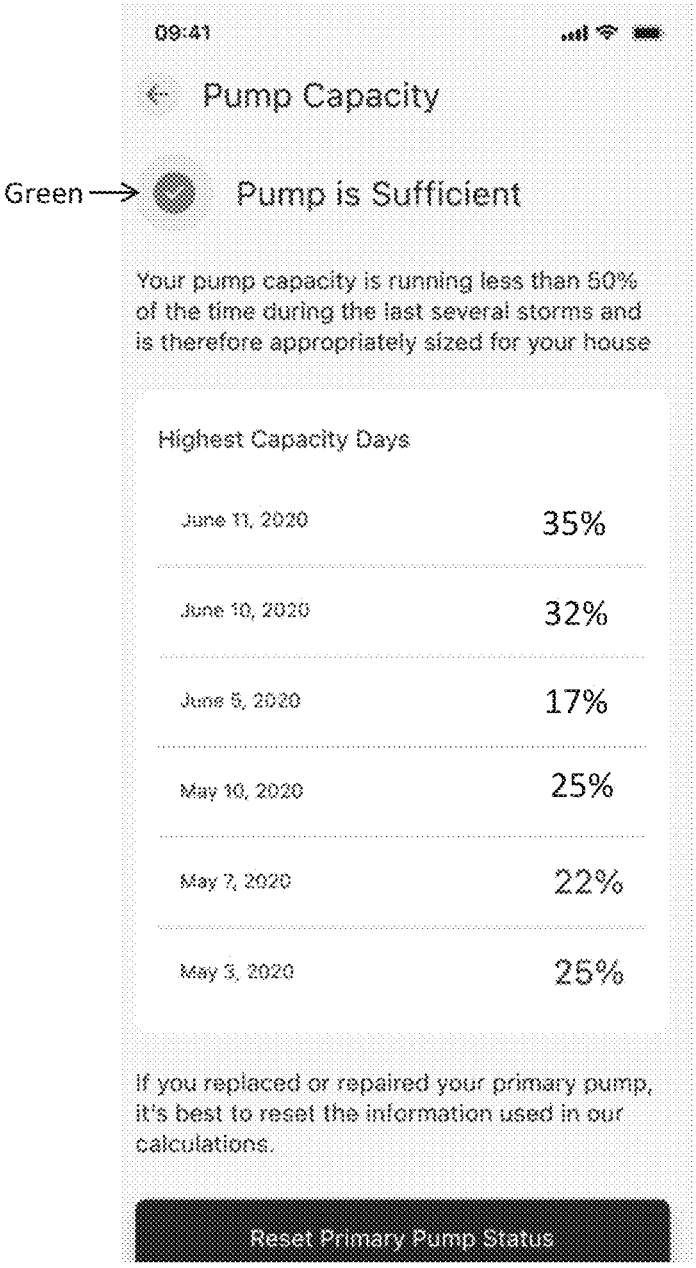
Figure 47:
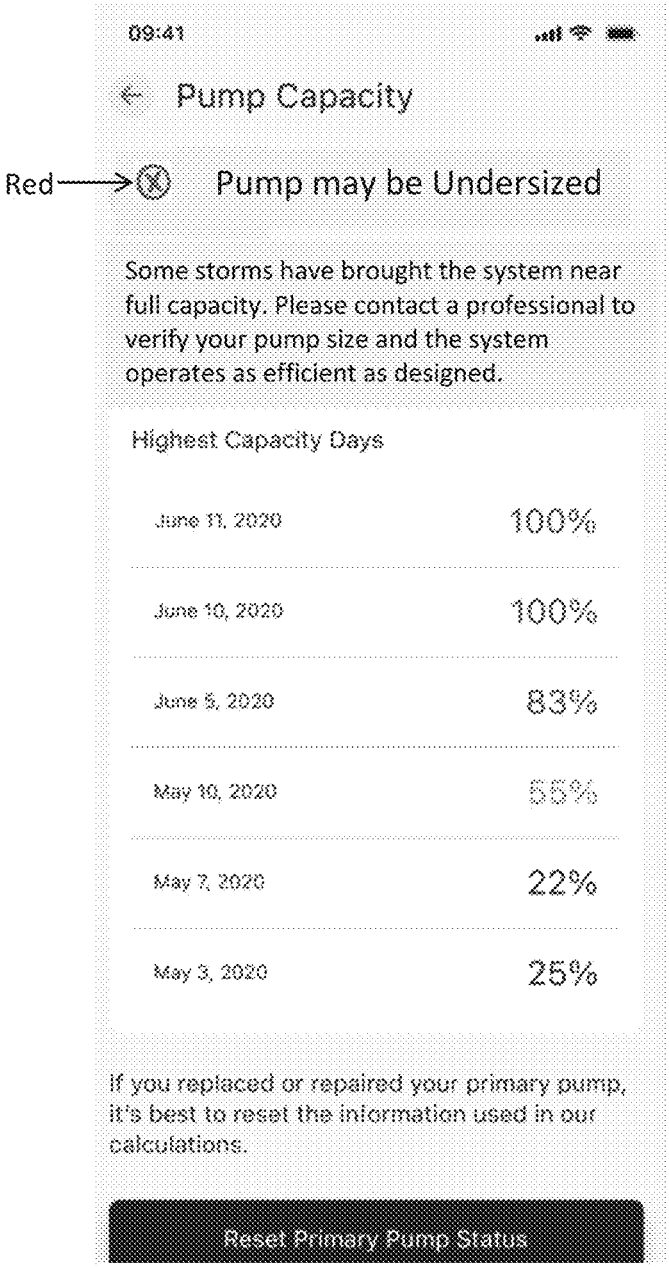
Figure 48:
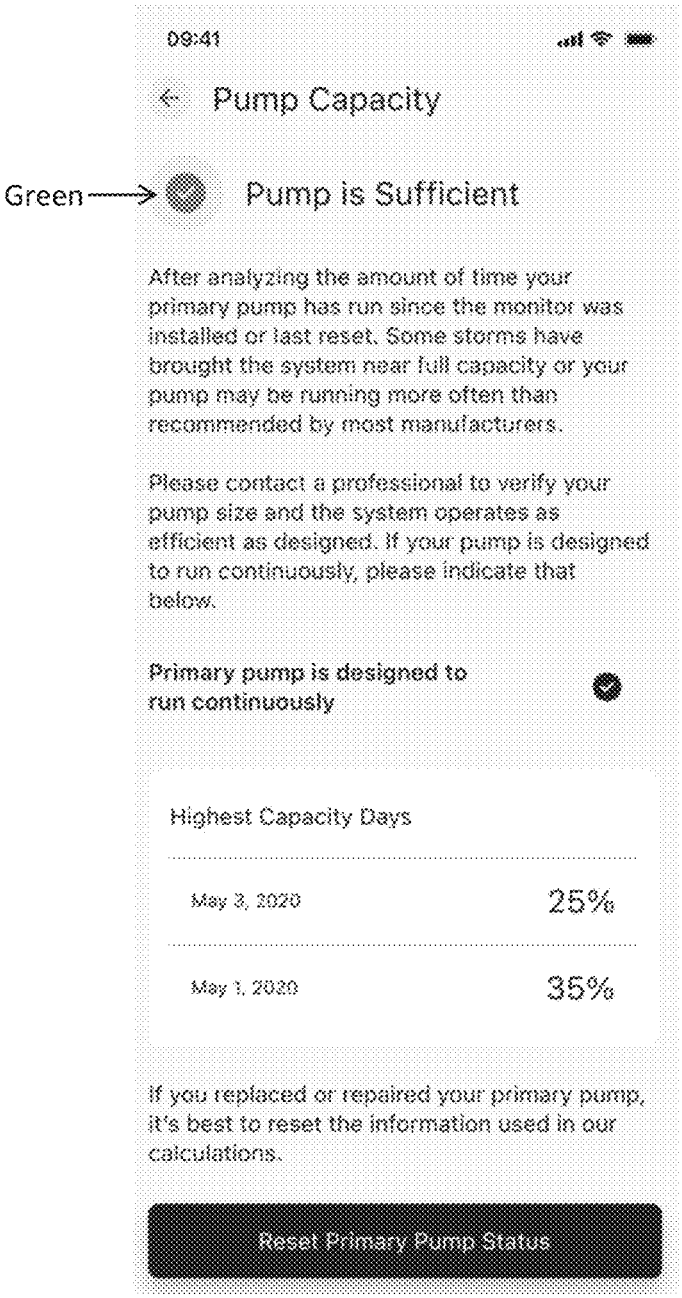
Figure 50:
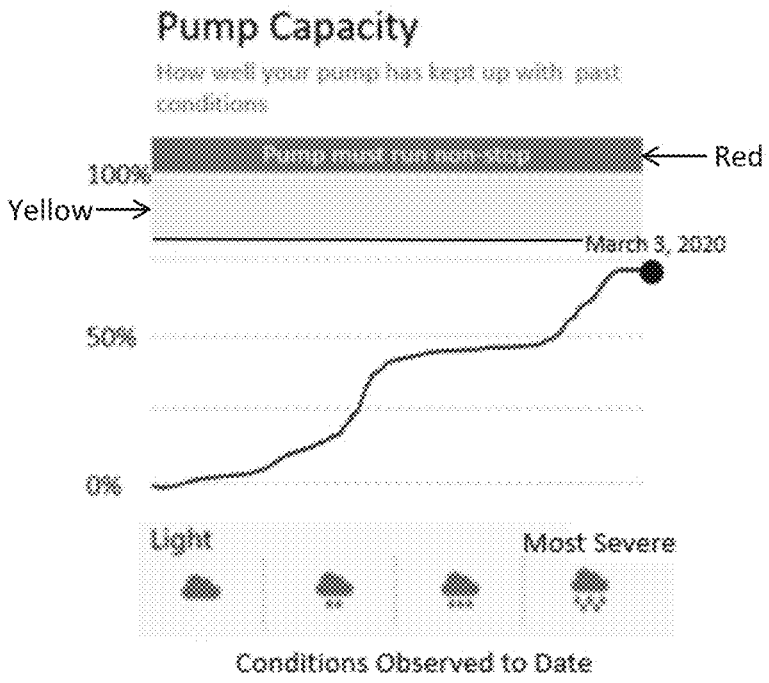

In exemplary embodiments, the history graph includes an indication of the weather during the selected period of time. For example, in the illustrated embodiment, as shown in FIG. 44, if the selected period of time is a week, the history graph can include a symbol (e.g., sun, cloud, or rain drops) indicating the weather for each day of the week above each bar of the history graph.

Again, in exemplary embodiments, the processor sends the signal to the user input/output module 28 indicating the primary pump and/or the backup pump operation history. The user input/output module 28 receives the signal from the processor and displays the notification to the user indicating the primary pump and/or the backup pump operation history.

In exemplary embodiments, the processor sends the signal to the user input/output module 28 indicating the primary pump and/or the backup pump operation history each time a cycle ends (i.e., when the primary pump 14 and/or the backup pump 20 are deactivated). In exemplary embodiments, the processor sends the signal to the user input/output module 28 indicating the primary pump and/or the backup pump operation history after a predetermined period of time even if the cycle has not ended (i.e., after a timeout period). In exemplary embodiments, the processor sends the signal to the user input/output module 28 indicating the primary pump and/or the backup pump operation history at a predetermined interval of time (e.g., once a day). In exemplary embodiments, the processor sends the signal to the user input/output module 28 indicating the primary pump and/or the backup pump operation history only when the user input/output module 28 is displaying the notification to the user indicating the primary pump and/or the backup pump operation history and, thus, only when the user input/output module 28 is requesting the primary pump and/or the backup pump operation history. In exemplary embodiments, the frequency at which the processor sends the signals to the user input/output module 28 is based, at least in part, on costs associated with sending the signals (e.g., data transmission costs).

In exemplary embodiments, the processor 36 in the sump pump monitor 12 sends the signal to the user input/output module 28 indicating the primary pump and/or the backup pump operation history via the processor 44*a* in the system provider cloud server 44 and/or the processor 46*a* in the third party cloud server 46. More specifically, the processor 36 in the sump pump monitor 12 sends the signal to the processor 44*a* in the system provider cloud server 44 and/or the processor 46*a* in the third party cloud server 46, and the processor 44*a* in the system provider cloud server 44 and/or the processor 46*a* in the third party cloud server 46 sends the signal to the user input/output module 28.

In exemplary embodiments, the processor 44*a* in the system provider cloud server 44 and/or the processor 46*a* in the third party cloud server 46 stores the signal indicating the primary pump and/or the backup pump operation history in the memory 44*b* in the system aprovider cloud server 44 and/or the memory 46*b* in the third party cloud server 46. More specifically, the processor 44*a* in the system provider cloud server 44 and/or the processor 46*a* in the third party cloud server 46 stores the water in and water out data displayed as the history data. Further, the processor 44*a* in the system provider cloud server 44 and/or the processor 46*a* in the third party cloud server 46 stores the total water out data displayed as each bar of each history graph, instead of calculating the total water out data each time the user input/output module 28 requests the history graph.

In exemplary embodiments, the processor determines a capacity of the primary pump 14 (i.e., whether the primary pump 14 is properly sized) based on operation history. FIGS. 35 and 45-50 are illustrations of mobile device screens and messages for displaying information regarding the primary pump capacity according to exemplary embodiments.

In exemplary embodiments, to determine the primary pump capacity, the processor determines a percentage of time and/or a duration of time that the primary pump 14 operated during a predetermined period of time throughout each day. In exemplary embodiments, the predetermined period of time is in the range of approximately 5-15 minutes. However, one of ordinary skill in the art will appreciate that the predetermined period of time could be larger or smaller. If the predetermined period of time is 10 minutes, then the processor determines the percentage of time and/or the duration of time that the primary pump 14 operated for each 10 minute interval during each day. If the primary pump 14 operated for the entire 10 minute interval, then the percentage of time is 100% and/or the duration of time is 10 minutes. If the primary pump 14 operated for 5 minutes of the 10 minute interval, then the percentage of time is 50% and/or the duration of time is 5 minutes. In exemplary embodiments, if the primary pump 14 activates in a middle of a current predetermined period of time, then the processor starts a new predetermined period of time, instead of waiting until an end of the current predetermined period of time.

In exemplary embodiments, the processor assigns to each day the highest percentage of time and/or the highest duration of time that the primary pump 14 operated during any of the 10 minute intervals throughout that day. If the highest percentage of time and/or the highest duration of time that the primary pump 14 operated during any 10 minute interval is 100% and/or 10 minutes, then that day is assigned 100% and/or 10 minutes. If the highest percentage of time and/or the highest duration of time that the primary pump 14 operated during any 10 minute interval is 60% and/or 6 minutes, then that day is assigned 60% and/or 6 minutes.

In exemplary embodiments, if the highest percentage of time (or a percentage equivalent of the highest duration of time) for any day is less than or equal to 50%, then the primary pump 14 is likely properly sized. In exemplary embodiments, if the highest percentage of time (or a percentage equivalent of the highest duration of time) for any day is greater than 50% and less than or equal to 80%, then the primary pump 14 may not be properly sized. In exemplary embodiments, if the highest percentage of time (or a percentage equivalent of the highest duration of time) for any day is greater than 80%, then the primary pump 14 is likely not properly sized. One of ordinary skill in the art will appreciate that these thresholds could be larger or smaller.

In exemplary embodiments, the processor sends a signal to the user input/output module 28 indicating the highest percentage of time and/or the highest duration of time for a specified number of days and/or an indication whether the primary pump 14 is properly sized. The user input/output module 28 receives the signal from the processor and displays a notification to the user indicating the highest percentage of time and/or the highest duration of time for the specified number of days and/or the indication whether the primary pump 14 is properly sized. In an exemplary embodiment, the specified number of days is 6 days. However, one of ordinary skill in the art will appreciate that the specified number of days could be larger or smaller.

Additionally or alternatively, in exemplary embodiments, to determine the primary pump capacity, the processor determines the total duration of time that the primary pump 14 operated during a predetermined period of time. In exemplary embodiments, the predetermined period of time is an hour. However, one of ordinary skill in the art will appreciate that the predetermined period of time could be larger or smaller. If the predetermined period of time is an hour, then the processor determines the total duration of time that the primary pump 14 operated during each hour.

In exemplary embodiments, if the total duration of time that the primary pump 14 operated during the predetermined period of time is above a predetermined threshold, then the processor sends a signal to the user input/output module 28 indicating that the primary pump 14 may not be properly sized. The user input/output module 28 receives the signal from the processor and displays a notification to the user indicating that the primary pump 14 may not be properly sized.

In exemplary embodiments, the predetermined duration of time threshold is 20 minutes. In exemplary embodiments, if the number of times that the primary pump 14 operated during any hour is less than or equal to 20, then the primary pump 14 is likely properly sized. In exemplary embodiments, if the number of times that the primary pump 14 operated during any hour is greater than 20, then the primary pump 14 may not be properly sized (e.g., may be oversized). One of ordinary skill in the art will appreciate that the predetermined duration of time threshold could be larger or smaller.

Additionally or alternatively, in exemplary embodiments, to determine the primary pump capacity, the processor determines the number of times that the primary pump 14 operated during a predetermined period of time. In exemplary embodiments, the predetermined period of time is an hour. However, one of ordinary skill in the art will appreciate that the predetermined period of time could be larger or smaller. If the predetermined period of time is an hour, then the processor determines the number of times that the primary pump 14 operated during each hour.

In exemplary embodiments, if the number of times that the primary pump 14 operated during the predetermined period of time is above a predetermined threshold, then the processor sends a signal to the user input/output module 28 indicating that the primary pump 14 may not be properly sized. The user input/output module 28 receives the signal from the processor and displays a notification to the user indicating that the primary pump 14 may not be properly sized.

In exemplary embodiments, the predetermined number of times threshold is 20 times. In exemplary embodiments, if the number of times that the primary pump 14 operated during any hour is less than or equal to 20, then the primary pump 14 is likely properly sized. In exemplary embodiments, if the number of times that the primary pump 14 operated during any hour is greater than 20, then the primary pump 14 may not be properly sized (e.g., may be oversized). One of ordinary skill in the art will appreciate that the predetermined number of times threshold could be larger or smaller.

In exemplary embodiments, the processor determines the primary pump capacity (i.e., whether the primary pump 14 is properly sized) based on the highest percentage of time, the highest duration of time (or a percentage equivalent thereof), the total duration of time, and/or the number of times for each predetermined period of time. Generally, if the primary pump 14 is operating for long periods of time, then the primary pump 14 is likely undersized. Conversely, if the primary pump 14 is operating for a large number of times, then the primary pump 14 is likely oversized. Otherwise, the primary pump 14 is likely properly sized. The processor sends a signal to the user input/output module 28 indicating the primary pump capacity. The user input/output module 28 receives the signal from the processor and displays a notification to the user indicating the primary pump capacity.

Figure 18:
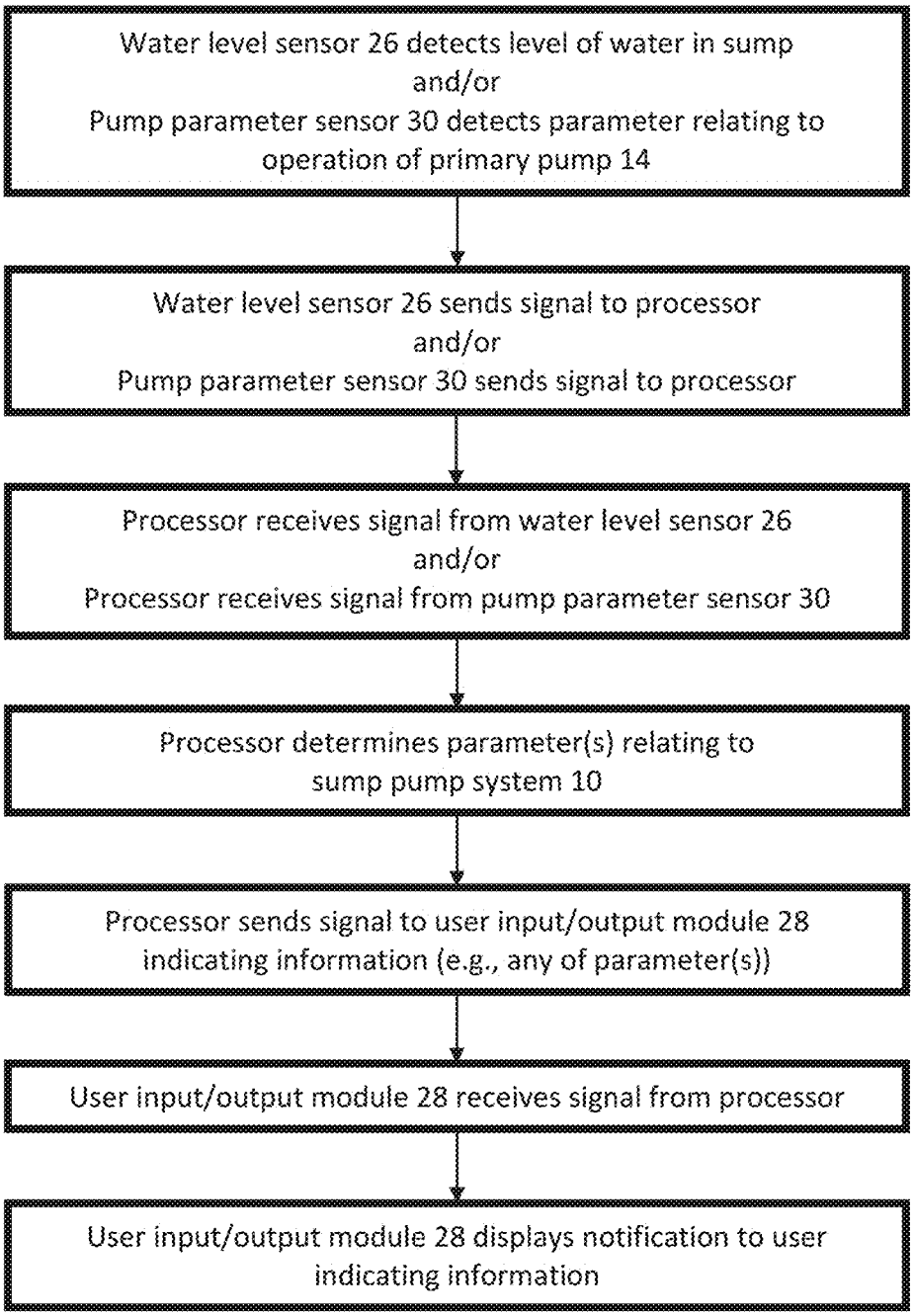
FIG. 18 is a flowchart illustrating operation of a sump pump system, including a sump pump monitor and application, according to an exemplary embodiment of the present invention.
Figure 19:
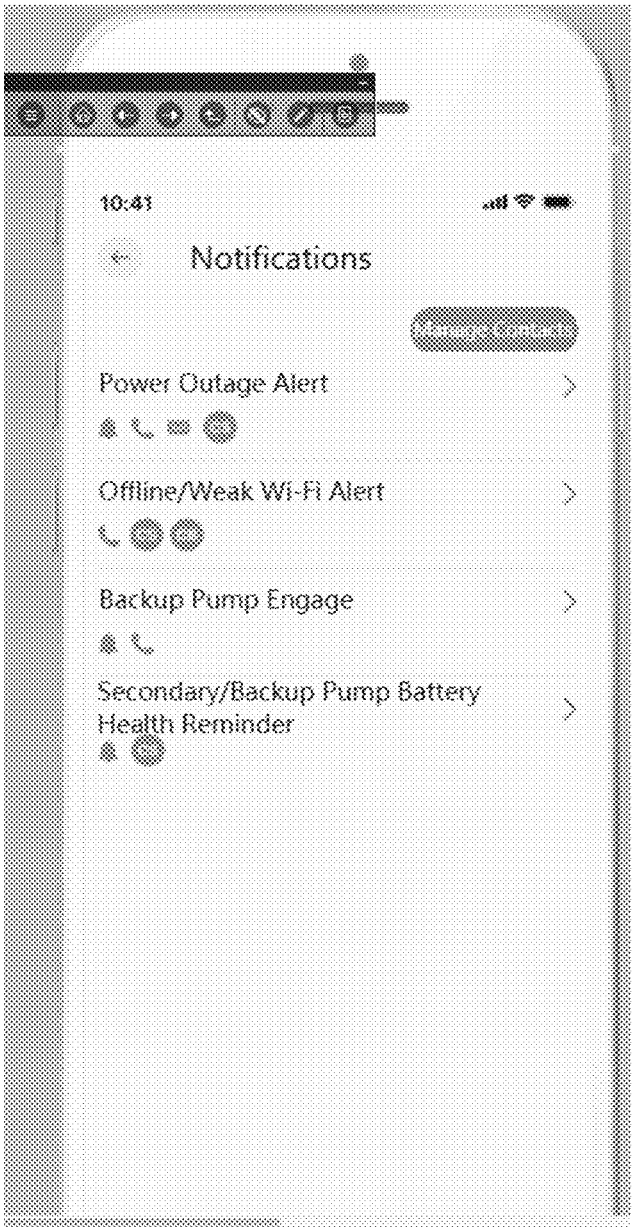
FIGS. 19-23 are illustrations of mobile device screens for inputting and displaying information regarding a wireless communication connection or network interface outage notification feature and a power outage notification feature according to exemplary embodiments of the present invention.
Figure 20:
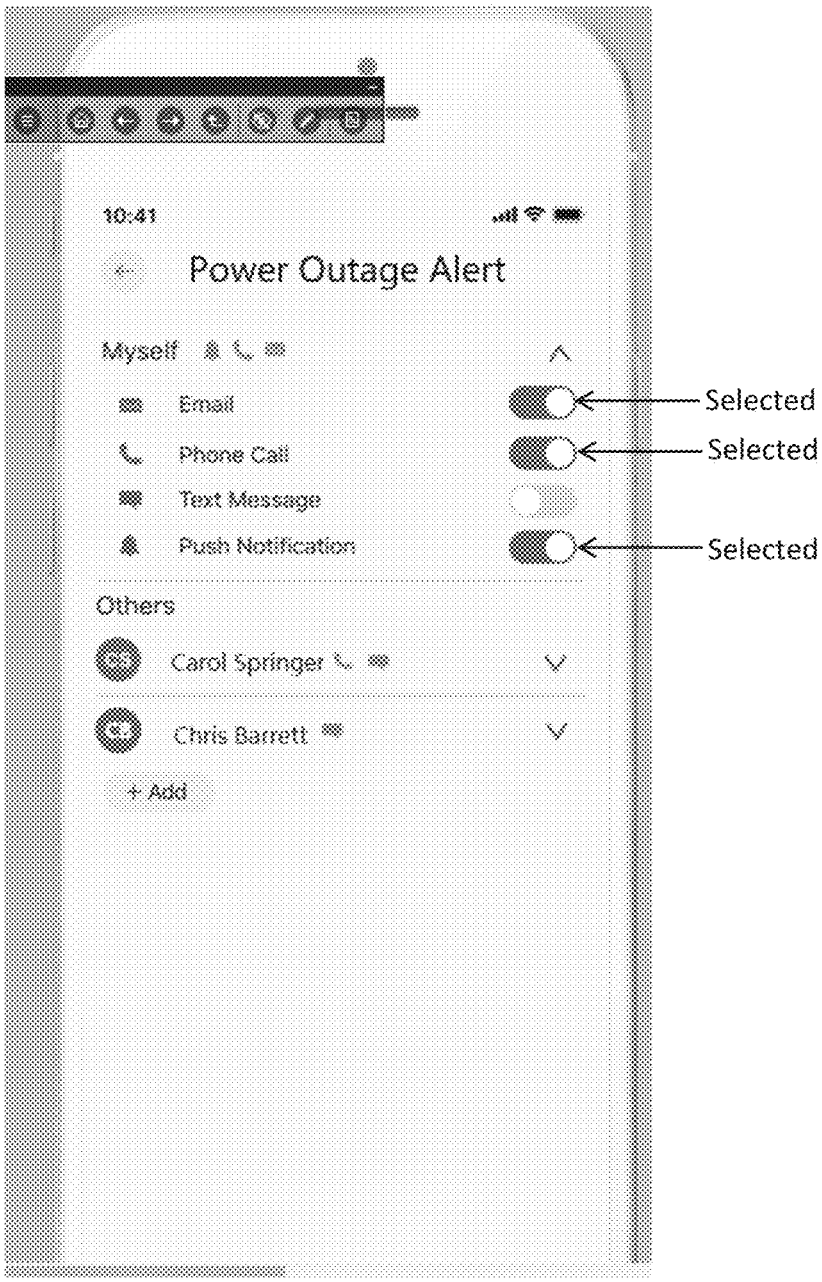
Figure 21:
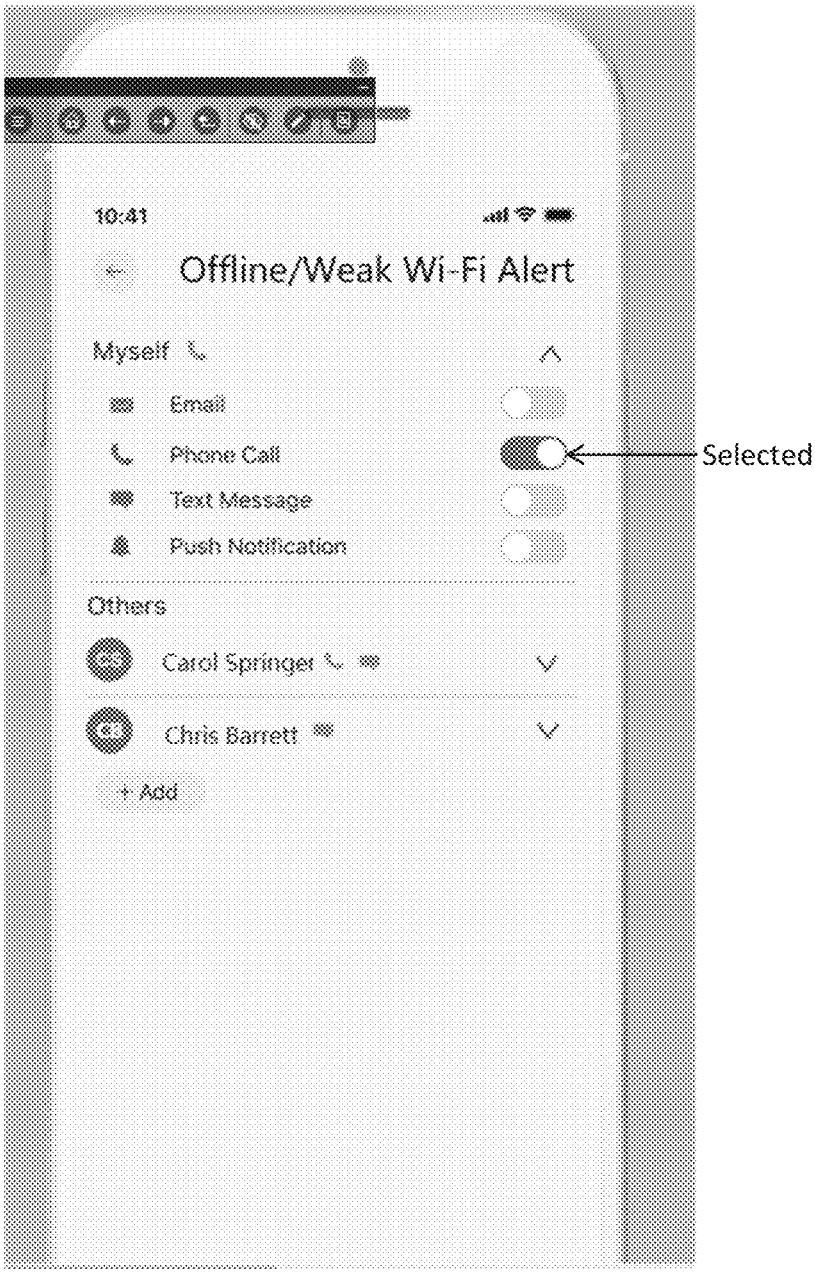

In exemplary embodiments, during operation of the sump pump system 10 (including the monitoring subsystems of the sump pump monitor 12 described in detail above), the water level sensor 26 detects the water level in the sump and/or the pump parameter sensor 30 detects the parameter relating to the operation of the primary pump 14. The water level sensor 26 sends the signal to the processor indicating the water level and/or the pump parameter sensor 30 sends the signal to the processor indicating the pump parameter. The processor receives the signal from the water level sensor 26 indicating the water level and/or the processor receives the signal from the pump parameter sensor 30 indicating the pump parameter. Based on the water level readings received from the water level sensor 26 and/or the pump parameter readings received from the pump parameter sensor 30, the processor determines a parameter(s) relating to the sump pump system 10 (e.g., to the primary pump 14 and/or the backup pump 20). The processor sends a signal to the user input/output module 28 (e.g., the mobile device 52 and/or the smart hub 54) indicating this information (e.g., any of the parameter(s) relating to the sump pump system 10). The user input/output module 28 (e.g., the mobile device 52 and/or the smart hub 54) receives the signal from the processor and displays a notification to the user indicating this information. These exemplary steps are illustrated in FIG. 18.

The following includes definitions of exemplary terms that may be used throughout the disclosure. Both singular and plural forms of all terms fall within each meaning.

"Computer" or "processor," as used herein includes, but is not limited to, one or more programmed or programmable electronic device or coordinated devices that can store, retrieve, or process data and may be any processing unit, distributed processing configuration, or processor systems. Examples of processor include microprocessors, microcontrollers, central processing units (CPUs), graphics processing units (GPUs), tensor processing unit (TPU), floating point units (FPUs), reduced instruction set computing (RISC) processors, digital signal processors (DSPs), field programmable gate arrays (FPGAs), etc., in any combination. One or more cores of a single microprocessor and/or multiple microprocessor each having one or more cores can be used to perform the operation as being executed by a processor herein. The processor can also be a processor dedicated to the training of neural networks and other artificial intelligence (AI) systems. The processor may be associated with various other circuits that support operation in the processor, such as random access memory (RAM), read-only memory (ROM), programmable read-only memory (PROM), erasable programmable read-only memory (EPROM), clocks, decoders, memory controllers, or interrupt controllers, etc. These support circuits may be internal or external to the processor or its associated electronic packaging. The support circuits are in operative communication with the processor. The support circuits are not necessarily shown separate from the processor in block diagrams or drawings.

"Network interface," synonymous with "data interface," as used herein includes, but is not limited to, any interface or protocol for transmitting and receiving data between electronic devices. The network or data interface can refer to a connection to a computer via a local network or through the internet and can also refer to a connection to a portable device— e.g., a mobile device or a USB thumb drive—via a wired or wireless connection. A network interface can be used to form networks of computers to facilitate distributed and/or remote computing (i.e., cloud-based computing). "Cloud-based computing" means computing that is implemented on a network of computing devices that are remotely connected to the device via a network interface.

"Signal," as used herein includes, but is not limited to, one or more electric signals, including analog or digital signals, one or more computer instructions, a bit or bit stream, or the like.

"Logic," synonymous with "circuit," as used herein includes but is not limited to hardware, firmware, software and/or combinations of each to perform a function(s) or action(s). For example, based on a desired application or needs, logic may include a software-controlled microprocessor, discrete logic such as an application specific integrated circuit (ASIC), or other programmed logic device and/or controller. Logic may also be fully embodied as software. The logic flow of an embodiment of the invention could be embodied in logic.

"Software," as used herein includes, but is not limited to, one or more computer readable and/or executable instructions that cause a computer, processor, logic, and/or other electronic device to perform functions, actions, and/or behave in a desired manner. The instruments may be embodied in various forms such as routines, algorithms, modules, or programs including separate applications or code from dynamically linked sources or libraries (DLLs). Software may also be implemented in various forms such as a stand-alone program, a web-based program, a function call, a subroutine, a servlet, an application, an app, an applet (e.g., a Java applet), a plug-in, instructions stored in a memory, part of an operating system, or other type of executable instructions or interpreted instructions from which executable instructions are created. The logic flow of an embodiment of the invention could be embodied in software.

"Module" or "engine" as used herein will be appreciated as comprising various configurations of computer hardware and/or software implemented to perform operations. In some embodiments, modules or engines as described herein may be represented as instructions operable to be executed by a processor in a processor or memory. In other embodiments, modules or engines as described herein may be represented as instructions read or executed from readable media. A module or engine may operate in either hardware or software according to application specific parameters or user settings. It will be appreciated by those of skill in the art that such configurations of hardware and software may vary, but remain operable in substantially similar ways. The logic flow of an embodiment of the invention could be embodied in a module or engine.

"Data storage device," as used herein includes, but is not limited to, a device or devices for non-transitory storage of code or data, e.g., a device with a non-transitory computer readable medium. As used herein, "non-transitory computer readable medium" mean any suitable non-transitory computer readable medium for storing code or data, such as a magnetic medium, e.g., fixed disks in external hard drives, fixed disks in internal hard drives, and flexible disks; an optical medium, e.g., CD disk, DVD disk; and other media, e.g., ROM, PROM, EPROM, EEPROM, flash PROM, external memory drives, etc. The memory of an embodiment of the invention could be embodied in a data storage device.

While the above exemplary definitions have been provided, it is intended that the broadest reasonable interpretation consistent with this specification be used for these and other terms. Aspects and implementations of the present disclosure will be understood more fully from the detailed description given above and from the accompanying drawings of the various aspects and implementations of the disclosure. This should not be taken to limit the disclosure to the specific aspects or implementations, but is for explanation and understanding only.

One of ordinary skill in the art will now appreciate that the present invention provides a sump pump system, including a sump pump monitor and application. Although the present invention has been shown and described with reference to particular embodiments, equivalent alterations and modifications will occur to those skilled in the art upon reading and understanding this specification. The present invention includes all such equivalent alterations and modifications and is limited only by the scope of the following claims in light of their full scope of equivalents.

What is claimed is:

1. A sump pump system comprising:

a water level sensor, the water level sensor operable to detect a level of water in a sump;

a pump parameter sensor, the pump parameter sensor operable to detect a parameter relating to operation of a pump;

a user input/output module, the user input/output module operable to communicate with a user; and a processor, the processor operable to communicate with the water level sensor, the pump parameter sensor, and the user input/output module;

wherein the water level sensor is operable to detect the level of water in the sump and to send a signal to the processor indicating the detected water level;

wherein the pump parameter sensor is operable to detect the parameter relating to operation of the pump and to send a signal to the processor indicating the detected pump parameter;

wherein the processor is operable to receive the signal from the water level sensor indicating the detected water level and to receive the signal from the pump parameter sensor indicating the detected pump parameter;

wherein the processor is operable to determine at least one of a percentage of time that the pump operated during a predetermined period of time, a duration of time that the pump operated during the predetermined period of time, and a number of times that the pump operated during the predetermined period of time based on the detected pump parameter;

wherein the processor is operable to determine a pump capacity, the pump capacity indicating whether the pump is properly sized for an operating environment;

wherein the processor is operable to determine the pump capacity based on at least one of the percentage of time that the pump operated during the predetermined period of time, the duration of time that the pump operated during the predetermined period of time, and the number of times that the pump operated during the predetermined period of time;

wherein the processor is operable to send a signal to the user input/output module indicating the pump capacity; and wherein the user input/output module is operable to receive the signal from the processor indicating the pump capacity and to display a notification to the user indicating the pump capacity.

2. The sump pump system of claim 1, wherein:

the pump parameter sensor is a pump current sensor; and the pump current sensor is operable to detect whether current is flowing to the pump.

3. The sump pump system of claim 1, wherein:

the percentage of time that the pump operated during the predetermined period of time is compared to a threshold to determine the pump capacity.

4. The sump pump system of claim 1, wherein:

the percentage of time that the pump operated during the predetermined period of time is a highest percentage of time that the pump operated during a day.

5. The sump pump system of claim 1, wherein:

the duration of time that the pump operated during the predetermined period of time is compared to a threshold to determine the pump capacity.

6. The sump pump system of claim 1, wherein:

the duration of time that the pump operated during the predetermined period of time is a highest duration of time that the pump operated during a day.

7. The sump pump system of claim 1, wherein:

the duration of time that the pump operated during the predetermined period of time is a total duration of time that the pump operated during a day.

8. The sump pump system of claim 1, wherein:

the number of times that the pump operated during the predetermined period of time is compared to a threshold to determine the pump capacity.

9. The sump pump system of claim 1, wherein:

the number of times that the pump operated during the predetermined period of time is a total number of times that the pump operated during a day.

10. A sump pump system comprising:

a water level sensor, the water level sensor operable to detect a level of water in a sump;

a pump parameter sensor, the pump parameter sensor operable to detect a parameter relating to operation of a pump;

a user input/output module, the user input/output module operable to communicate with a user; and a processor, the processor operable to communicate with the water level sensor, the pump parameter sensor, and the user input/output module;

wherein the water level sensor is operable to detect the level of water in the sump and to send a signal to the processor indicating the detected water level;

wherein the pump parameter sensor is operable to detect the parameter relating to operation of the pump and to send a signal to the processor indicating the detected pump parameter;

wherein the processor is operable to receive the signal from the water level sensor indicating the detected water level and to receive the signal from the pump parameter sensor indicating the detected pump parameter;

wherein the processor is operable to determine at least two of a percentage of time that the pump operated during a predetermined period of time, a duration of time that the pump operated during the predetermined period of time, and a number of times that the pump operated during the predetermined period of time based on the detected pump parameter;

wherein the processor is operable to determine a pump capacity, the pump capacity indicating whether the pump is properly sized for an operating environment;

wherein the processor is operable to determine the pump capacity based on at least two of the percentage of time that the pump operated during the predetermined period of time, the duration of time that the pump operated during the predetermined period of time, and the number of times that the pump operated during the predetermined period of time;

wherein the processor is operable to send a signal to the user input/output module indicating the pump capacity; and wherein the user input/output module is operable to receive the signal from the processor indicating the pump capacity and to display a notification to the user indicating the pump capacity.

11. The sump pump system of claim 10, wherein:

the pump parameter sensor is a pump current sensor; and the pump current sensor is operable to detect whether current is flowing to the pump.

12. The sump pump system of claim 10, wherein:

the percentage of time that the pump operated during the predetermined period of time is compared to a threshold to determine the pump capacity.

13. The sump pump system of claim 10, wherein:

the percentage of time that the pump operated during the predetermined period of time is a highest percentage of time that the pump operated during a day.

14. The sump pump system of claim 10, wherein:

the duration of time that the pump operated during the predetermined period of time is compared to a threshold to determine the pump capacity.

15. The sump pump system of claim 10, wherein:

the duration of time that the pump operated during the predetermined period of time is a highest duration of time that the pump operated during a day.

16. The sump pump system of claim 10, wherein:

the duration of time that the pump operated during the predetermined period of time is a total duration of time that the pump operated during a day.

17. The sump pump system of claim 10, wherein:

the number of times that the pump operated during the predetermined period of time is compared to a threshold to determine the pump capacity.

18. The sump pump system of claim 10, wherein:

the number of times that the pump operated during the predetermined period of time is a total number of times that the pump operated during a day.

19. A sump pump system comprising:

a water level sensor, the water level sensor operable to detect a level of water in a sump;

a pump parameter sensor, the pump parameter sensor operable to detect a parameter relating to operation of a pump;

a user input/output module, the user input/output module operable to communicate with a user; and a processor, the processor operable to communicate with the water level sensor, the pump parameter sensor, and the user input/output module;

wherein the water level sensor is operable to detect the level of water in the sump and to send a signal to the processor indicating the detected water level;

wherein the pump parameter sensor is operable to detect the parameter relating to operation of the pump and to send a signal to the processor indicating the detected pump parameter;

wherein the processor is operable to receive the signal from the water level sensor indicating the detected water level and to receive the signal from the pump parameter sensor indicating the detected pump parameter;

wherein the processor is operable to determine a percentage of time that the pump operated during a predetermined period of time, a duration of time that the pump operated during the predetermined period of time, and a number of times that the pump operated during the predetermined period of time based on the detected pump parameter;

wherein the processor is operable to determine a pump capacity, the pump capacity indicating whether the pump is properly sized for an operating environment;

wherein the processor is operable to determine the pump capacity based on the percentage of time that the pump operated during the predetermined period of time, the duration of time that the pump operated during the predetermined period of time, and the number of times that the pump operated during the predetermined period of time;

wherein the processor is operable to send a signal to the user input/output module indicating the pump capacity; and wherein the user input/output module is operable to receive the signal from the processor indicating the pump capacity and to display a notification to the user indicating the pump capacity.

20. The sump pump system of claim 19, wherein:

the pump parameter sensor is a pump current sensor; and the pump current sensor is operable to detect whether current is flowing to the pump.

* * * * *